US009945550B2

(12) United States Patent
Zhou et al.

(10) Patent No.: US 9,945,550 B2
(45) Date of Patent: Apr. 17, 2018

(54) HIGH-BAY LIGHT-EMITTING DIODE (LED) LIGHT FIXTURE

(71) Applicant: FINTRONX, LLC, Raleigh, NC (US)

(72) Inventors: Dong Zhou, Cary, NC (US); Alan Darrell King, Raleigh, NC (US)

(73) Assignee: Fintronx, LLC, Raleigh, NC (US)

( * ) Notice: Subject to any disclaimer, the term of this patent is extended or adjusted under 35 U.S.C. 154(b) by 0 days.

(21) Appl. No.: 15/421,590

(22) Filed: Feb. 1, 2017

(65) Prior Publication Data

US 2017/0219201 A1 Aug. 3, 2017

Related U.S. Application Data

(60) Provisional application No. 62/290,735, filed on Feb. 3, 2016, provisional application No. 62/327,088, filed on Apr. 25, 2016, provisional application No. 62/376,141, filed on Aug. 17, 2016.

(51) Int. Cl.

| | |
|---|---|
| ***F21V 29/00*** | (2015.01) |
| ***F21V 29/76*** | (2015.01) |
| ***F21V 21/088*** | (2006.01) |
| ***F21V 31/00*** | (2006.01) |
| ***F21V 23/00*** | (2015.01) |
| ***F21V 23/04*** | (2006.01) |
| ***H05B 33/08*** | (2006.01) |
| ***F21V 19/00*** | (2006.01) |
| ***F21V 29/508*** | (2015.01) |
| *F21V 3/00* | (2015.01) |
| *F21V 17/12* | (2006.01) |
| *H05B 37/02* | (2006.01) |
| *F21Y 115/10* | (2016.01) |

(52) U.S. Cl.
CPC ..... *F21V 29/767* (2015.01); *F21V 19/0055* (2013.01); *F21V 21/088* (2013.01); *F21V 23/008* (2013.01); *F21V 23/0471* (2013.01); *F21V 29/508* (2015.01); *F21V 31/005* (2013.01); *H05B 33/0854* (2013.01); *H05B 33/0887* (2013.01); *H05B 33/0893* (2013.01); *F21V 3/00* (2013.01); *F21V 17/12* (2013.01); *F21Y 2115/10* (2016.08); *H05B 37/0272* (2013.01)

(58) Field of Classification Search
CPC .... F21V 29/508; F21V 29/767; F21V 21/088; F21V 31/005; F21V 23/008; F21V 23/0471; F21V 3/00; F21V 17/12; F21V 19/0055; H05B 33/0854; H05B 33/0887; H05B 37/0272
See application file for complete search history.

(56) References Cited

U.S. PATENT DOCUMENTS 9,476,581 B2 * 10/2016 Wu ..... F21V 31/005
2014/0307441 A1 * 10/2014 Wu ..... F21V 31/005 362/267

* cited by examiner

*Primary Examiner* — Thomas M Sember
(74) *Attorney, Agent, or Firm* — Ward and Smith, P.A.; Ryan K. Simmons

(57) ABSTRACT

A high-bay light-emitting diode (LED) light fixture including, a driver chamber assembly, a hook assembly, and an LED assembly. The driver chamber assembly further includes a driver chamber body that houses a driver module and/or a controller module, and a driver chamber cap. The hook assembly further includes a hook and a hook clip. The LED assembly further includes a light board, an LED module that supports an arrangement of LEDs, and a lens.

31 Claims, 57 Drawing Sheets

HIGH-BAY LIGHT-EMITTING DIODE (LED) LIGHT FIXTURE

RELATED APPLICATIONS

This application claims priority to and incorporates herein by reference related U.S. Provisional Patent Application Nos. 62/290,735, entitled "High-Bay Light-Emitting Diode (LED) Light Fixture" filed on Feb. 3, 2016; 62/327,088, entitled "High-Bay Light-Emitting Diode (LED) Light Fixture" filed on Apr. 25, 2016; and 62/376,141, entitled "High-Bay Light-Emitting Diode (LED) Light Fixture" filed on Aug. 17, 2016.

TECHNICAL FIELD

The presently disclosed subject matter relates generally to light-emitting diode (LED) fixtures and applications thereof and more particularly to a high-bay LED light fixture.

BACKGROUND

As compared with standard incandescent lights, fluorescent lights, and halogen lights, the main benefits of using light-emitting diode (LED) technology for lighting applications is longer life and less energy usage. For example, a 40-watt incandescent bulb or a 10- to 12-watt compact fluorescent light (CFL) bulb is needed to generate 450 lumens of light. By contrast, a 4- to 5-watt LED bulb can generate 450 lumens of light. Further, with respect to lifetime, one can expect to replace an incandescent bulb more than 40 times and a CFL bulb about 5 times over a period of 50 k hours. By contrast, one can expect to replace an LED bulb only once over the same period of time.

Unfortunately, the cost of implementing LED technology for lighting applications has been prohibitive to widespread adoption. As significant advances are being made in LED technology, however, it is now becoming cost-effective to use such technology for general lighting applications.

SUMMARY

In some aspects, the presently disclosed subject matter provides a waterproof, dust tight, chemical resistant high-bay LED light fixture for use in harsh commercial and industrial environments.

In one aspect, the presently disclosed subject matter provides a high-bay light emitting diode (LED) fixture comprising a driver chamber assembly and an LED assembly: wherein the driver chamber assembly comprises: (i) a driver chamber body comprising an LED driver module and a controller module operationally positioned therein; and (ii) a driver chamber cap, wherein a lower portion of the driver chamber cap is mechanically coupled to an upper end of the driver chamber assembly, wherein the driver chamber assembly further comprises a seal ring sandwiched between the upper end of the driver chamber body and the lower portion of the driver chamber cap, thereby forming a waterproof seal between the driver chamber body and the driver chamber cap; wherein the driver chamber body comprises a plurality of ridges or ribs running along a length of an outer surface of the driver chamber body and arranged parallel to one another; wherein the LED assembly comprises a light board comprising an LED module, wherein the LED module comprises a plurality of LEDs arranged on a substrate and a lens, wherein the lens is attached to the light board and adapted to cover the LED module; wherein the light board comprises a mating portion adapted to receive a lower end of the driver chamber body and a seal ring sandwiched between the lower end of the driver chamber body and the mating portion of the light board, thereby providing a waterproof seal between the light board and the driver chamber body; wherein the light board further comprises a plurality of ridges or ribs extending radially from the mating portion to an outer periphery of the light board; and wherein an outer surface of the driver chamber assembly and an outer surface of the LED assembly are coated with an anti-corrosive powder and a high emissivity coating.

In another aspect, the presently disclosed subject matter provides a high-bay light emitting diode (LED) fixture comprising a driver chamber assembly and an LED assembly, wherein: the driver chamber assembly comprises a driver chamber body and a driver heat sink, wherein the driver chamber body and driver heat sink are mechanically coupled and operationally arranged with respect to a hollow shaft running axially through a center of the driver chamber assembly; wherein the driver chamber body comprises a plurality of ridges or ribs running parallel to the hollow shaft and arranged parallel to one another along an outer surface of the driver chamber body; wherein the driver heat sink comprises a plurality of fin members, wherein two fin members and one surface of the drive heat sink in combination with an inner surface of the driver chamber body form four sides of a compartment adapted to enclose a LED driver module; wherein the driver chamber body further comprises a heat pad positioned between the LED driver module and the inner surface of the driver chamber body, wherein the heat pad is in contact with one side of the LED driver module and the inner surface of the driver chamber body forming the compartment adapted to enclose the LED driver module; wherein the driver chamber assembly further comprises a driver chamber cap fitted against an upper portion of the driver chamber body, wherein the driver chamber cap further comprises a seal forming a waterproof seal with the driver chamber assembly; wherein the driver chamber assembly comprises a driver chamber base fitted against a lower portion of the driver chamber body and wherein the LED assembly is mechanically coupled to a lower portion of the driver chamber base through a mating portion, wherein the mating portion comprises a seal ring forming a waterproof seal with the driver chamber base; wherein the LED assembly comprises a light board comprising an LED module, wherein the LED module comprises a plurality of LEDs arranged on a substrate and a lens, wherein the lens is attached to the light board and adapted to cover the LED module, wherein an outer surface of the light board comprises a plurality of ridges or ribs extending radially from the mating portion to an outer periphery of the light board; and wherein an outer surface of the driver chamber assembly and an outer surface of the LED assembly are coated with an anti-corrosive powder and a high emissivity coating.

In particular embodiments of the presently disclosed high-bay LED fixture, the seal ring sandwiched between the upper end of the driver chamber body and the lower portion of the driver chamber cap comprises a translucent material through which one or more status conditions of one or more components of the high-bay LED fixture can be visually indicated.

In yet another aspect, the presently disclosed high-bay LED fixture include one or more design features, including ridges or ribs, fins, and combinations thereof, along with non-electrically conductive and non-thermally conductive seals positioned between components of the fixture and high emissivity coatings to increase heat dissipation through radiation. Accordingly, the presently disclosed high-bay LED light fixture can operate efficiently in an ambient temperature range of, for example, from about −40° C. (−40° F.) to about 65° C. (149° F.).

For example, a thermal test of the presently disclosed device showed a reduction in temperature on the surface of the various fixture components. Compared with the power coating generally available on the market, a high emissivity coating reduces the temperature on the surface of light board by about 5° C. to 7° C. The non-electrically conductive and non-thermally conductive seal ring reduces the temperature between the light board and driver housing by about 10° C. Making the surface of the lighting board rigid increases the effective heat dissipation from the surface by more than 50%. Further, the multi-chambered structure driver housing reduces the temperature on the outside surface of the driver housing by about 2 to 3° C. due to improved heat dissipation efficiency.

Certain aspects of the presently disclosed subject matter having been stated hereinabove, which are addressed in whole or in part by the presently disclosed subject matter, other aspects will become evident as the description proceeds when taken in connection with the accompanying Examples and Drawings as best described herein below.

BRIEF DESCRIPTION OF THE DRAWINGS

Figure 1:
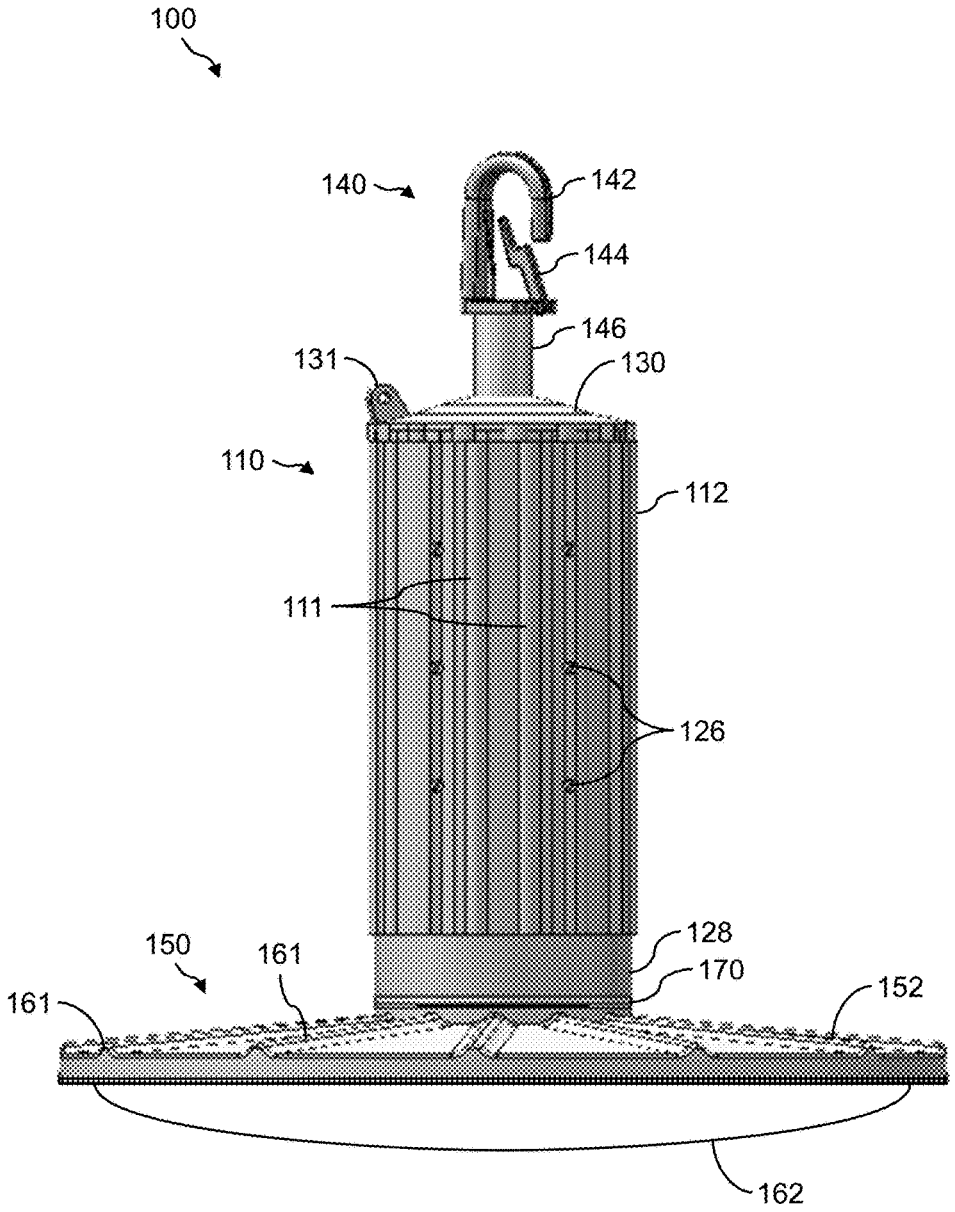
Figure 2:
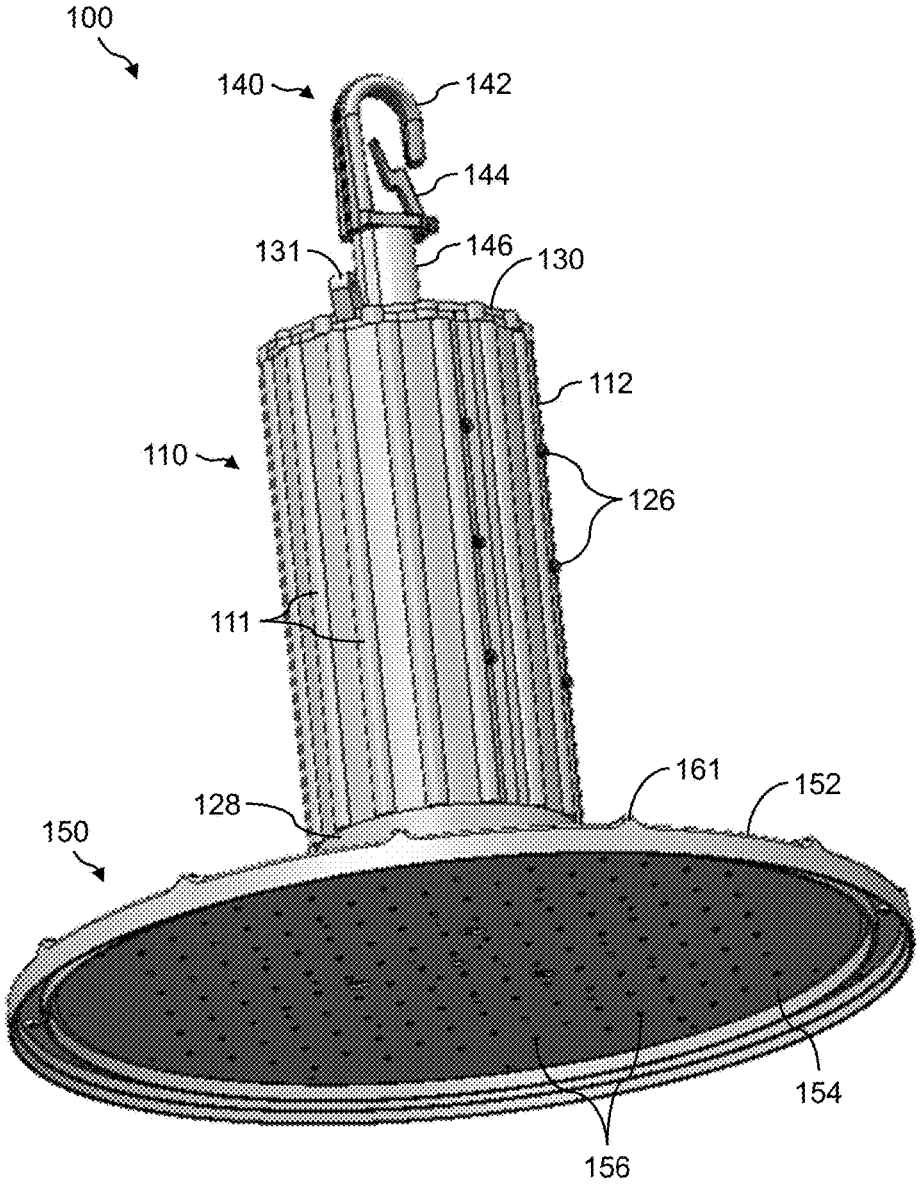
Figure 3:
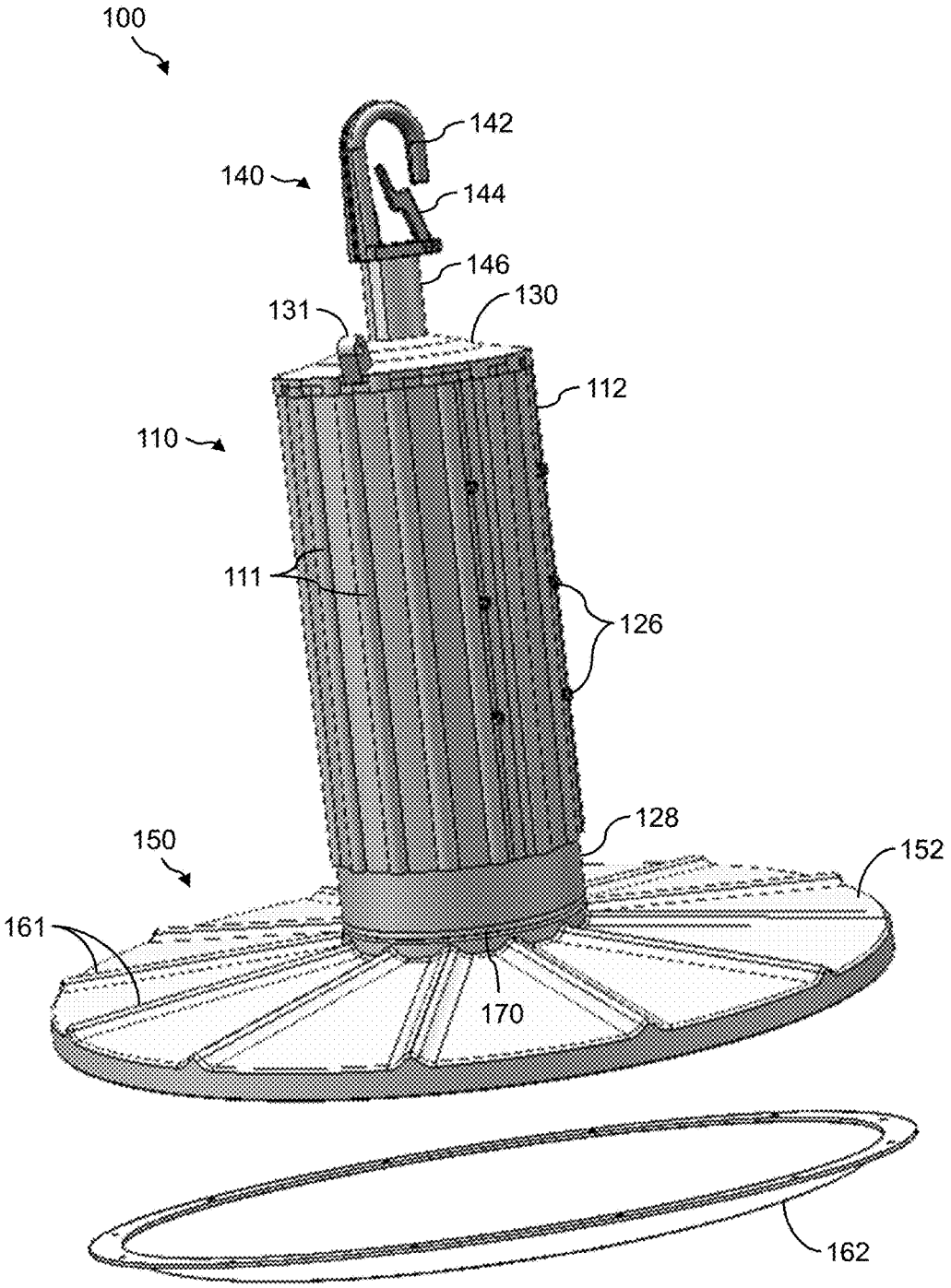
Figure 4:
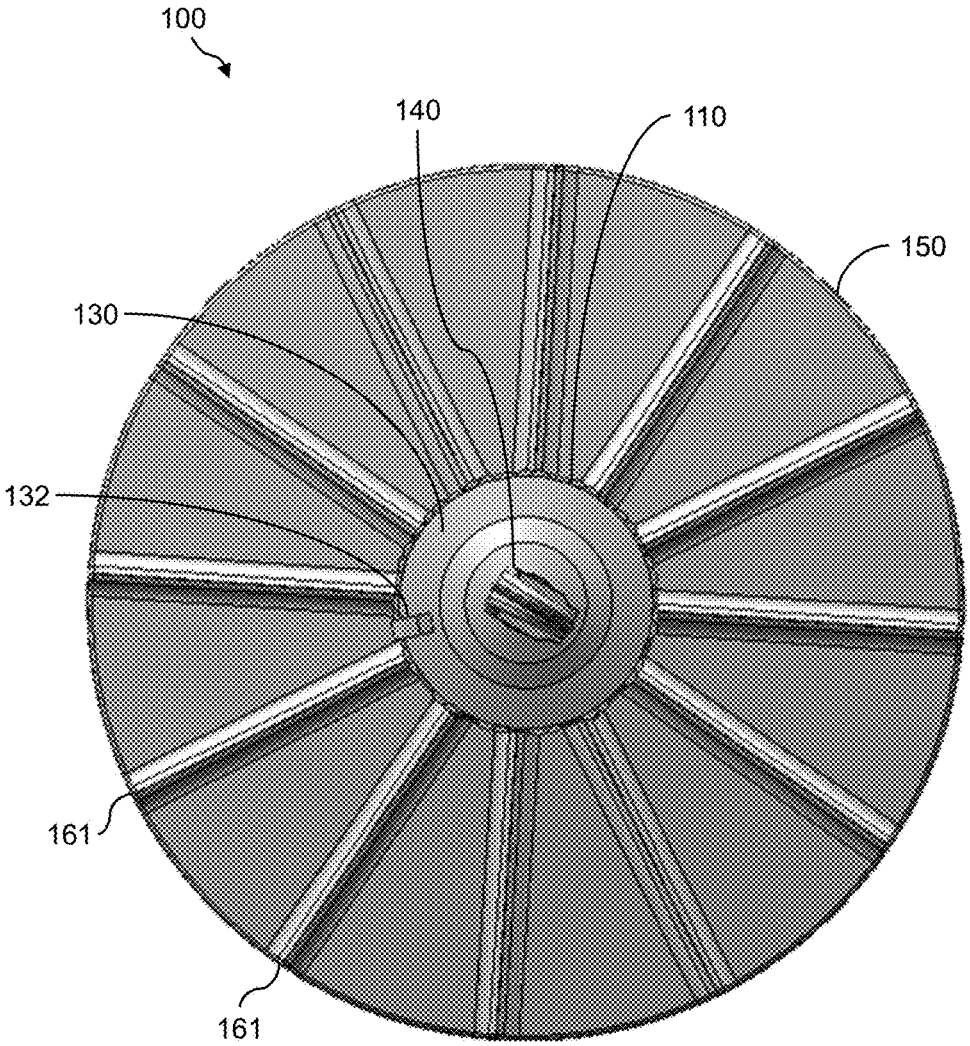
Figure 5:
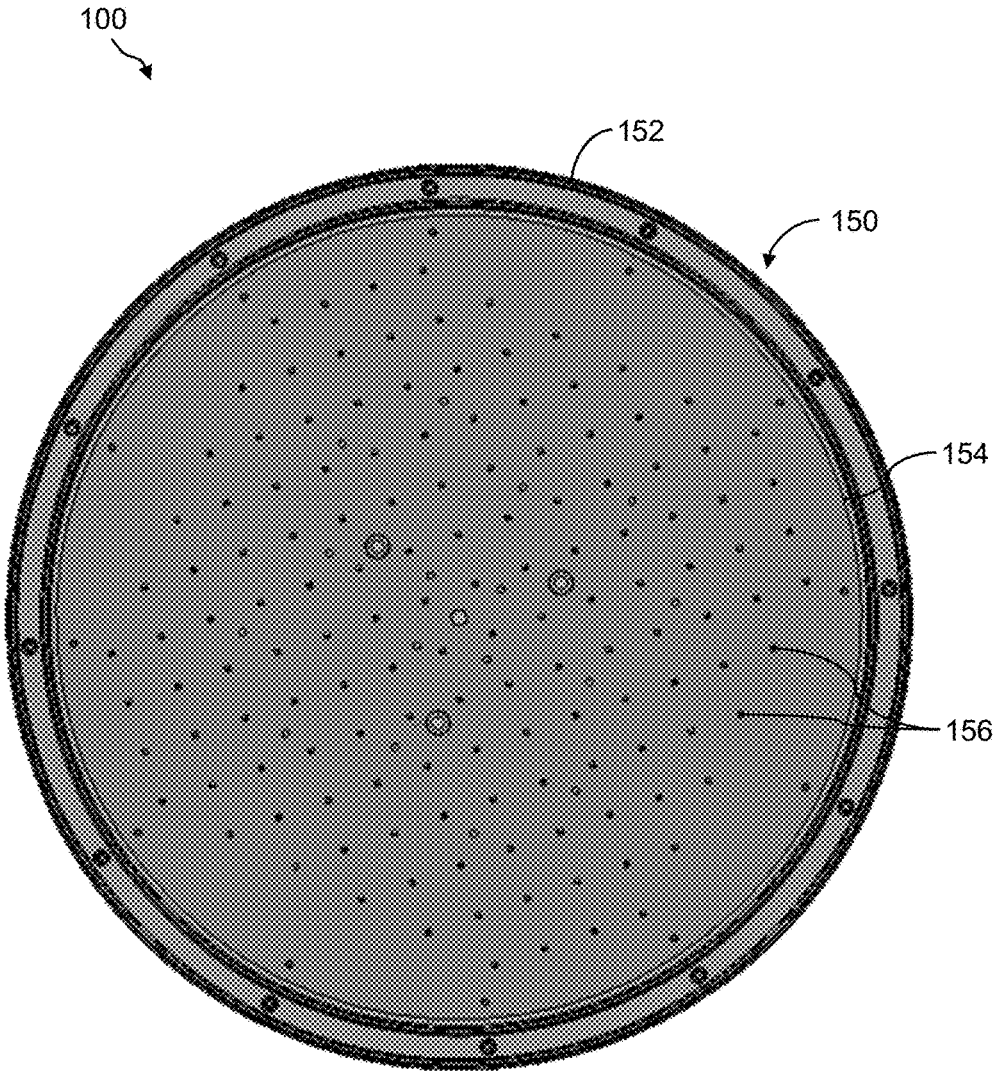
Figure 6:
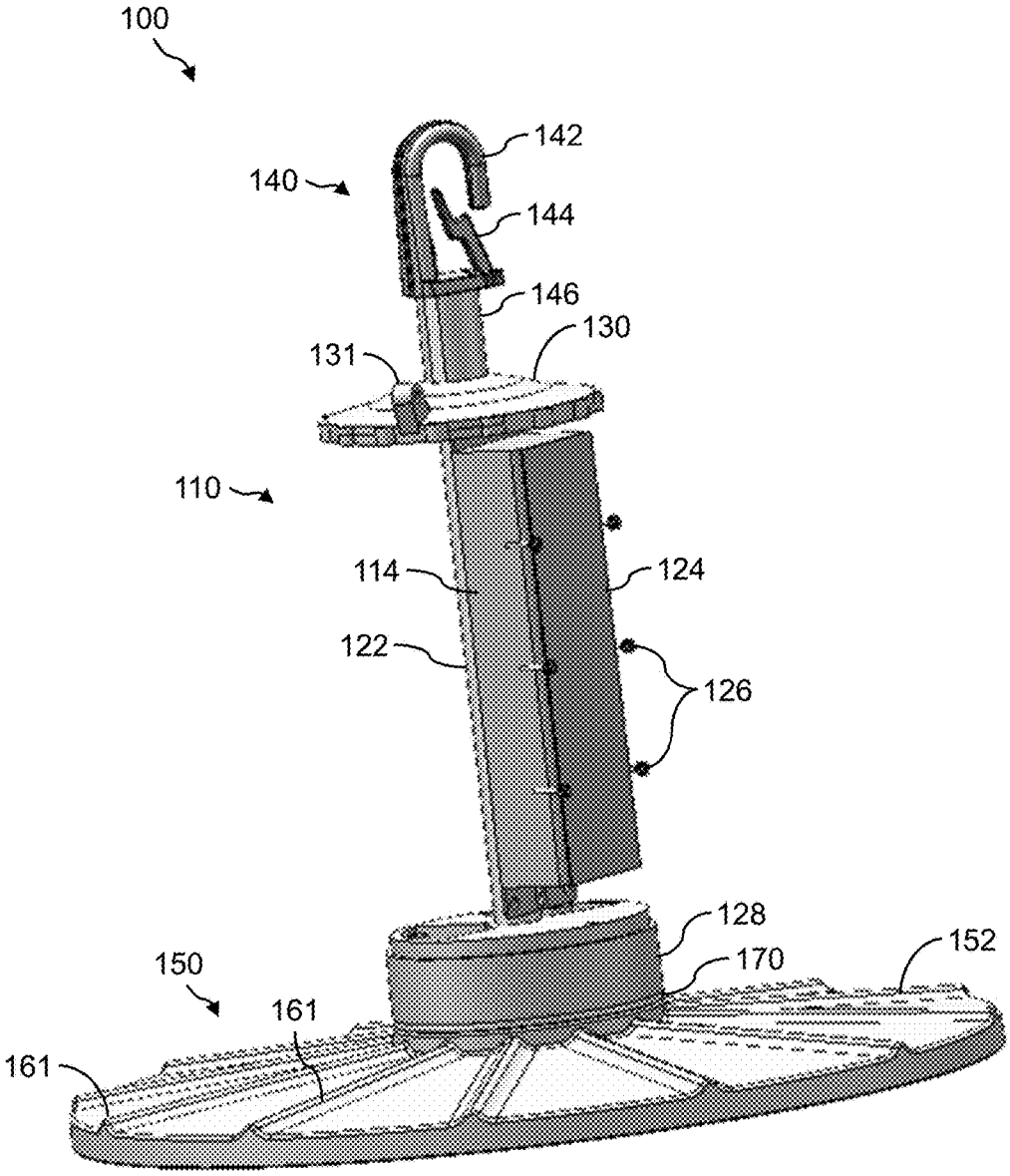
Figure 7:
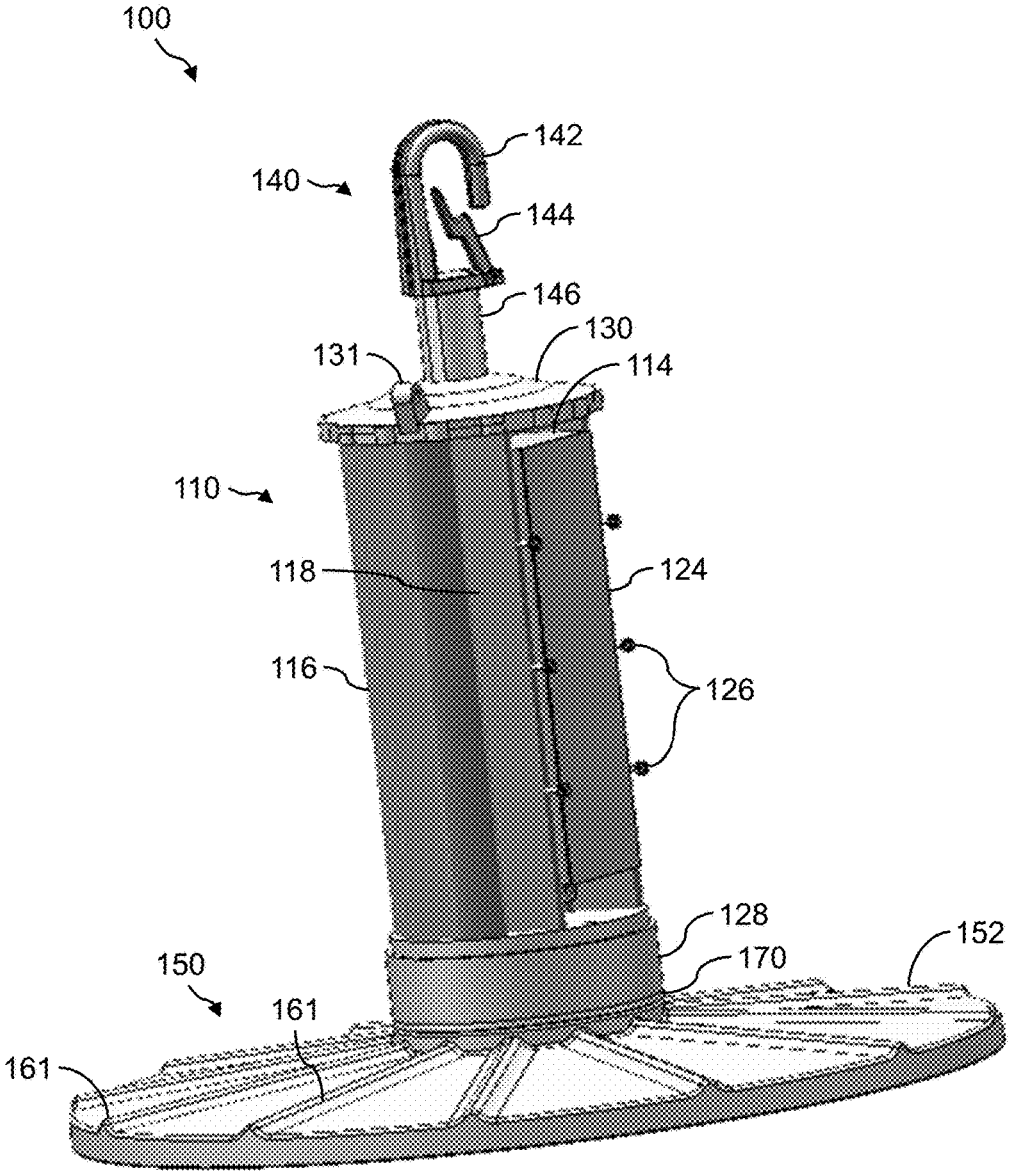
Figure 8:
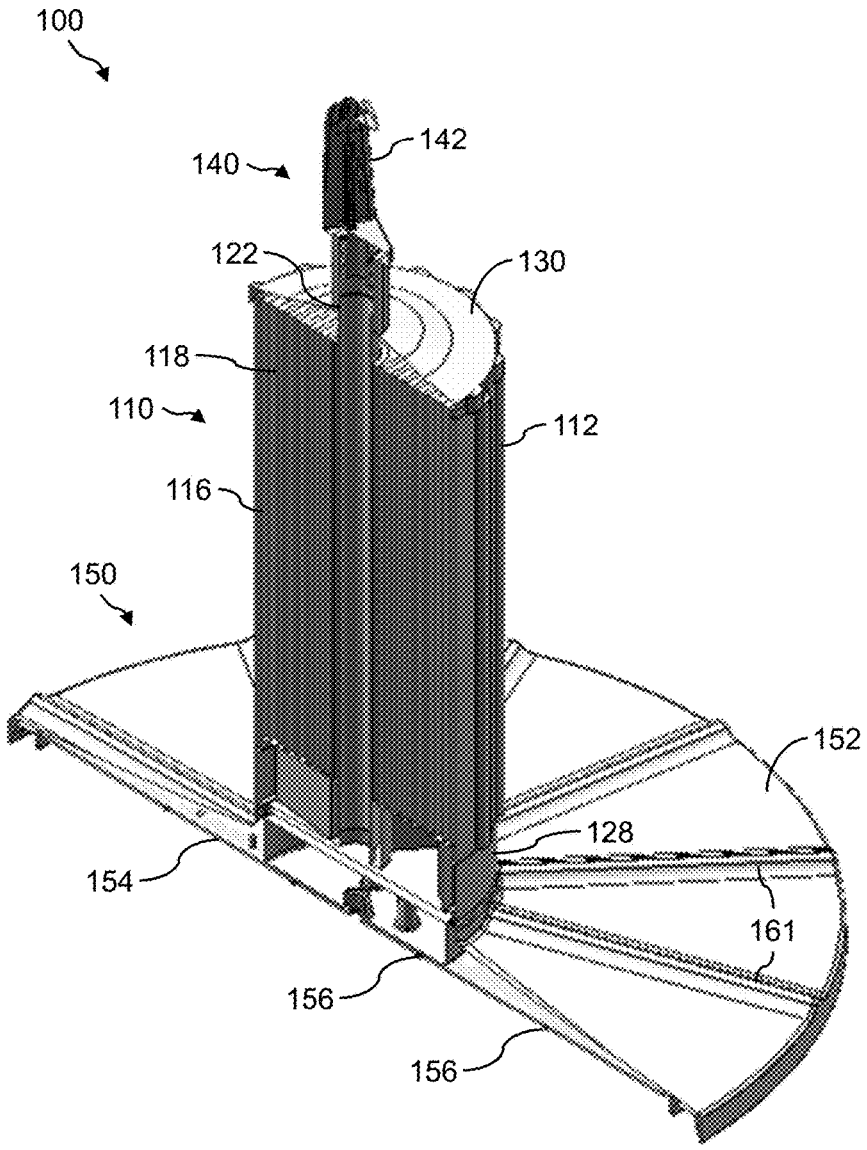
Figure 9:
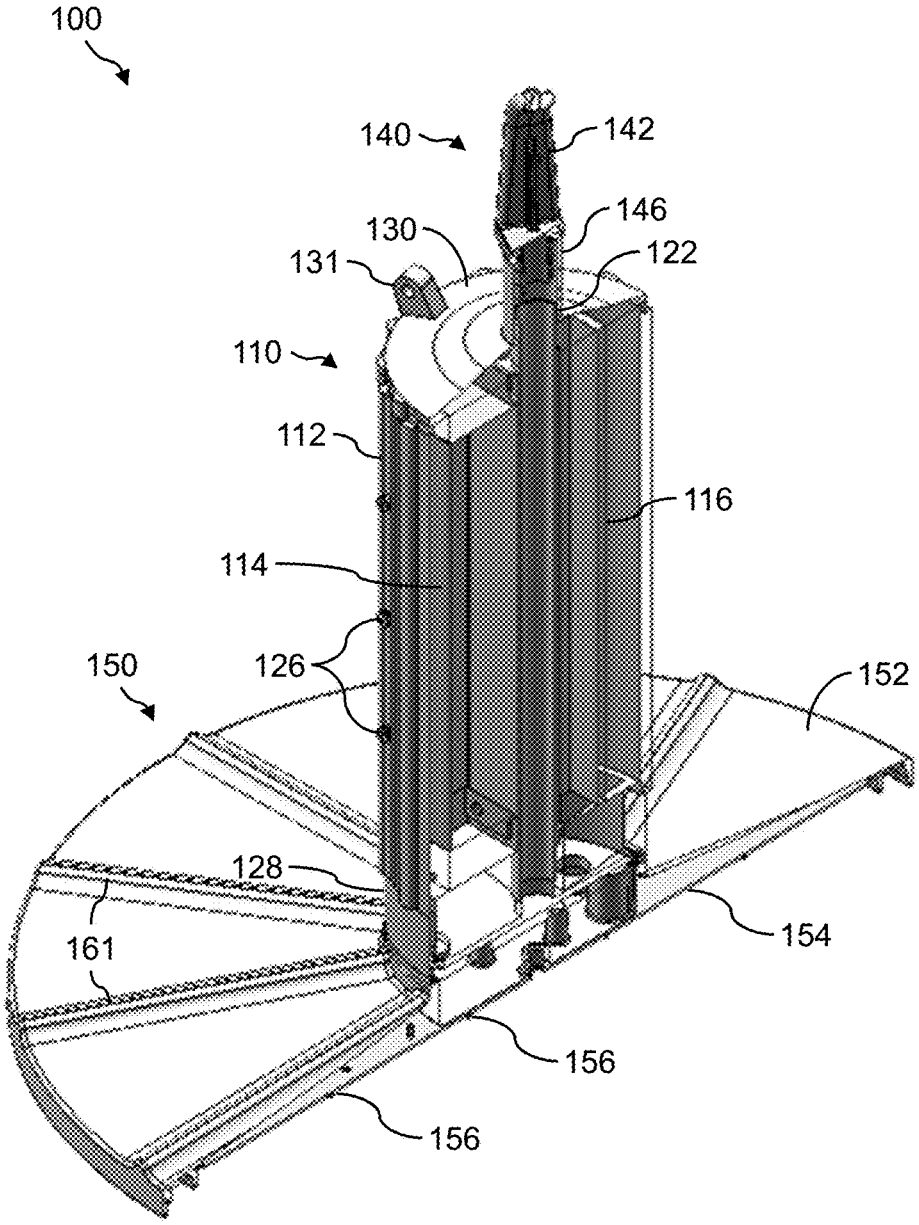
Figure 10:
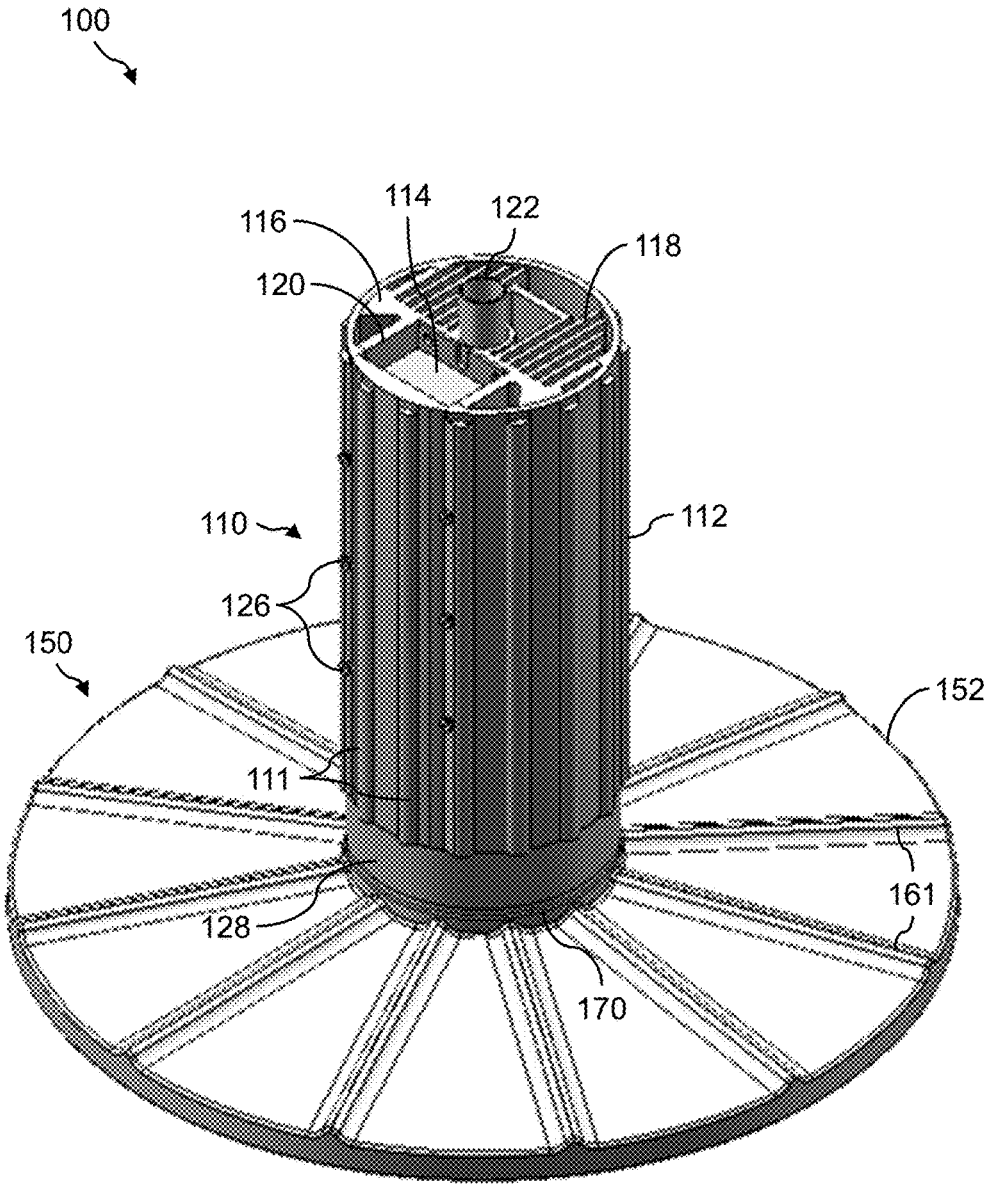
Figure 11:
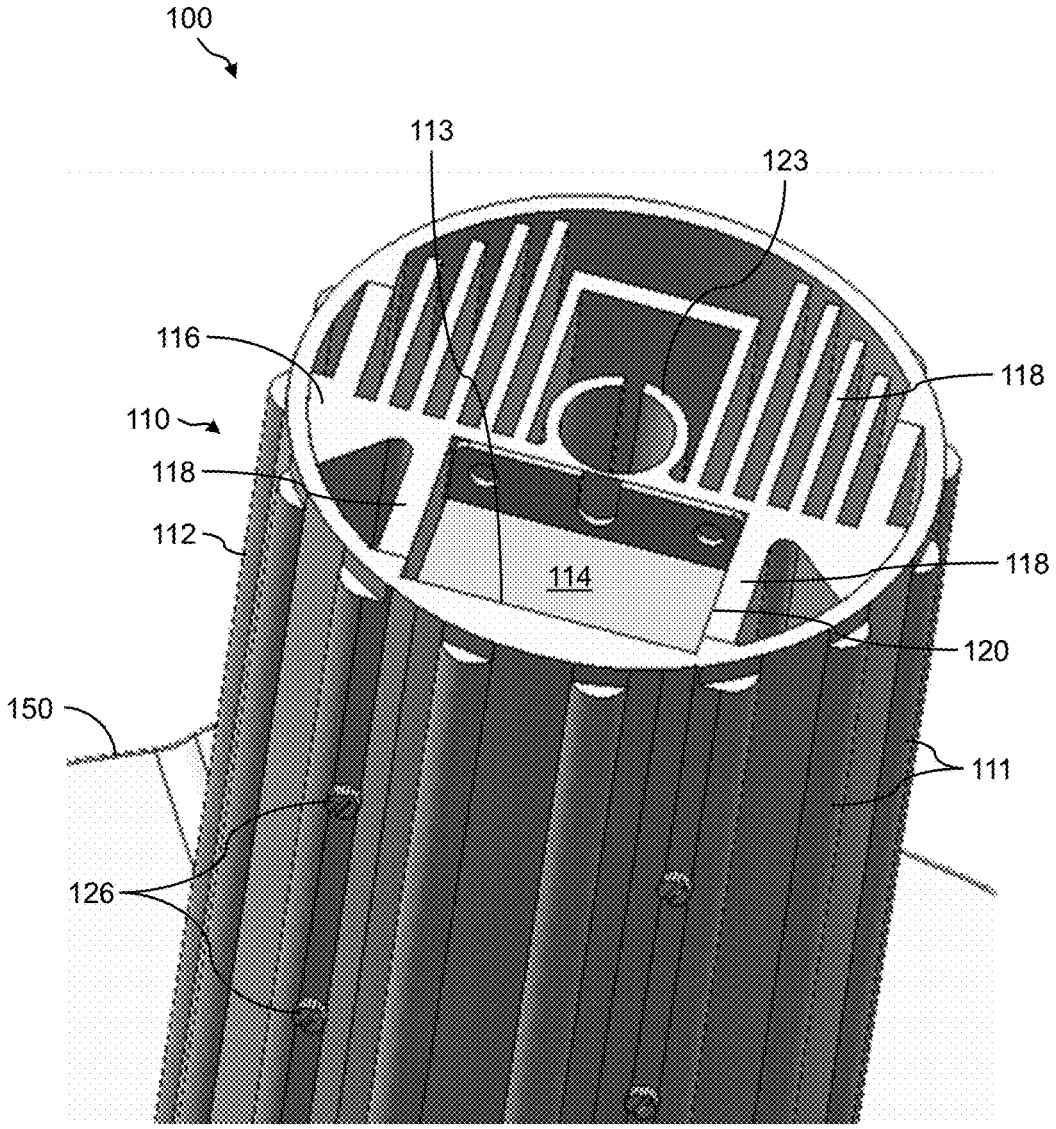
Figure 12:
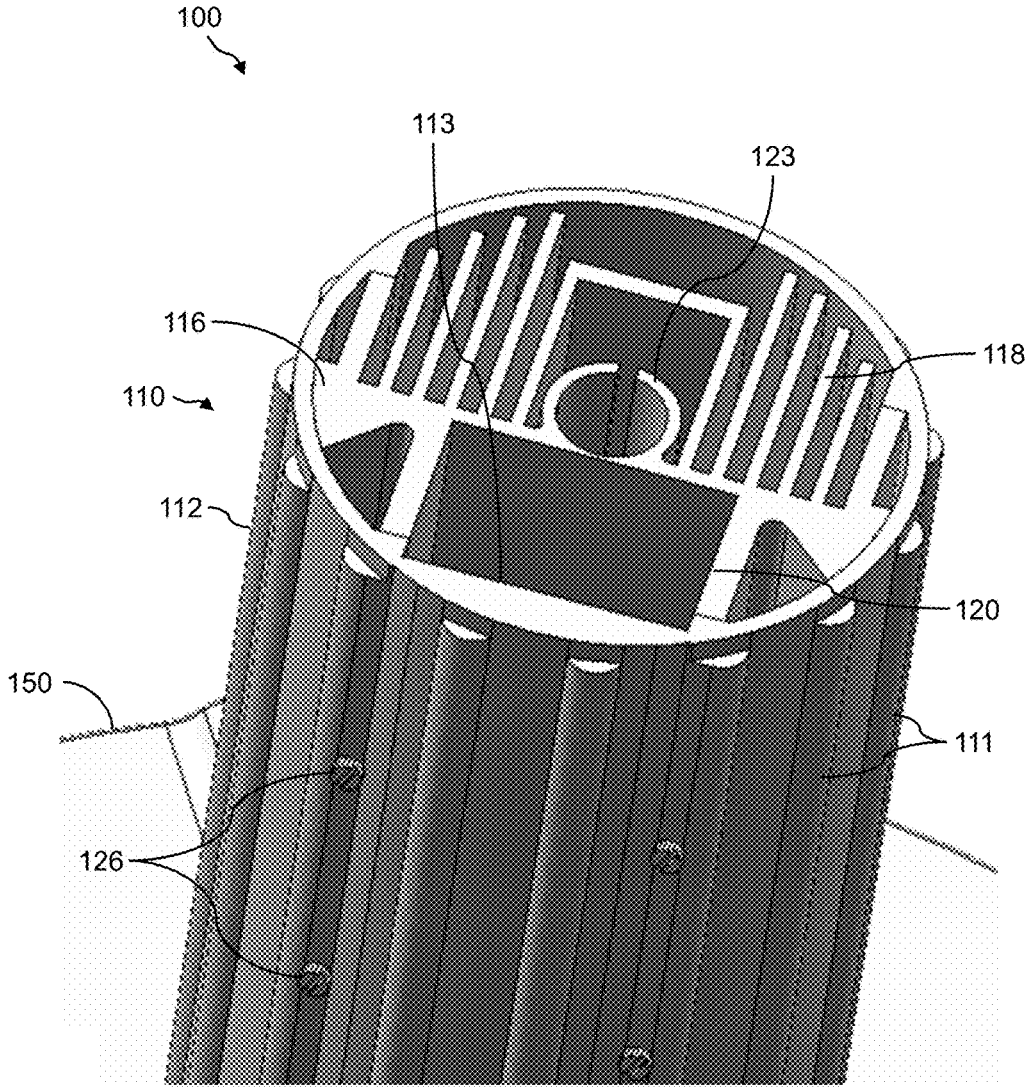
Figure 13:
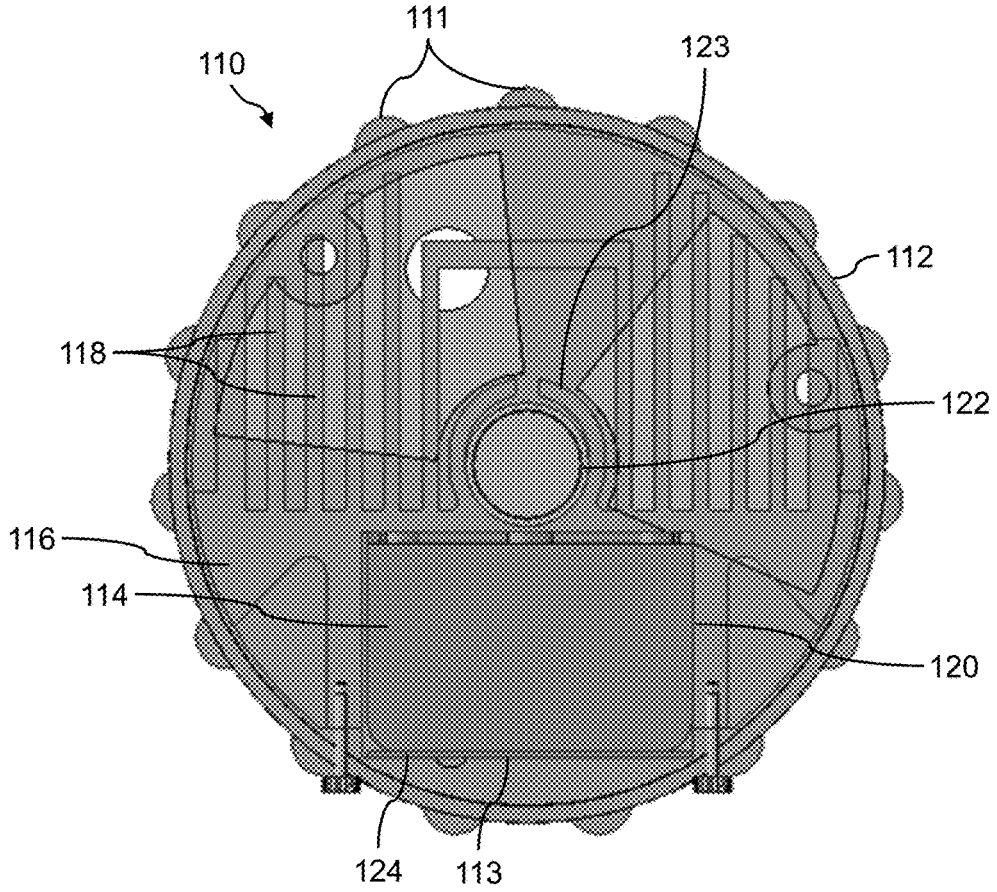
Figure 14:
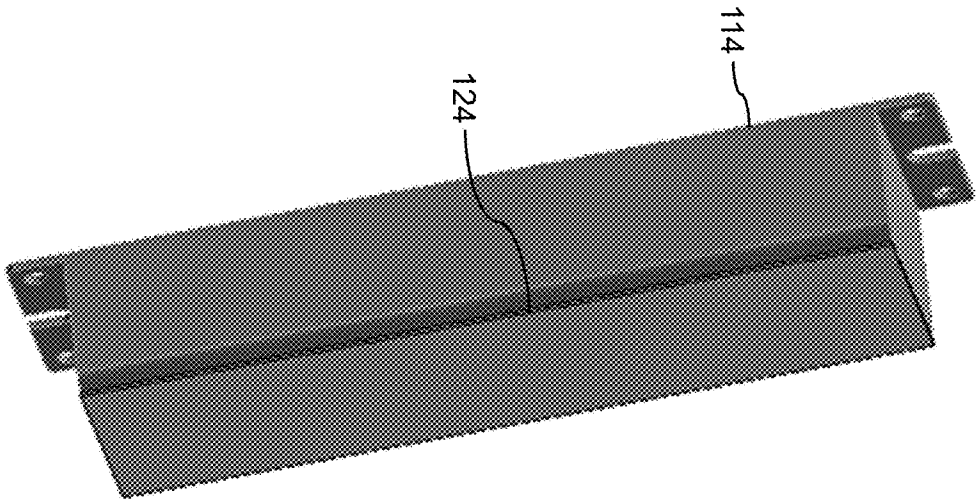
Figure 15:
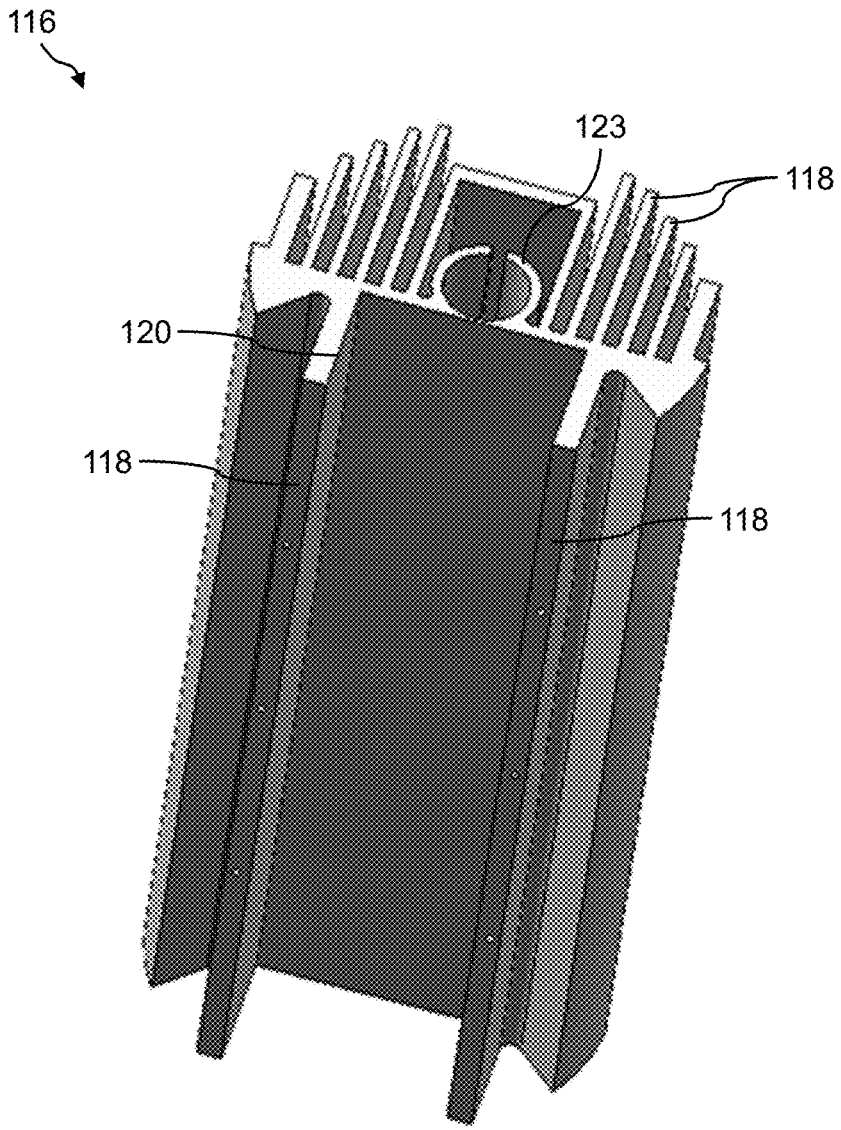
Figure 16:
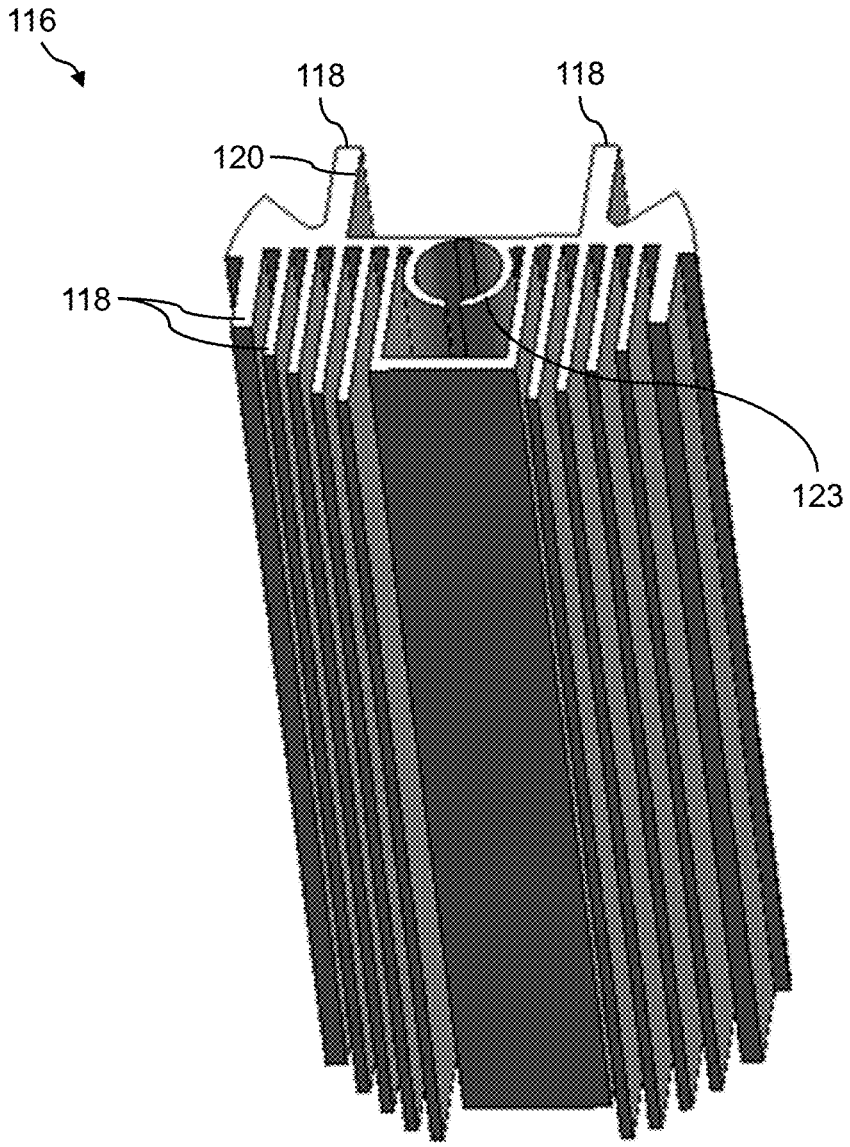
Figure 17A:
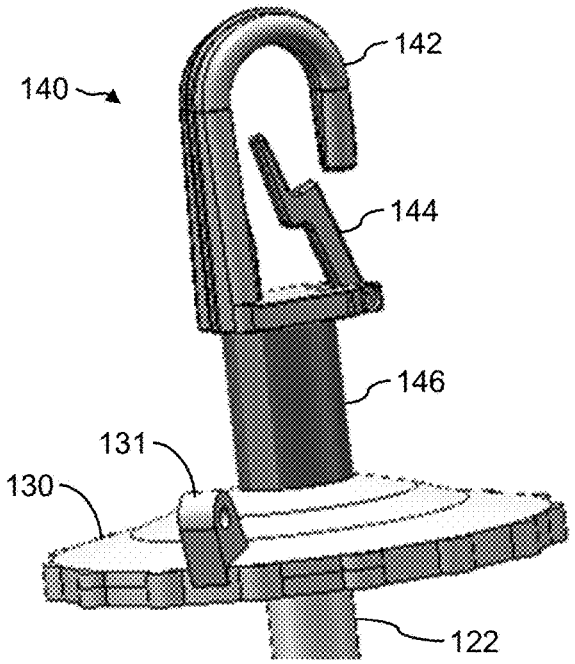
Figure 17B:
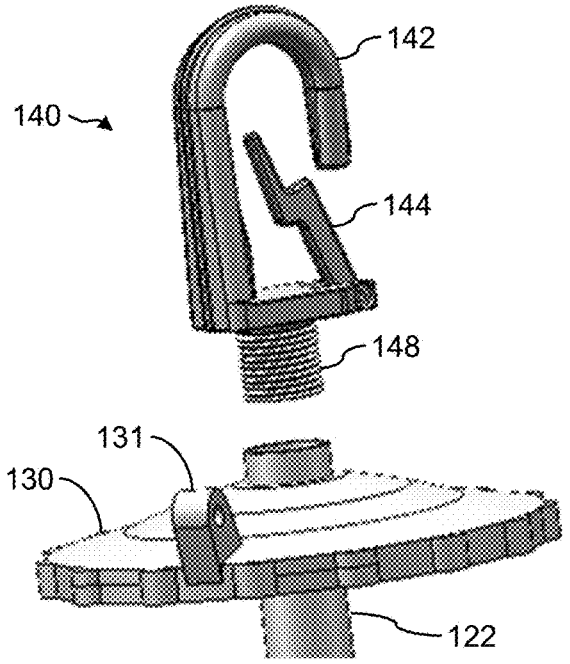
Figure 18:
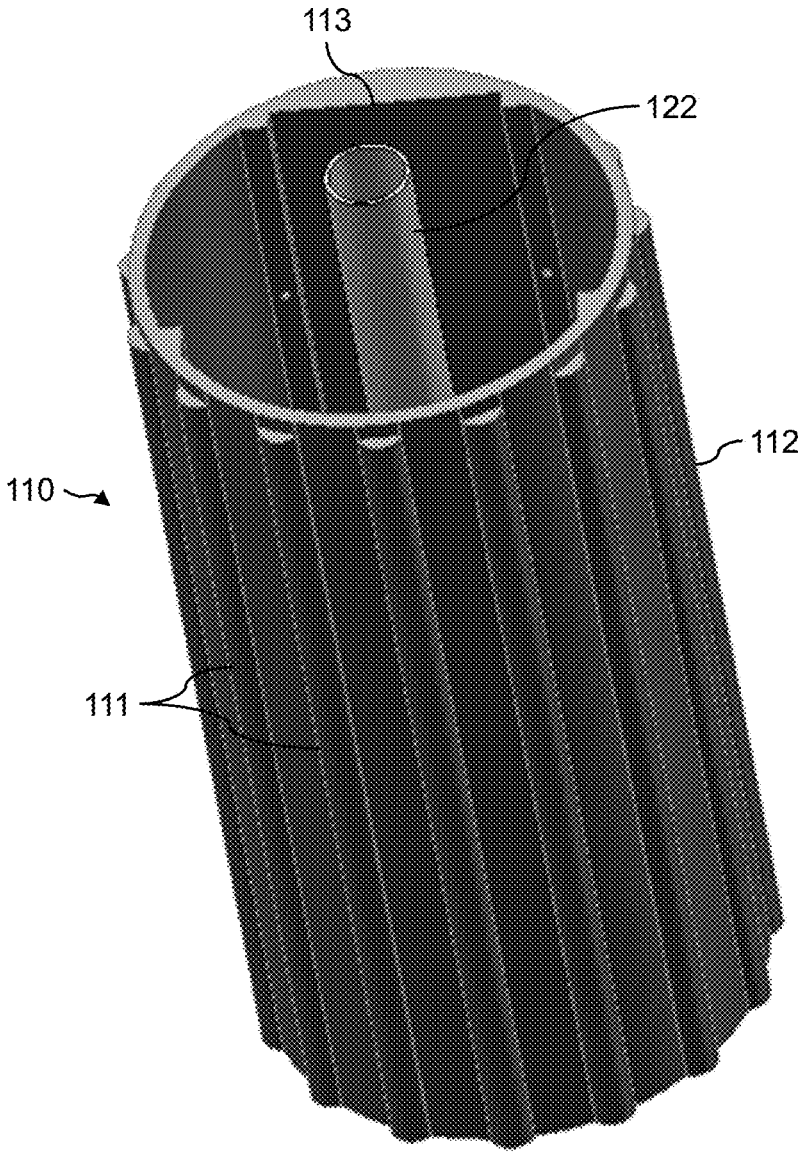
Figure 19:
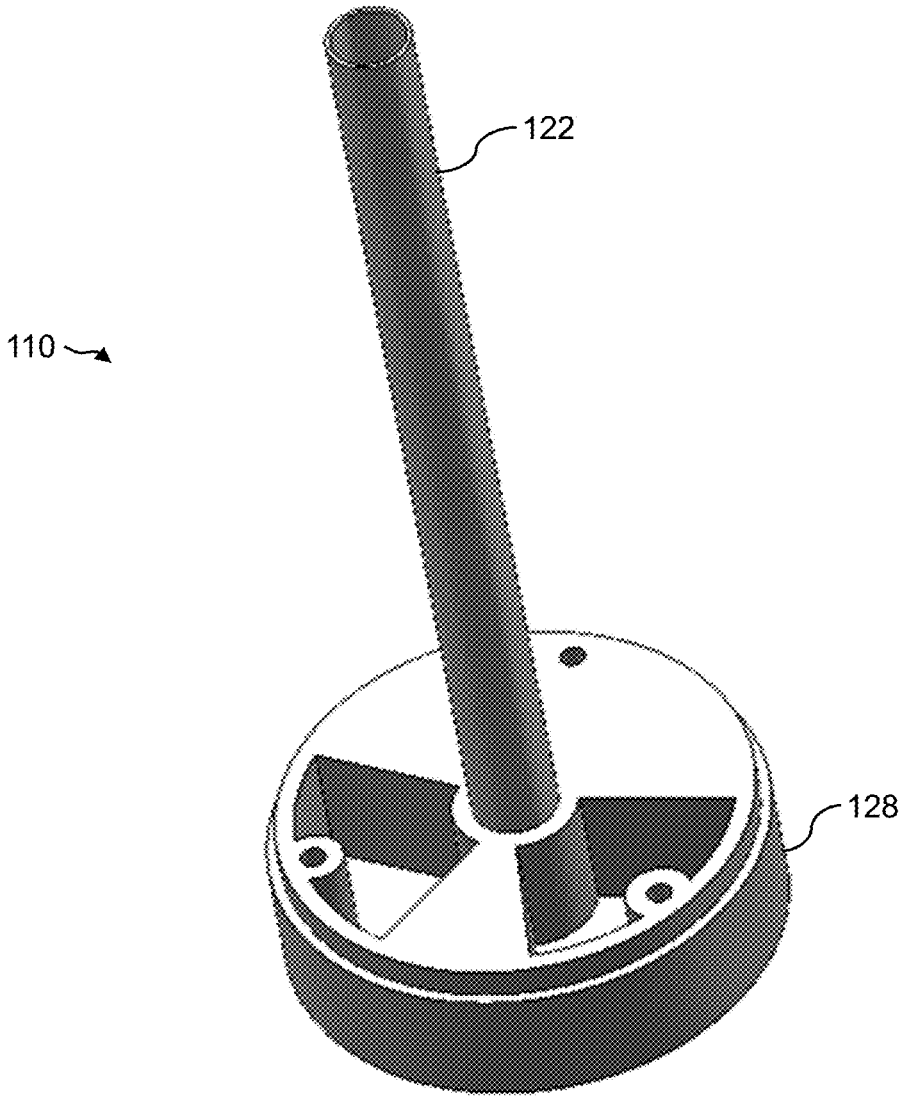
Figure 20:
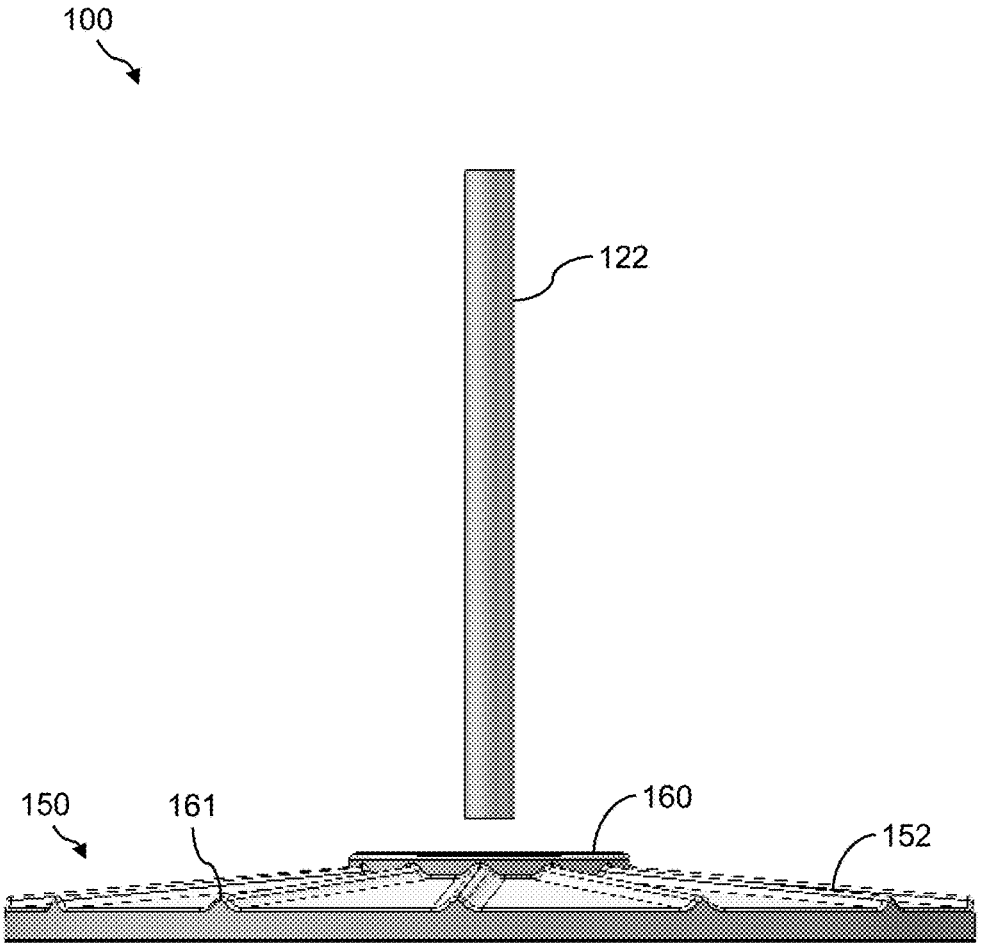
Figure 21:
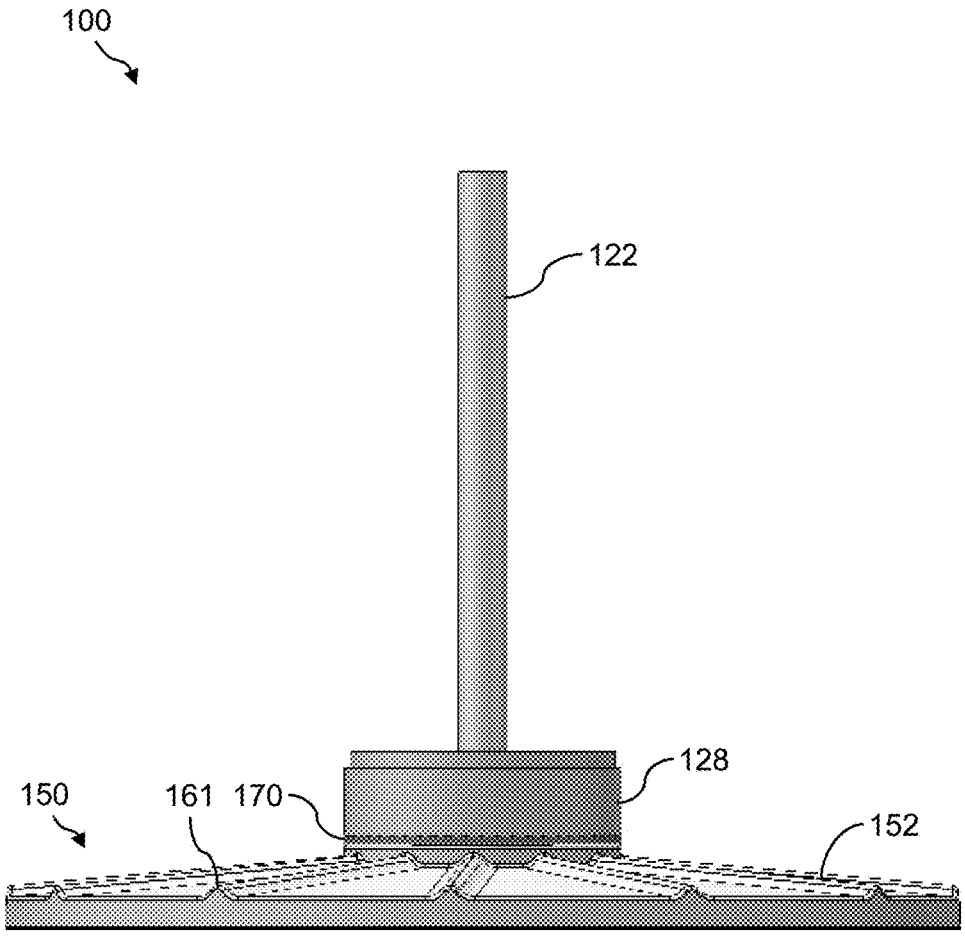
Figure 22:
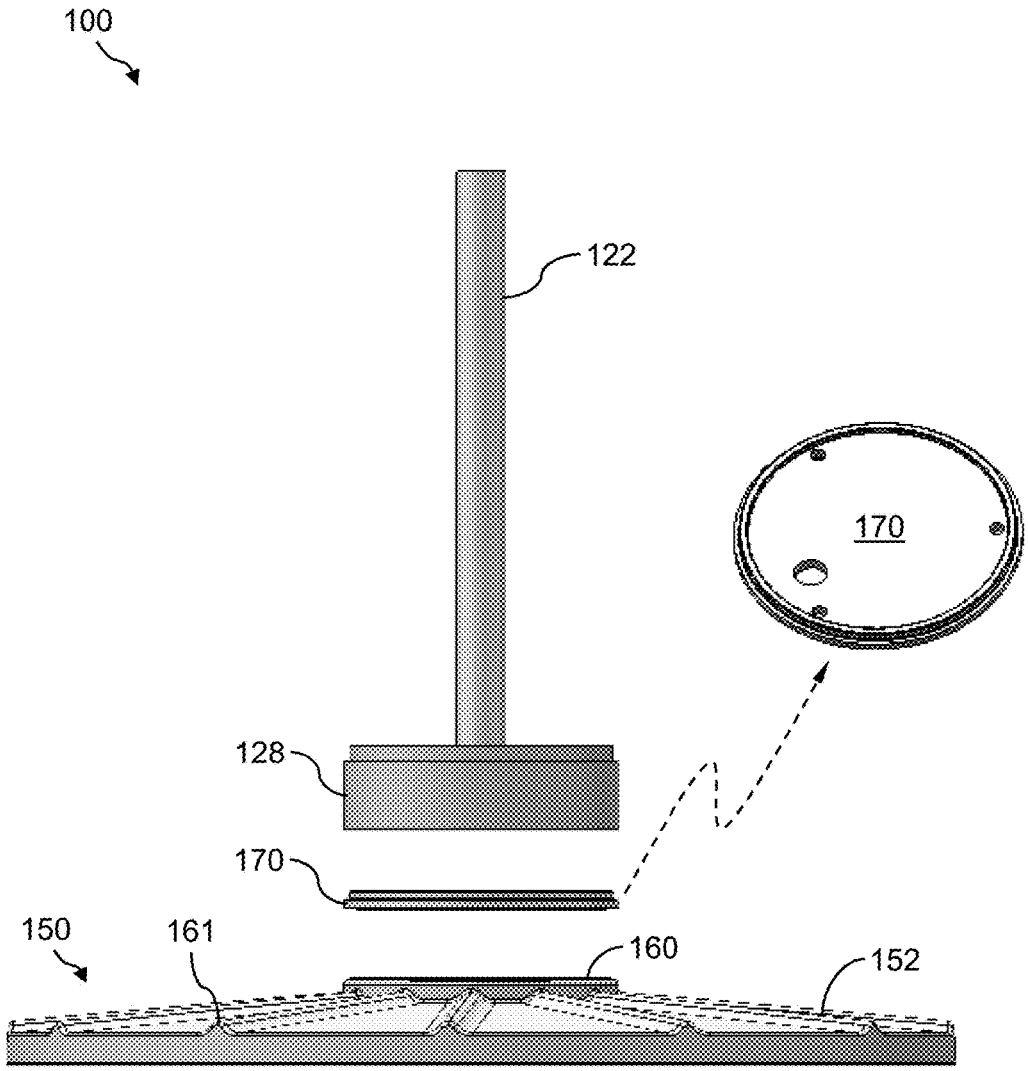
Figure 23:
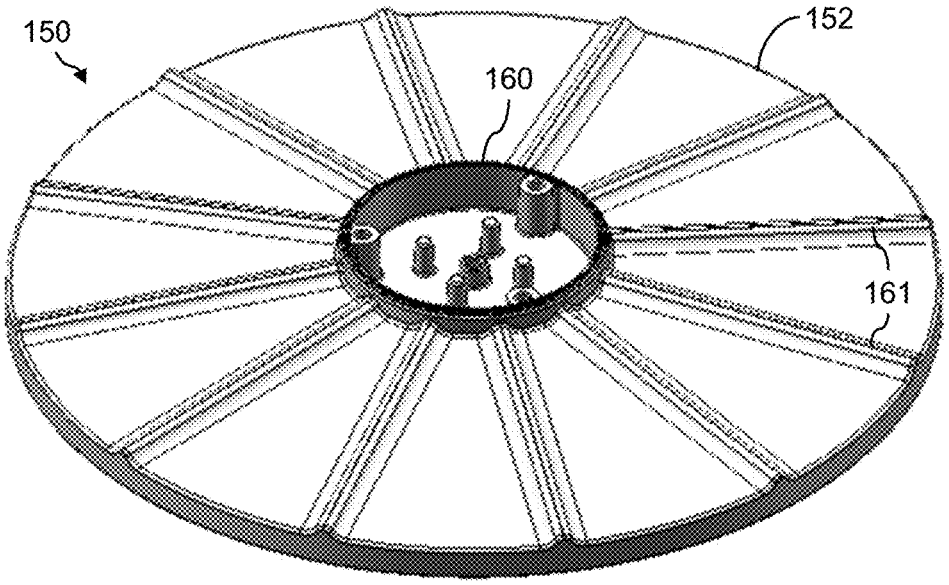
Figure 23:
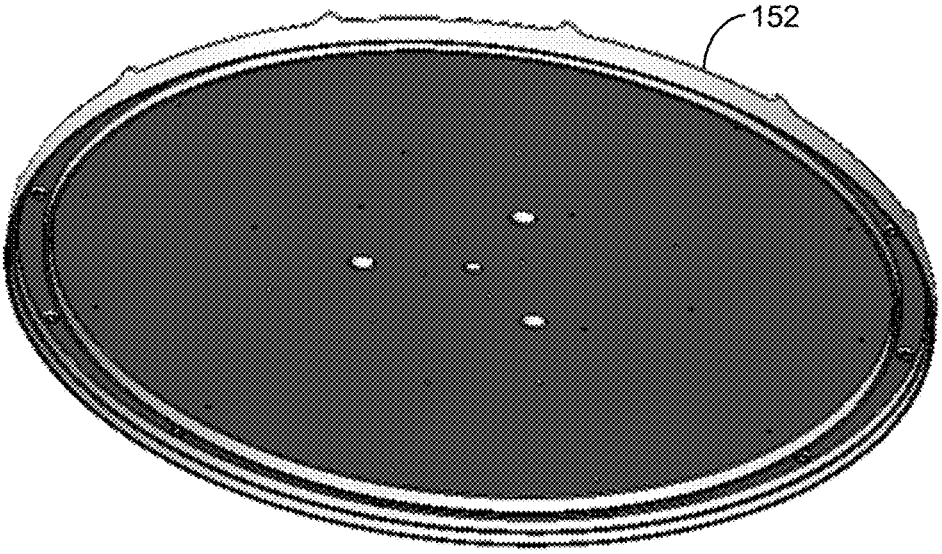
Figure 24:
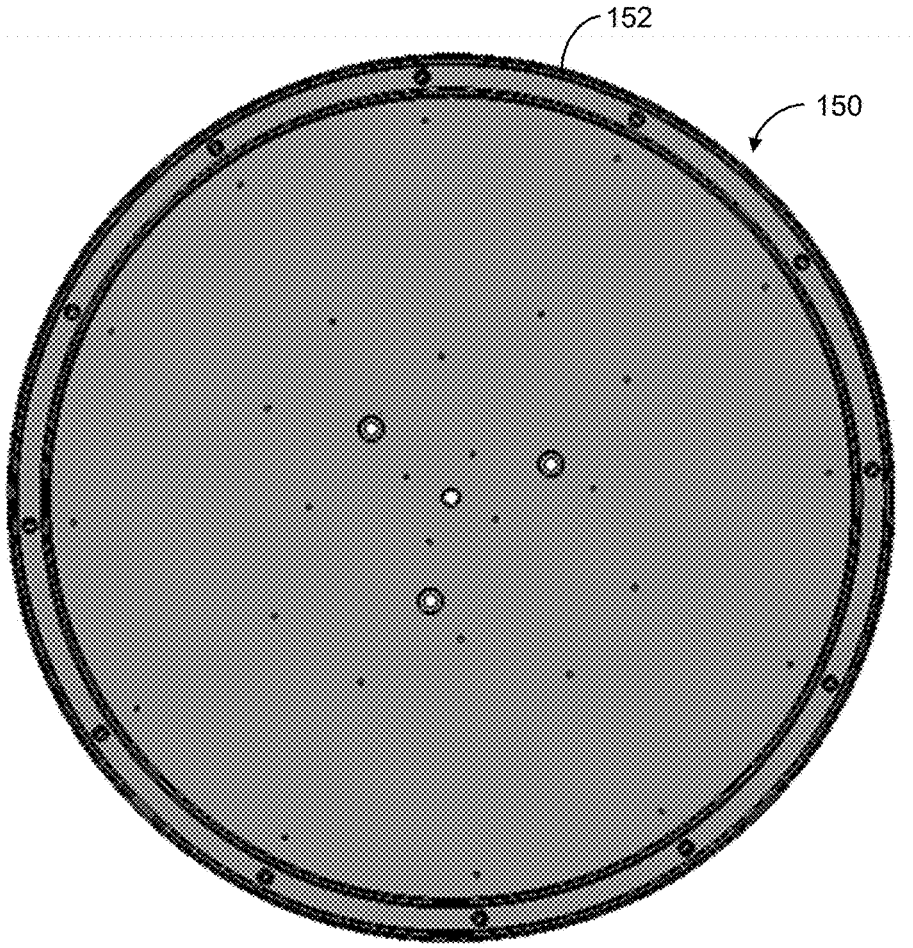
Figure 25:
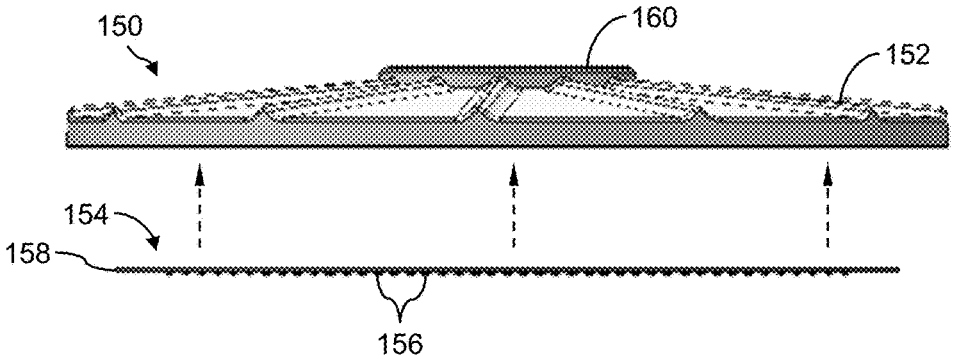
Figure 26:
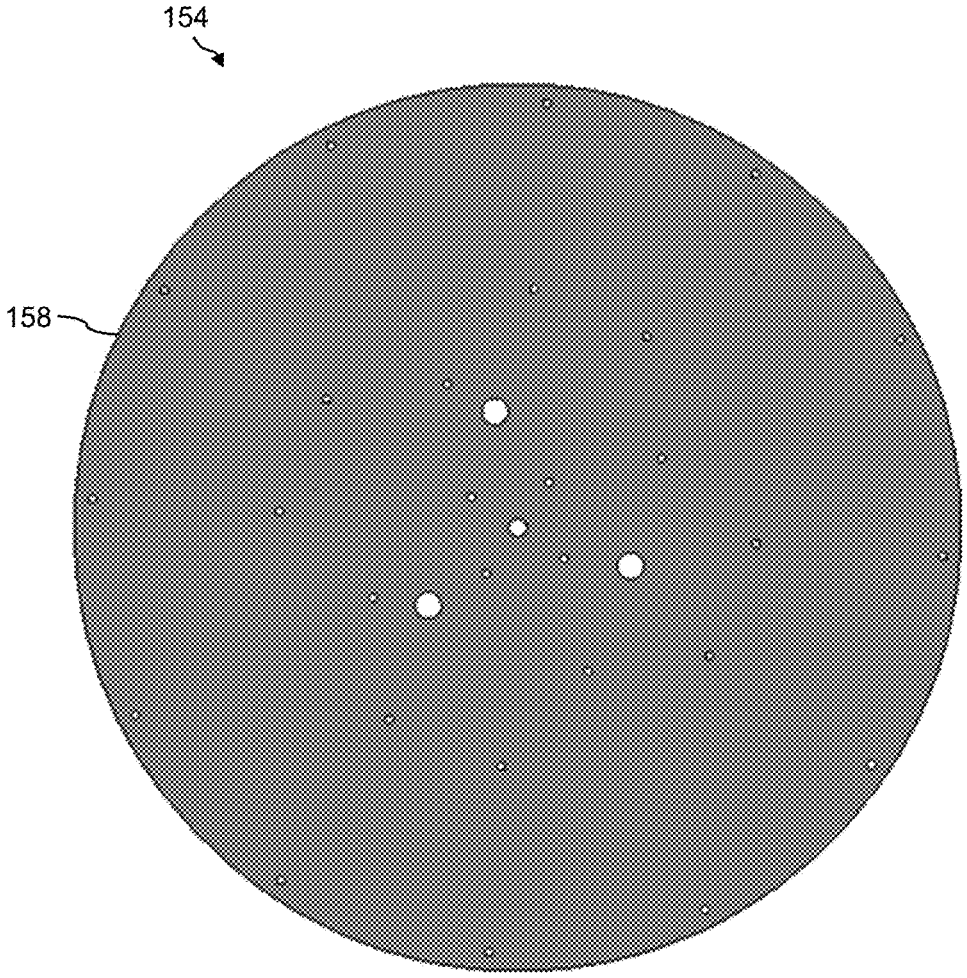
Figure 27:
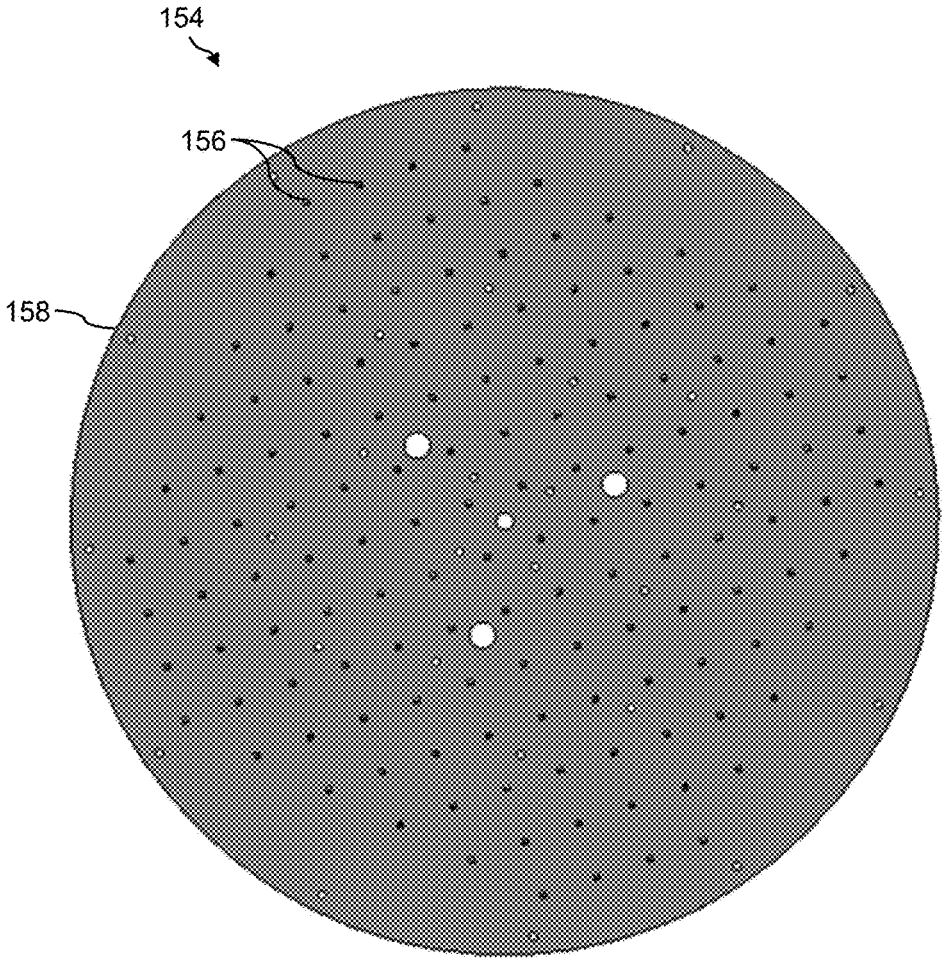
Figure 28:
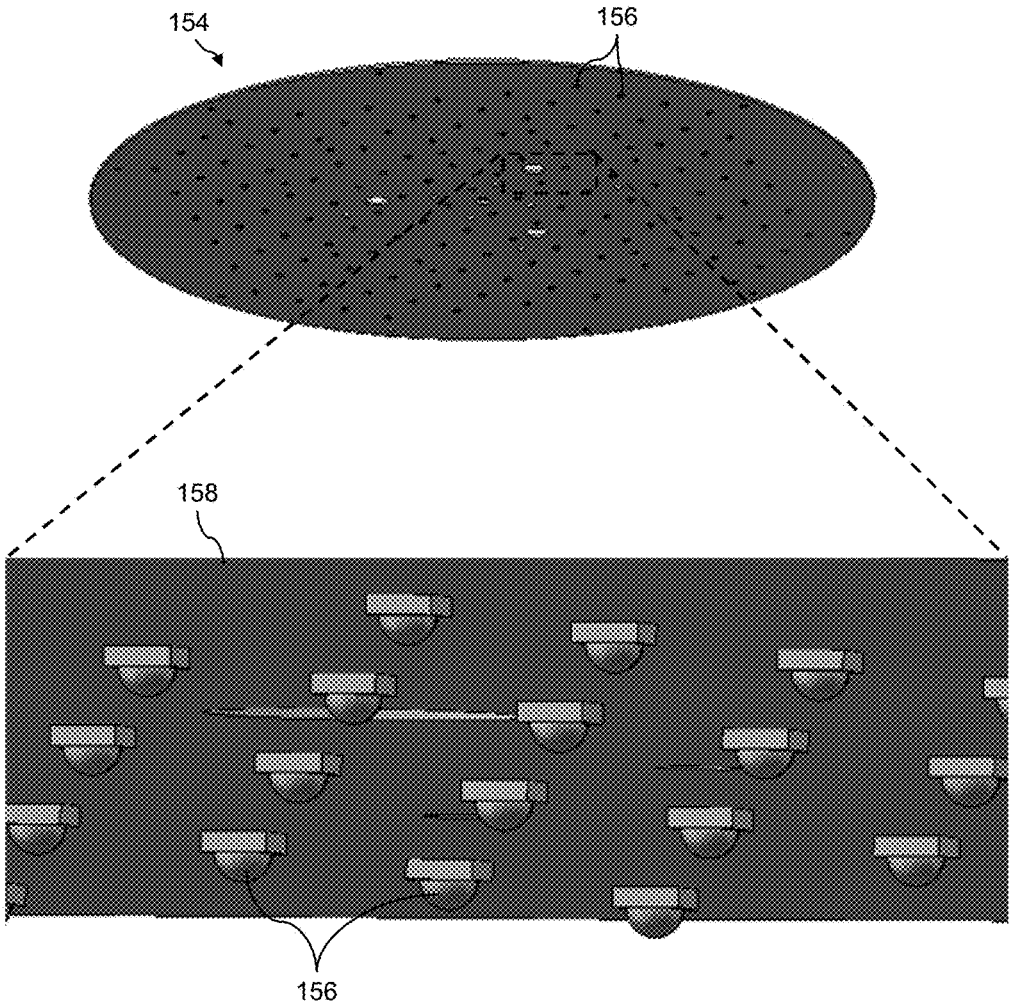
Figure 29:
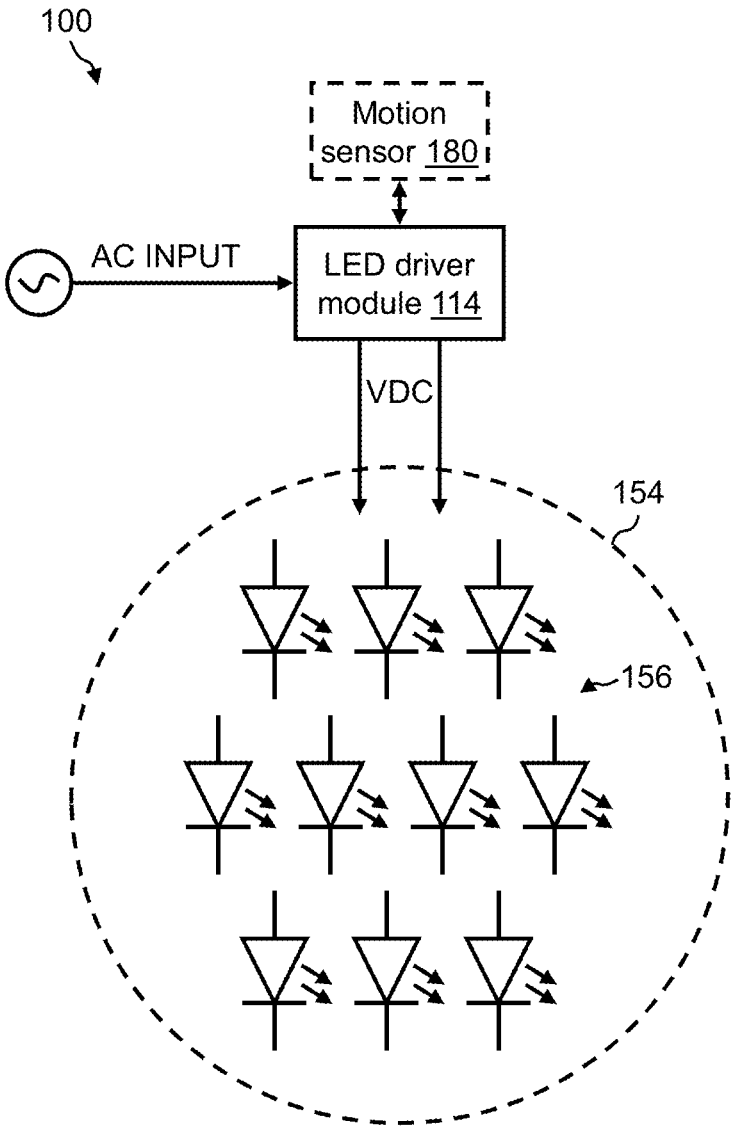
Figure 30:
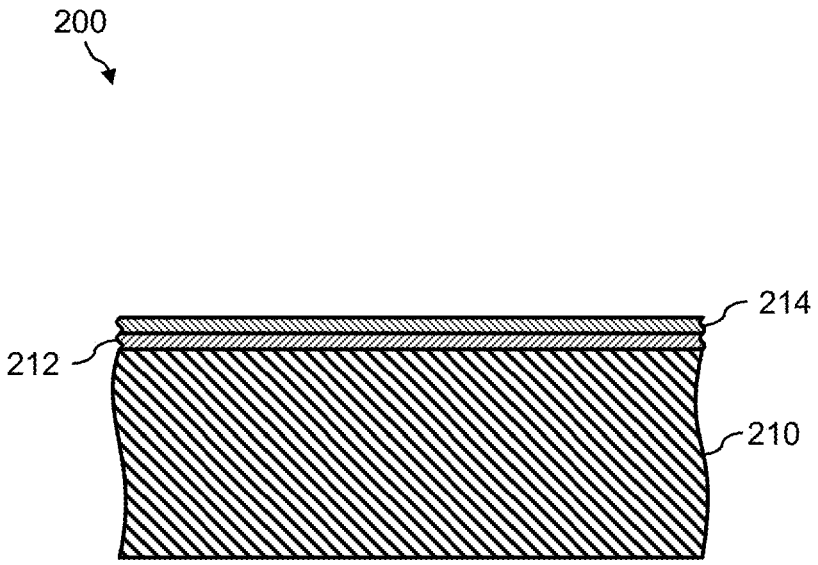
Figure 31:
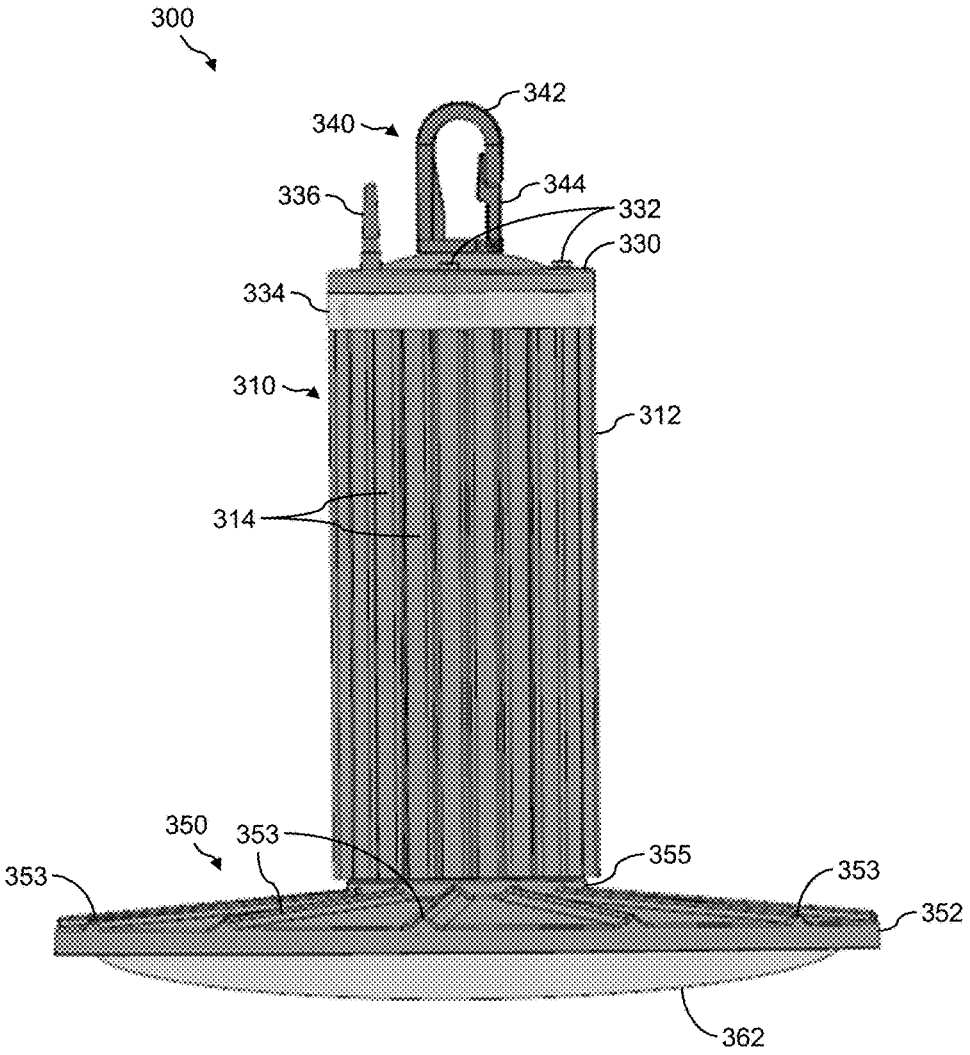
Figure 32:
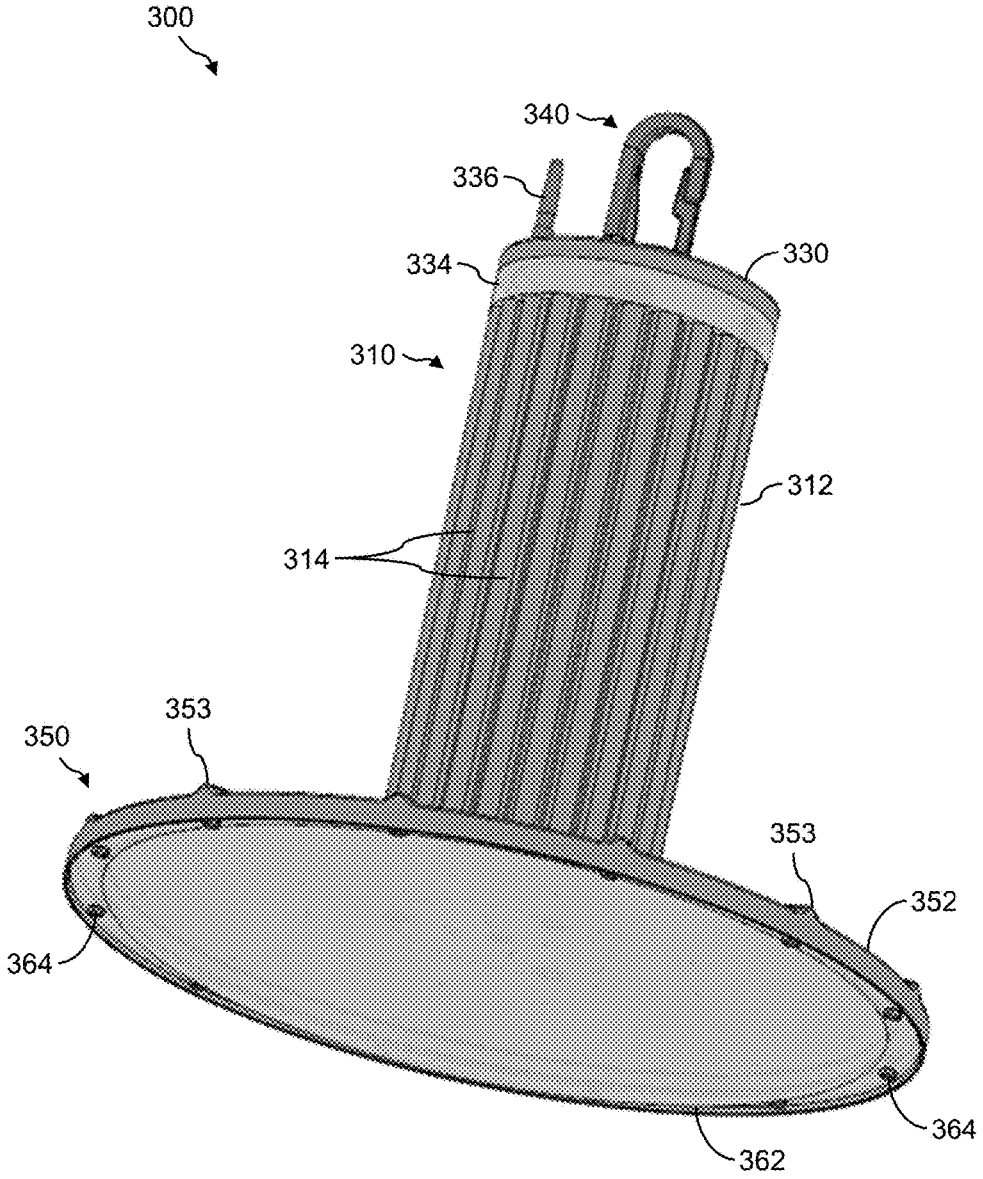
Figure 33:
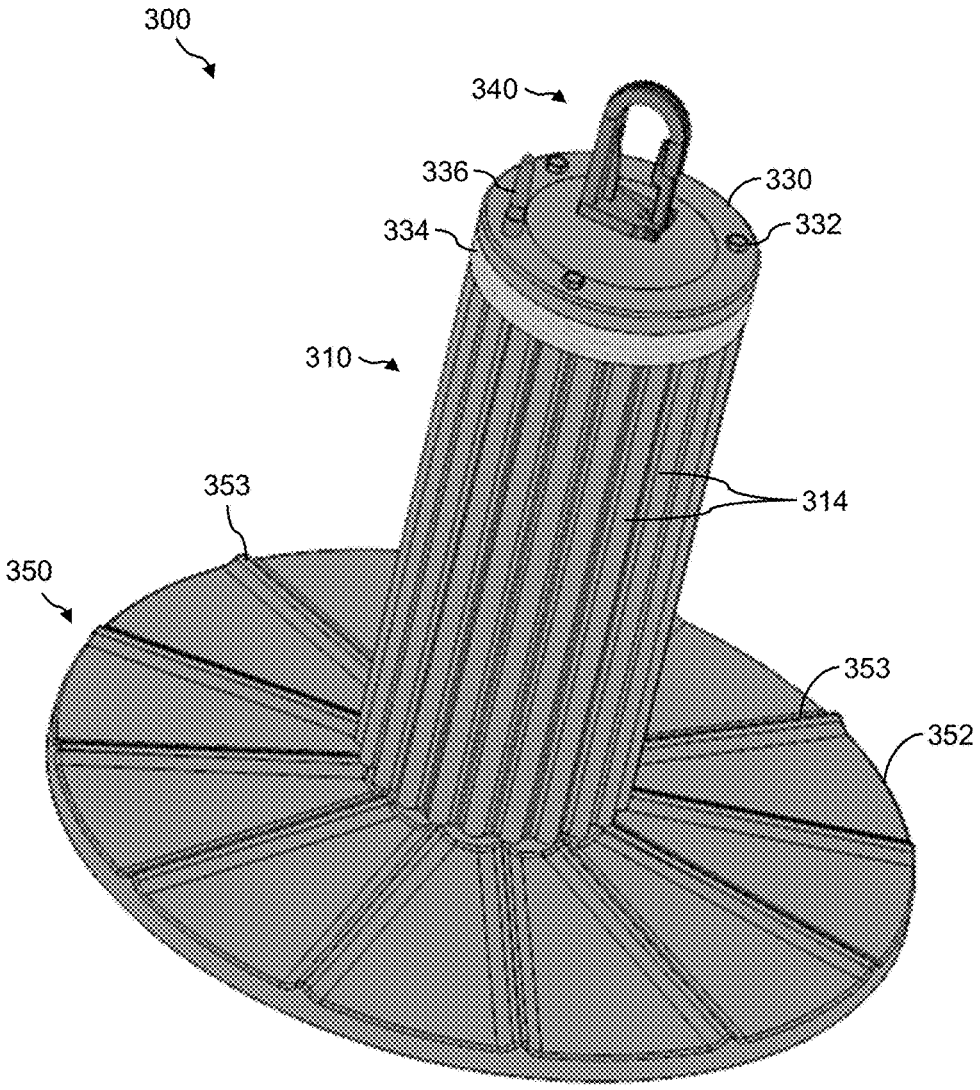
Figure 34:
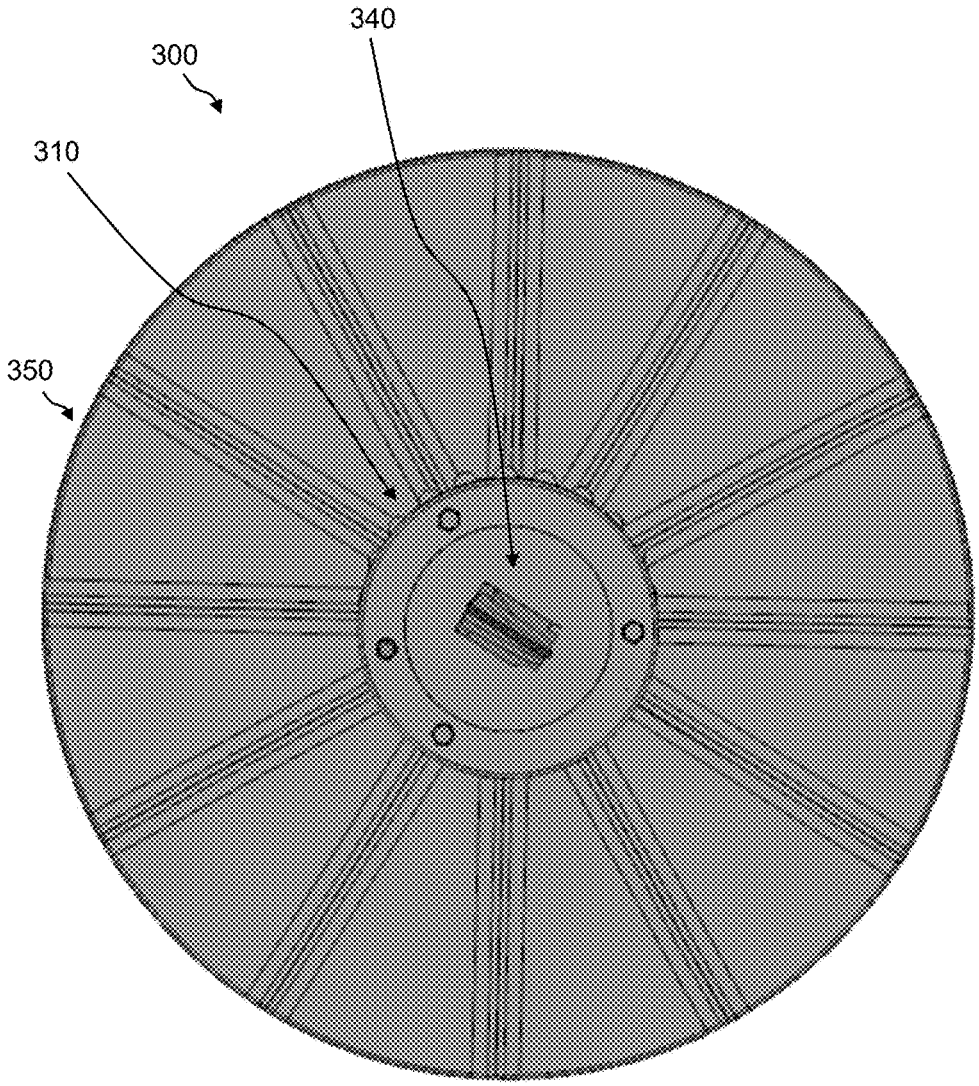
Figure 35:
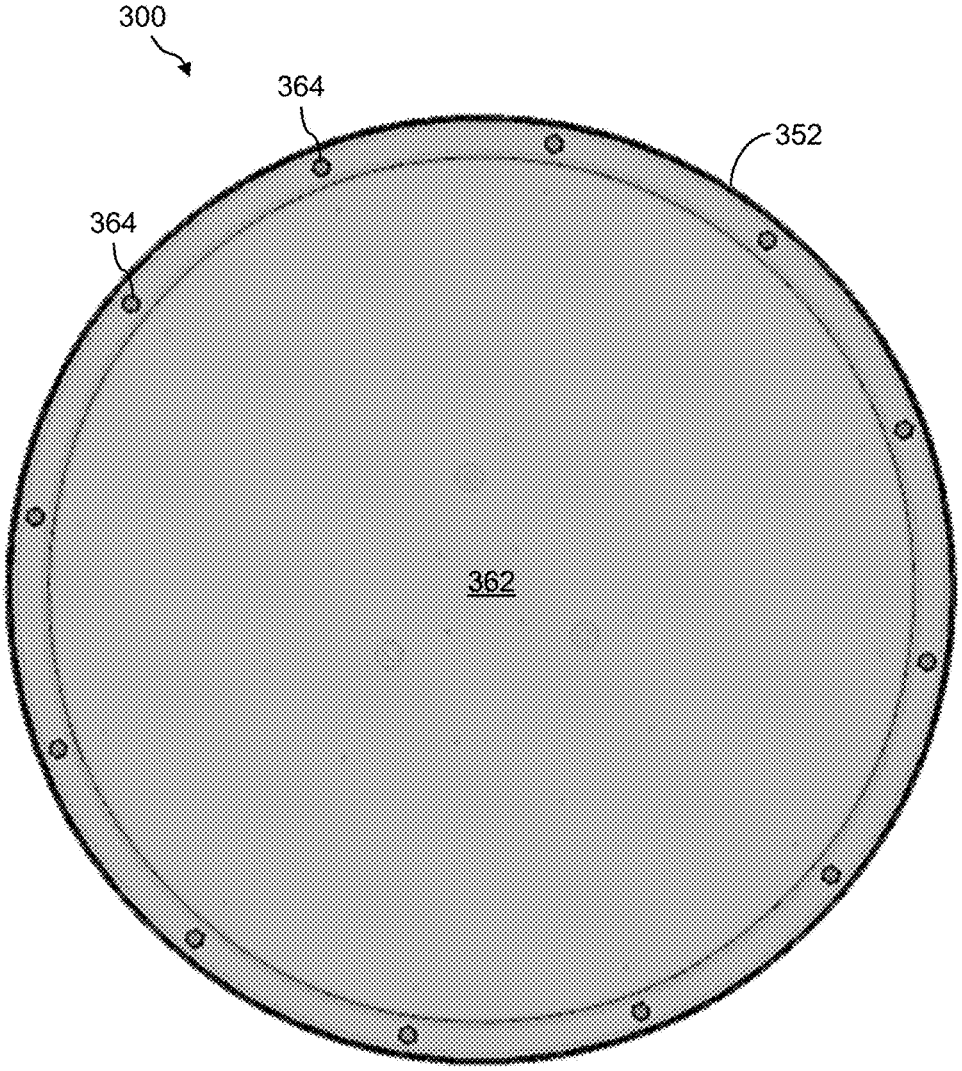
Figure 36:
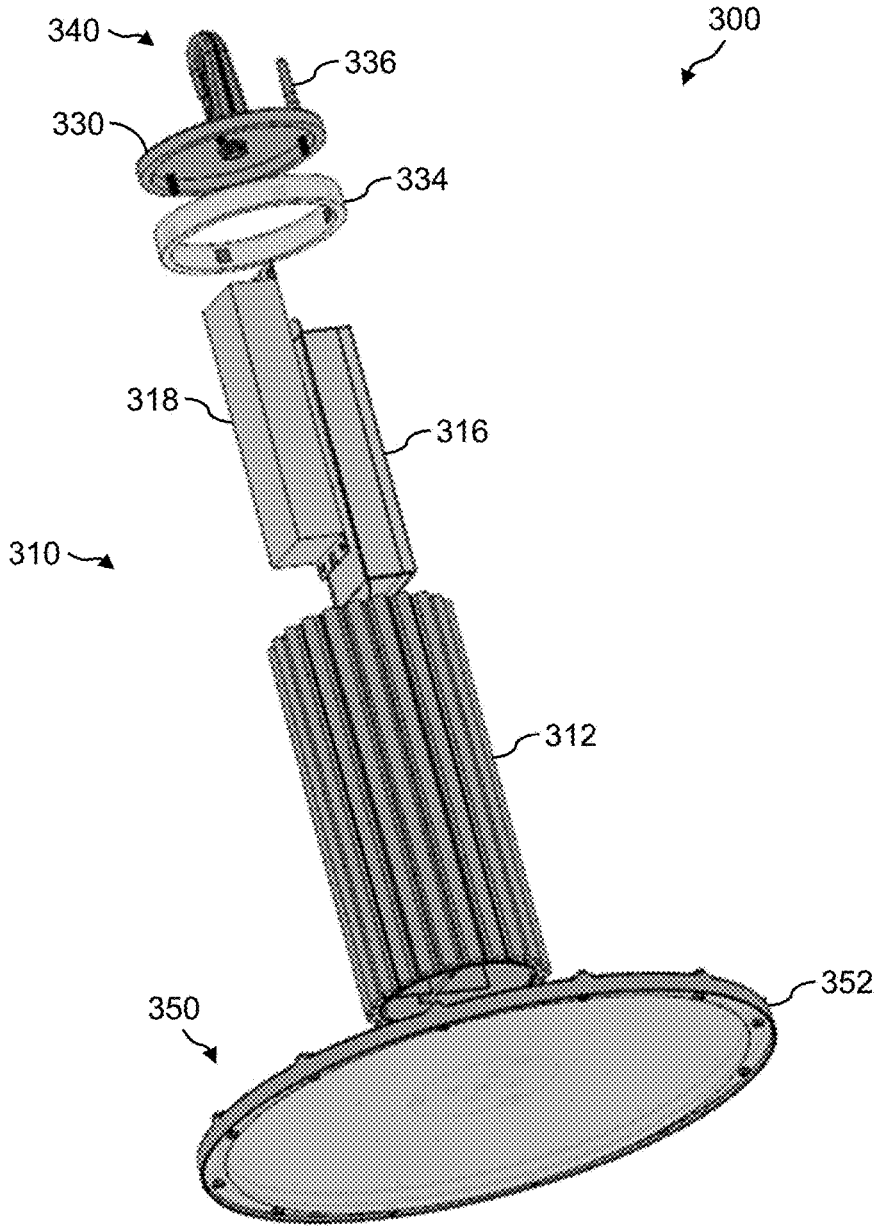
Figure 37:
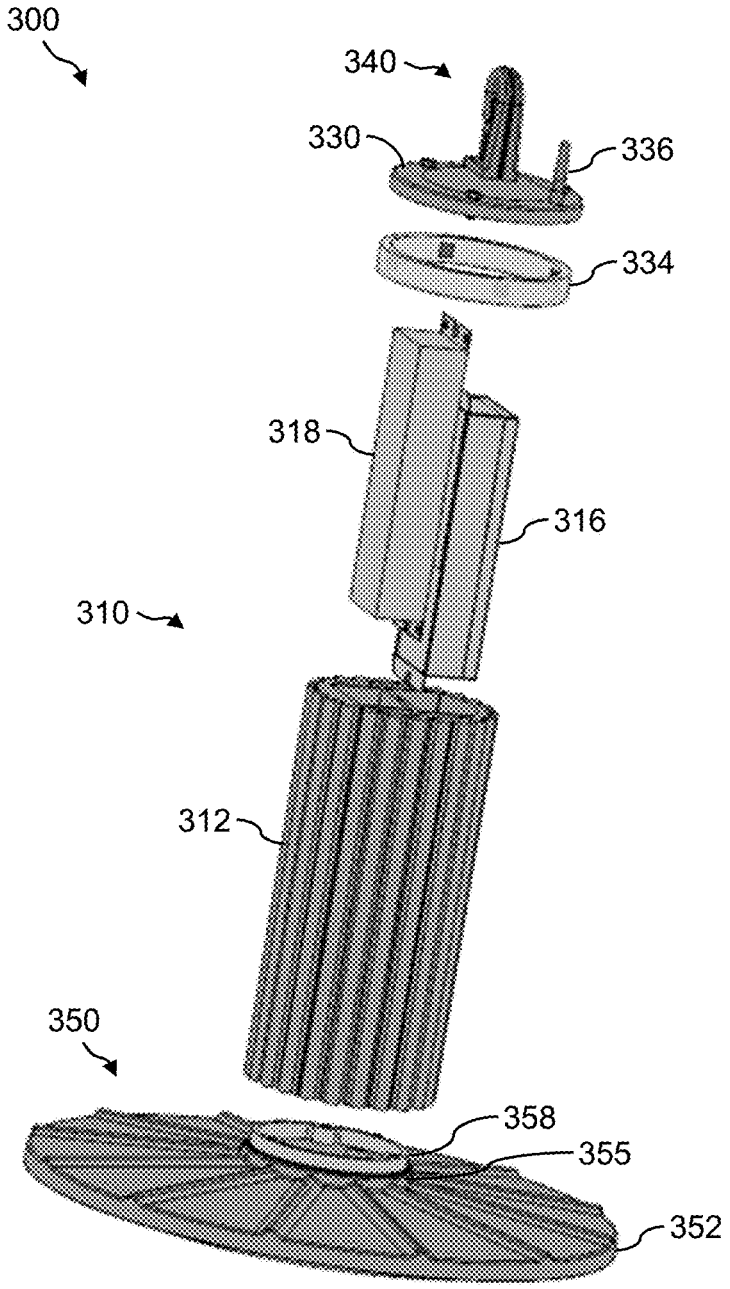
Figure 38:
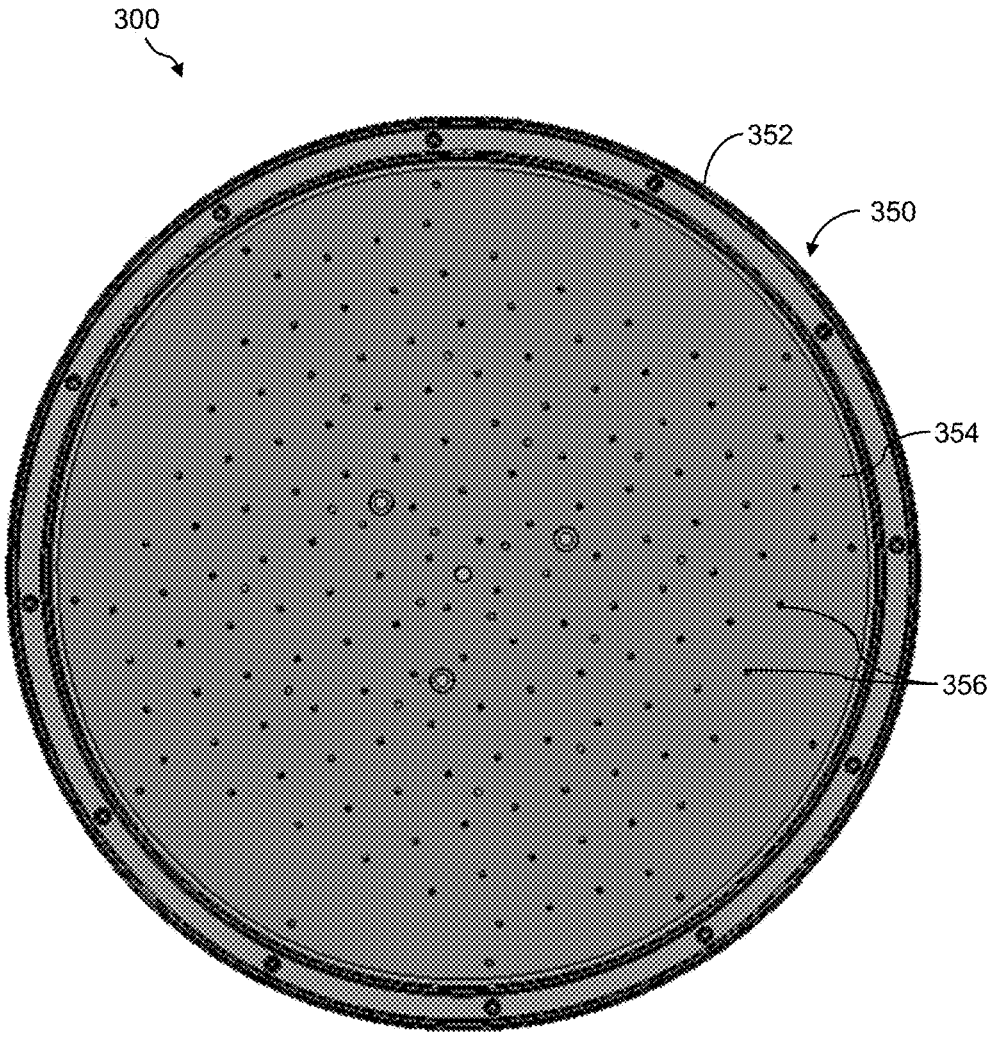
Figure 39:
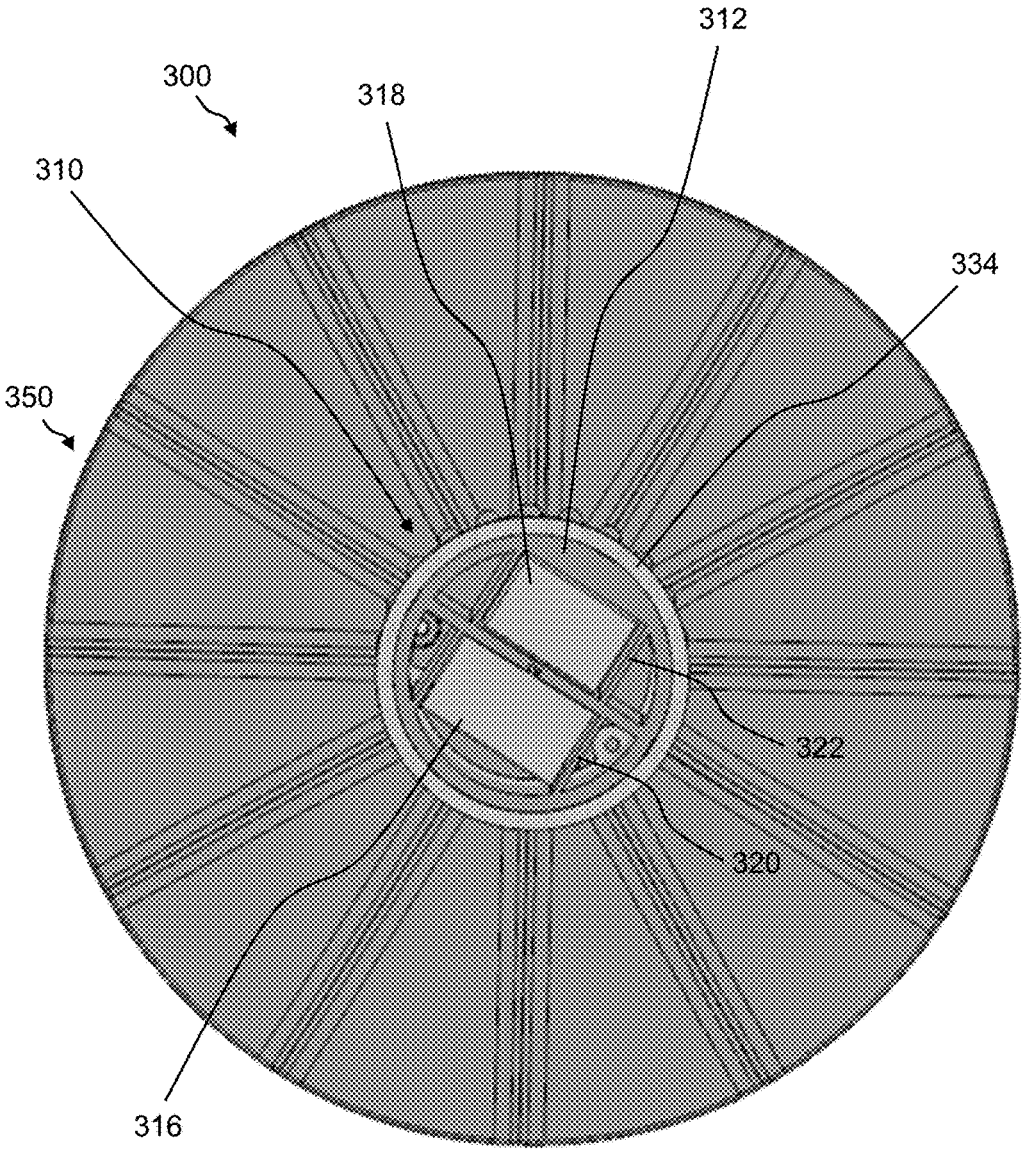
Figure 40A:
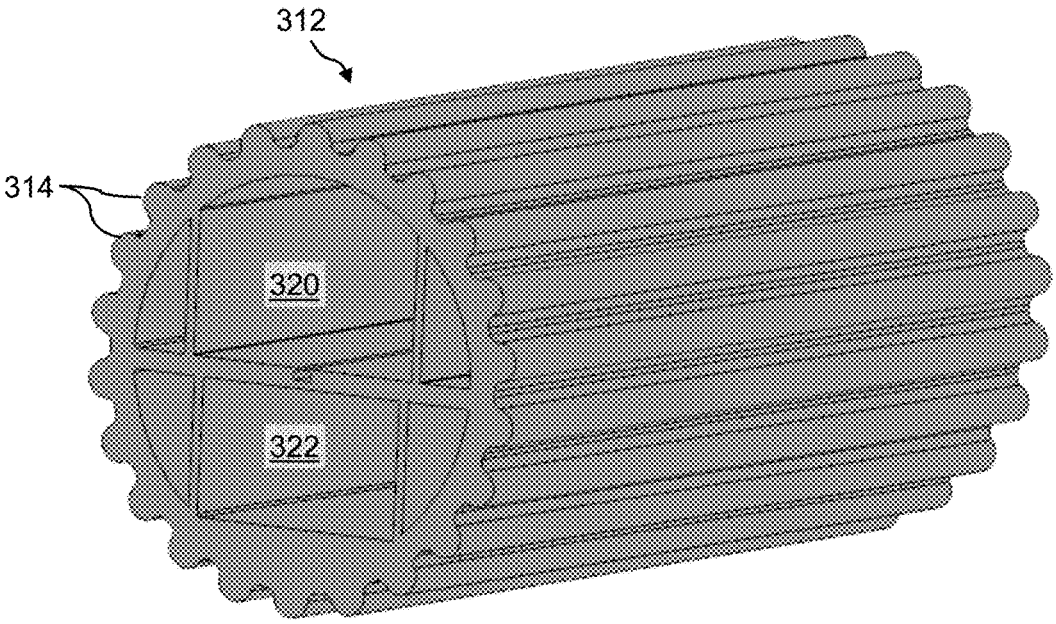
Figure 40B:
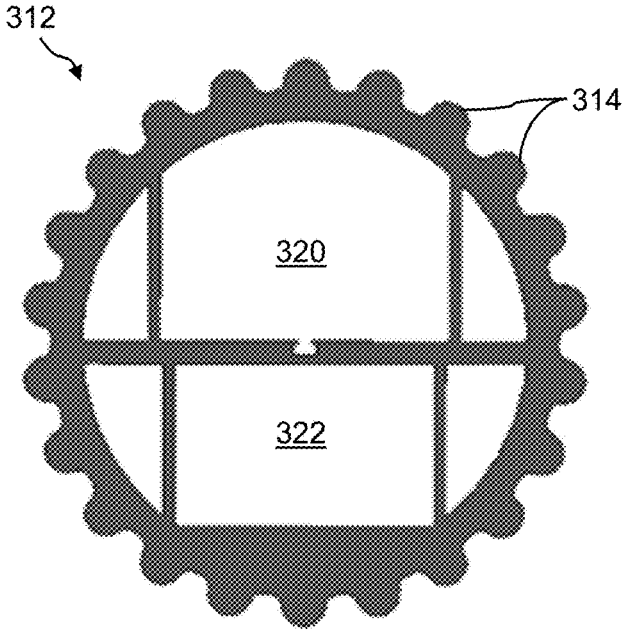
Figure 41A:
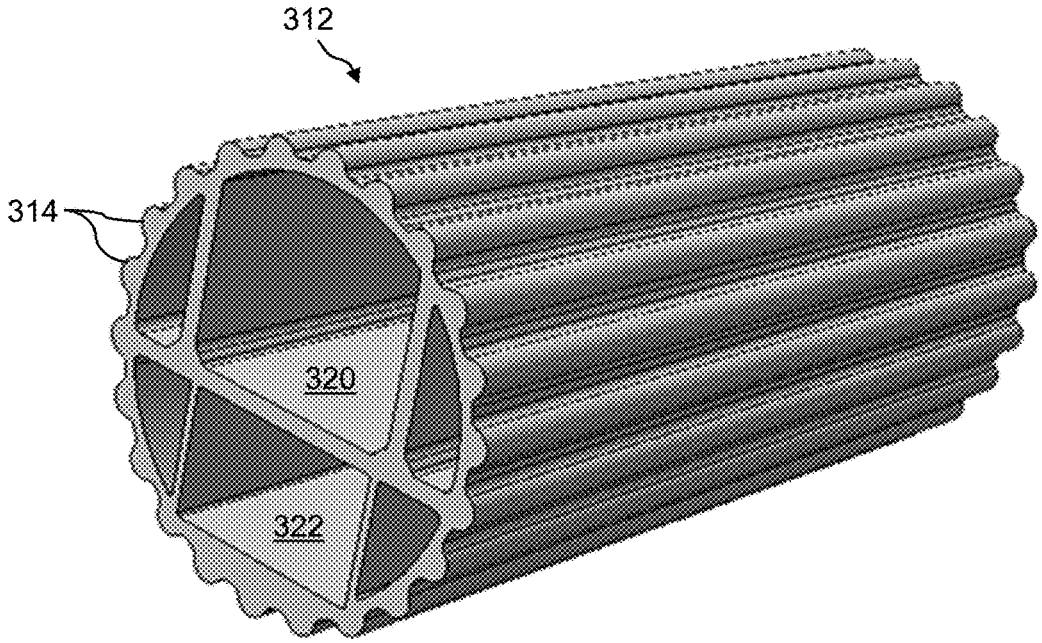
Figure 41B:
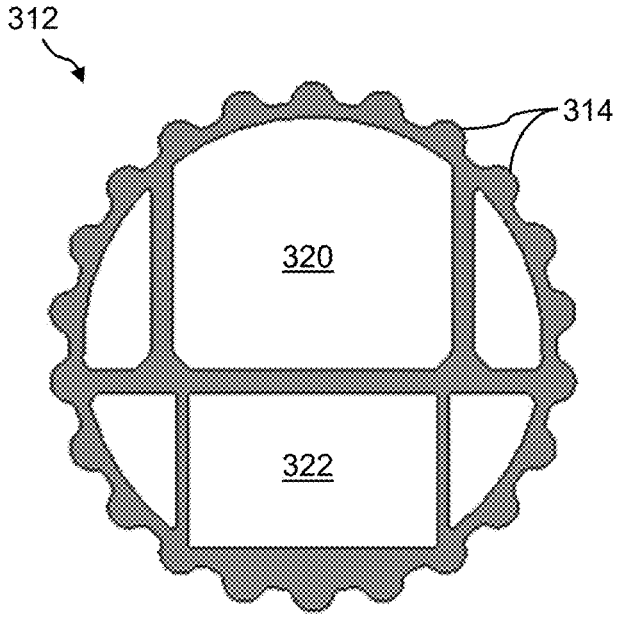
Figure 42A:
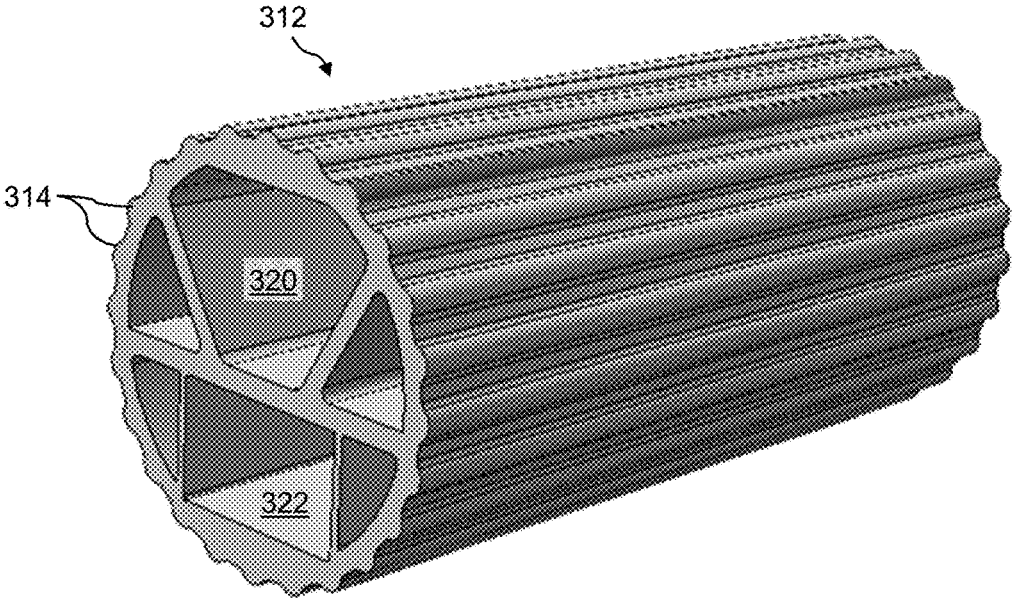
Figure 42B:
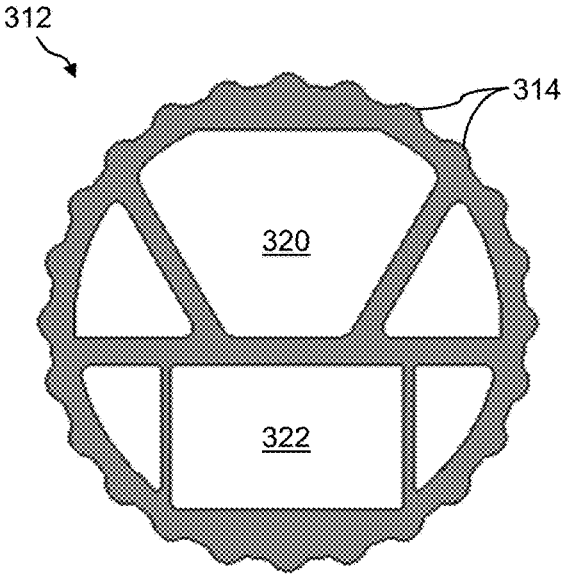
Figure 43:
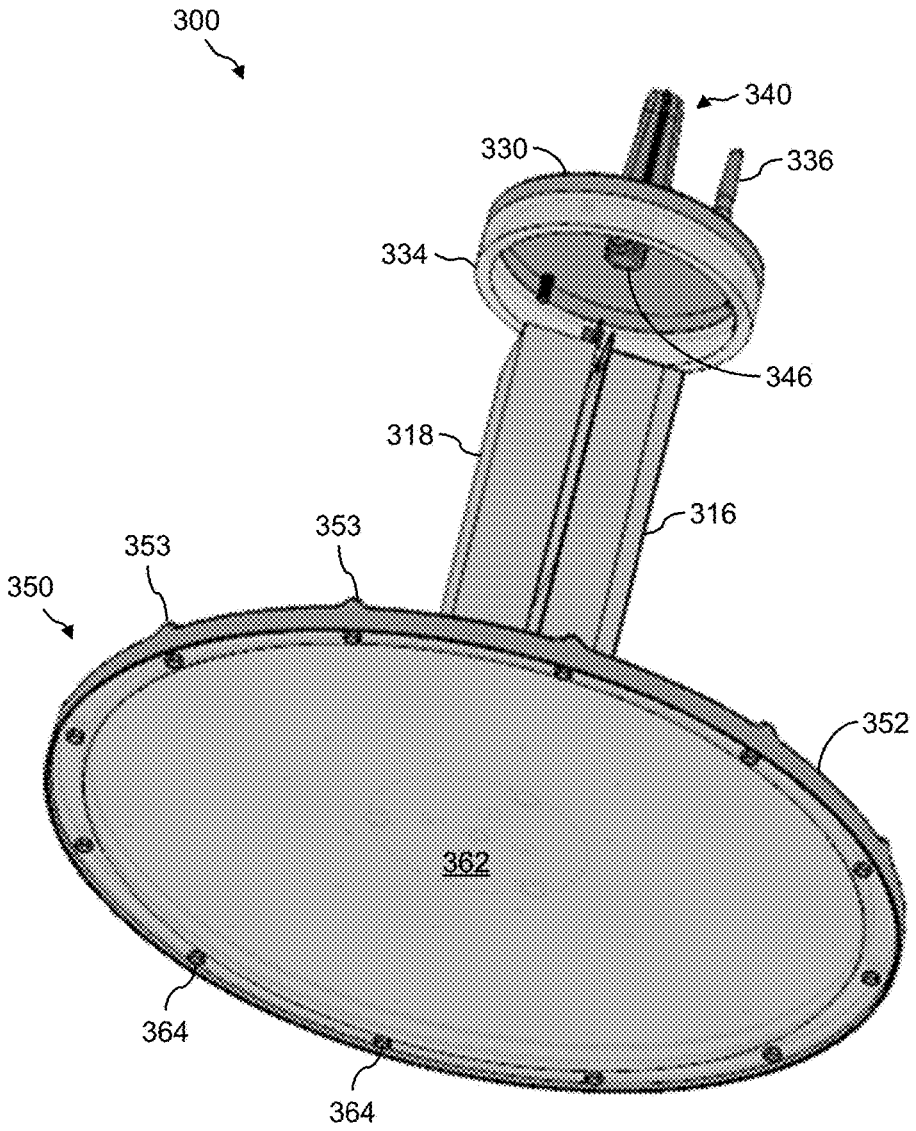
Figure 44:
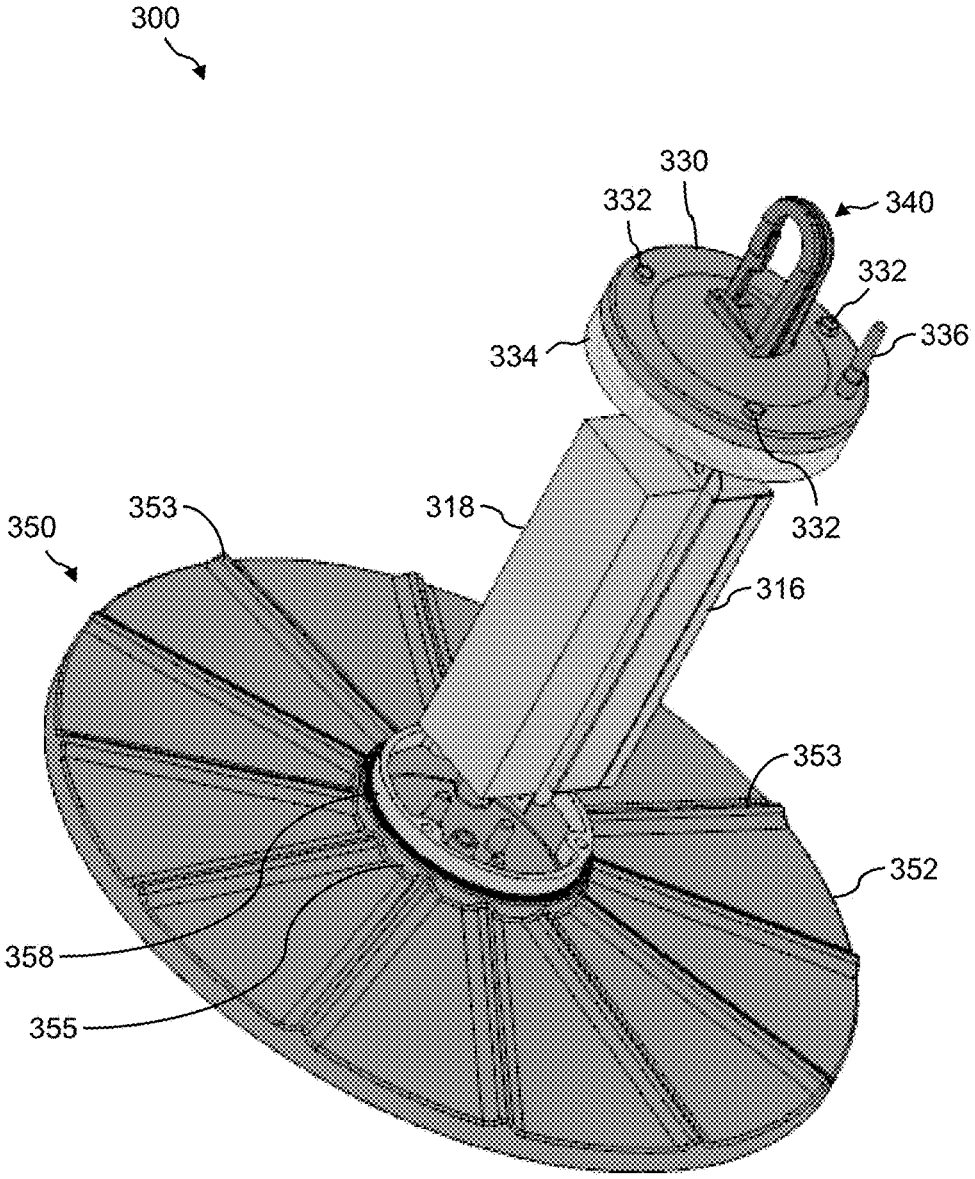
Figure 45:
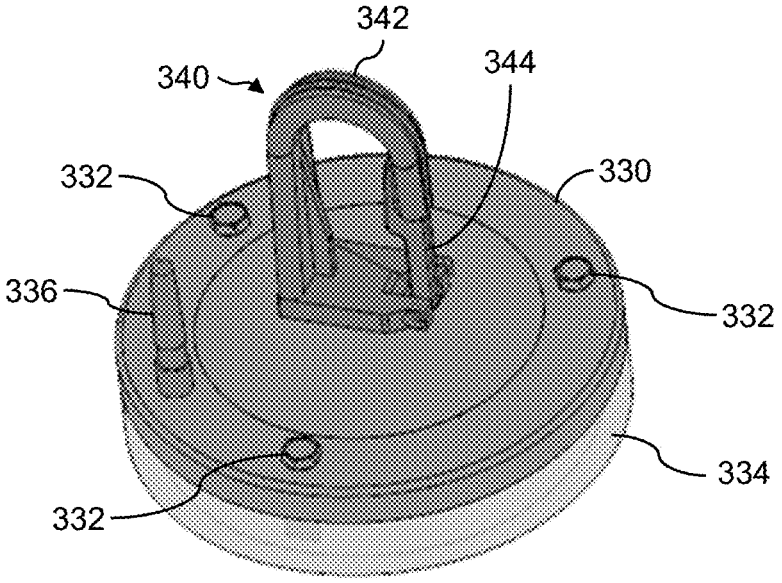
Figure 45:
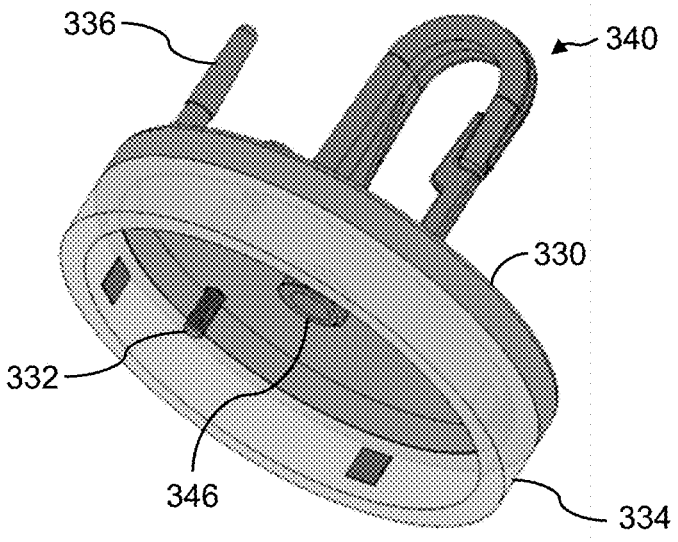
Figure 46:
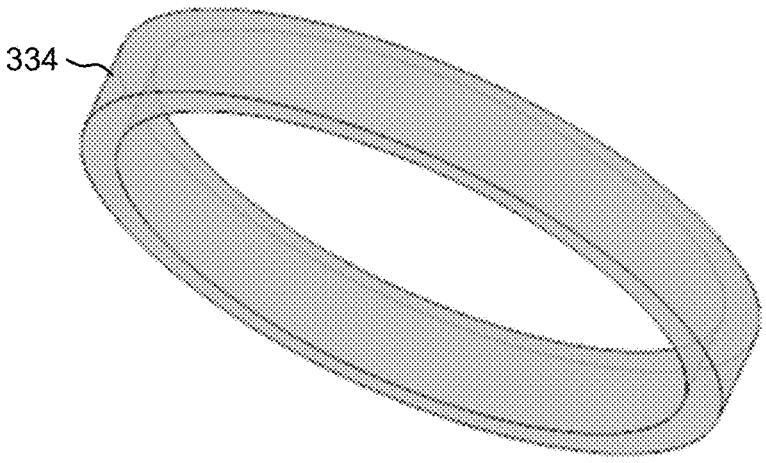
Figure 47:
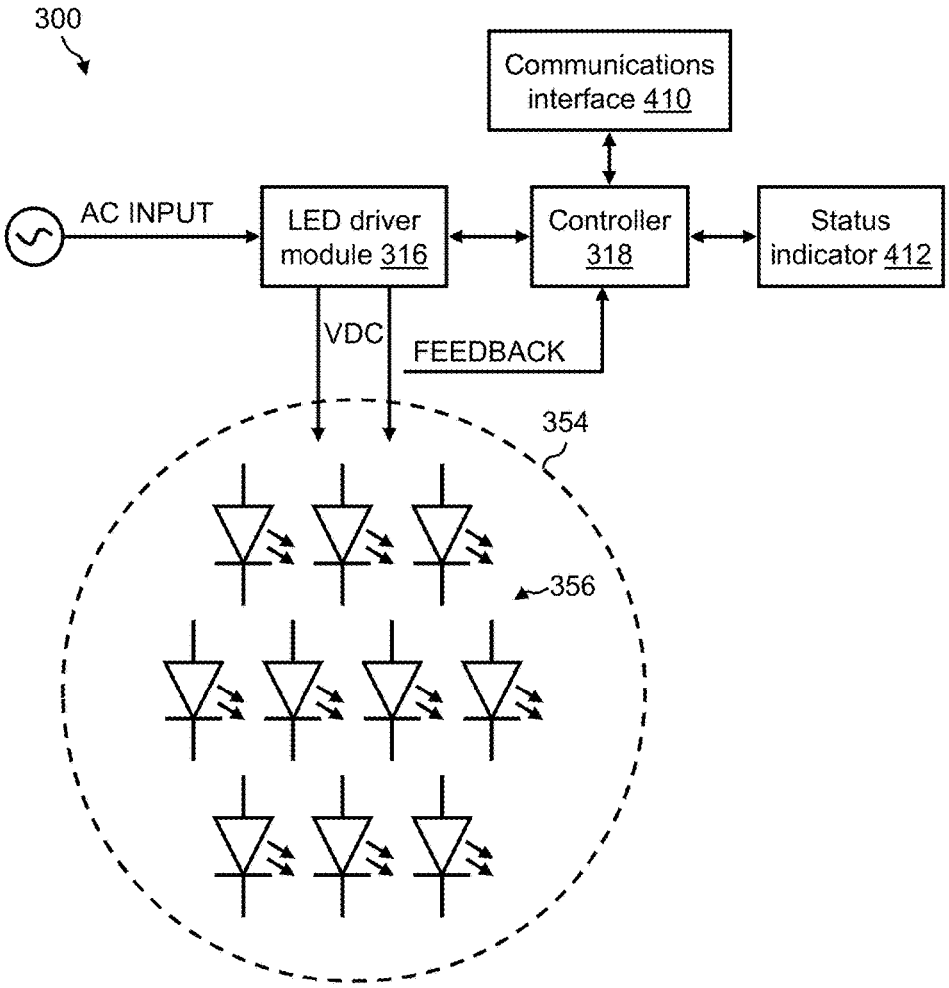
Figure 48:
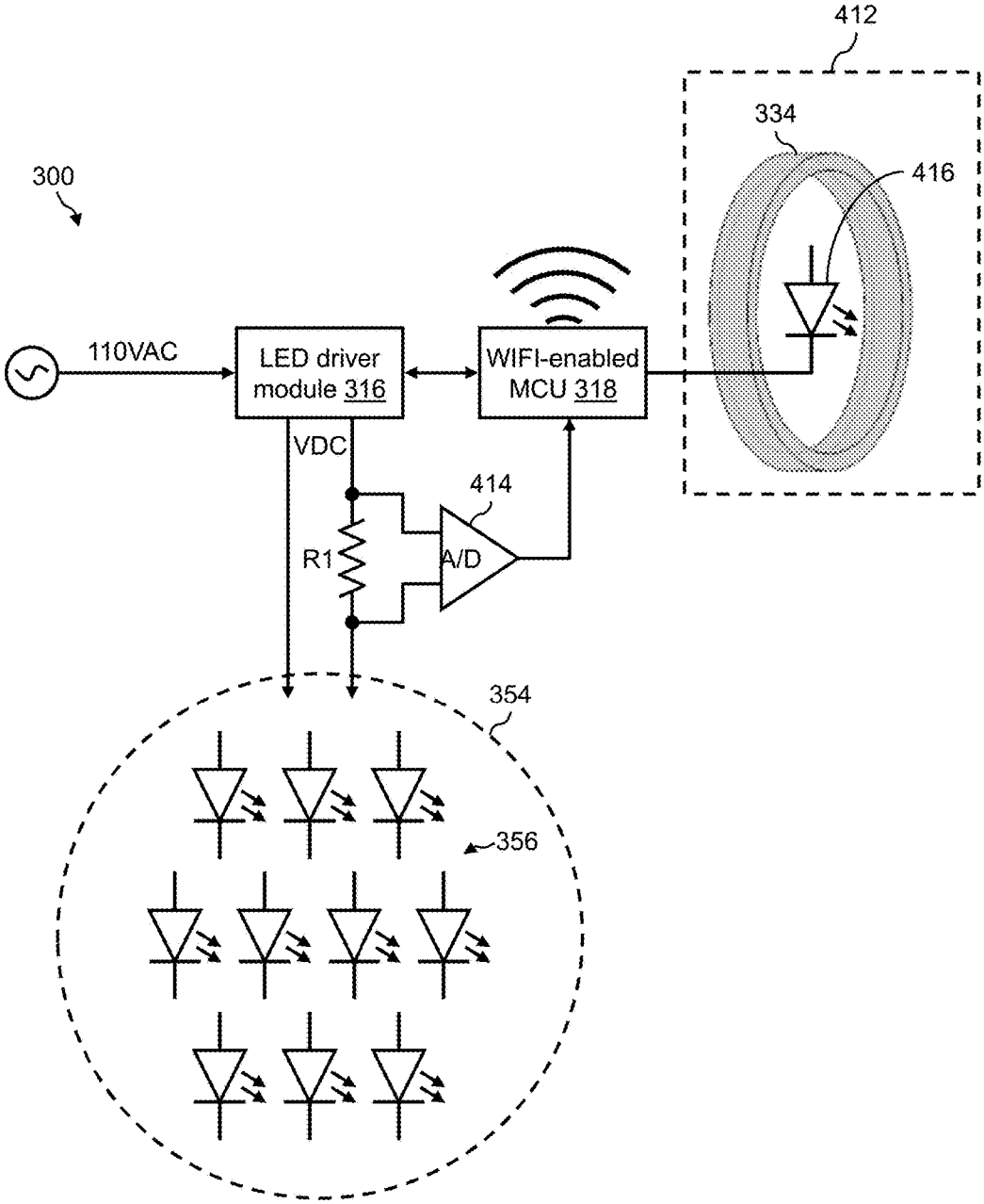
Figure 49:
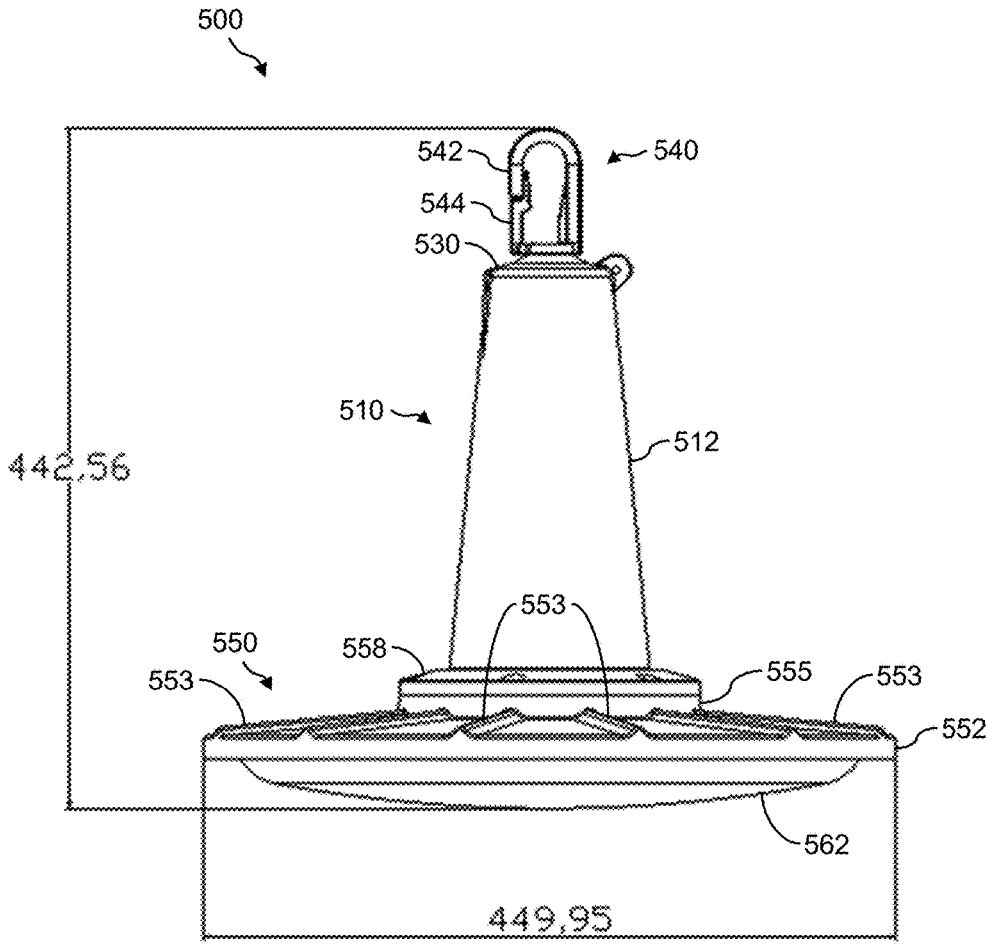
Figure 50:
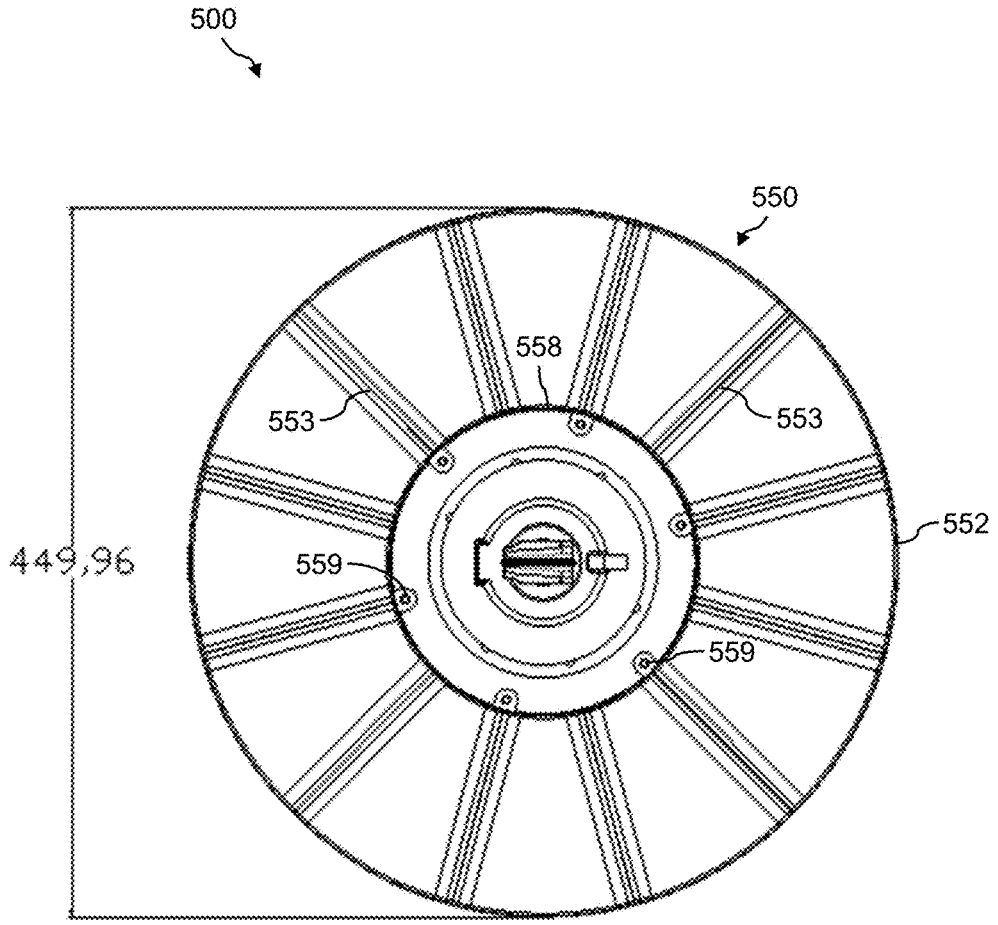
Figure 51:
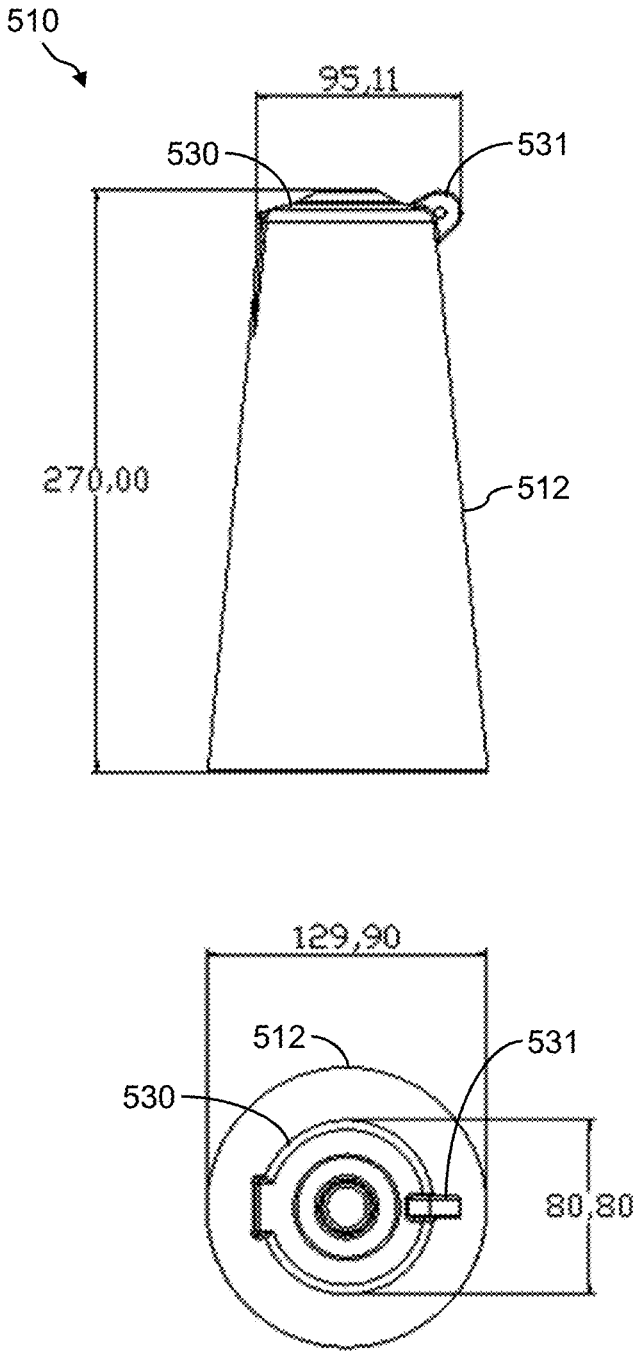
Figure 52:
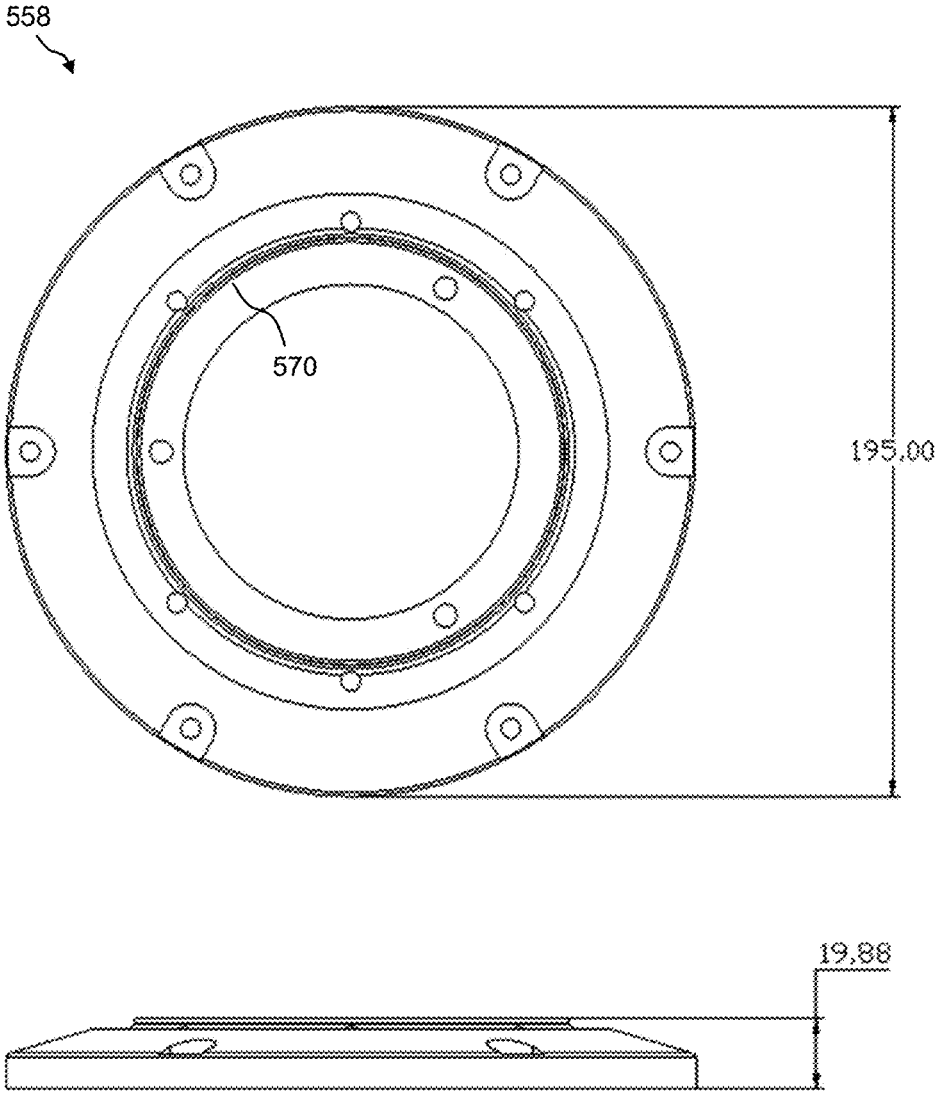
Figure 53:
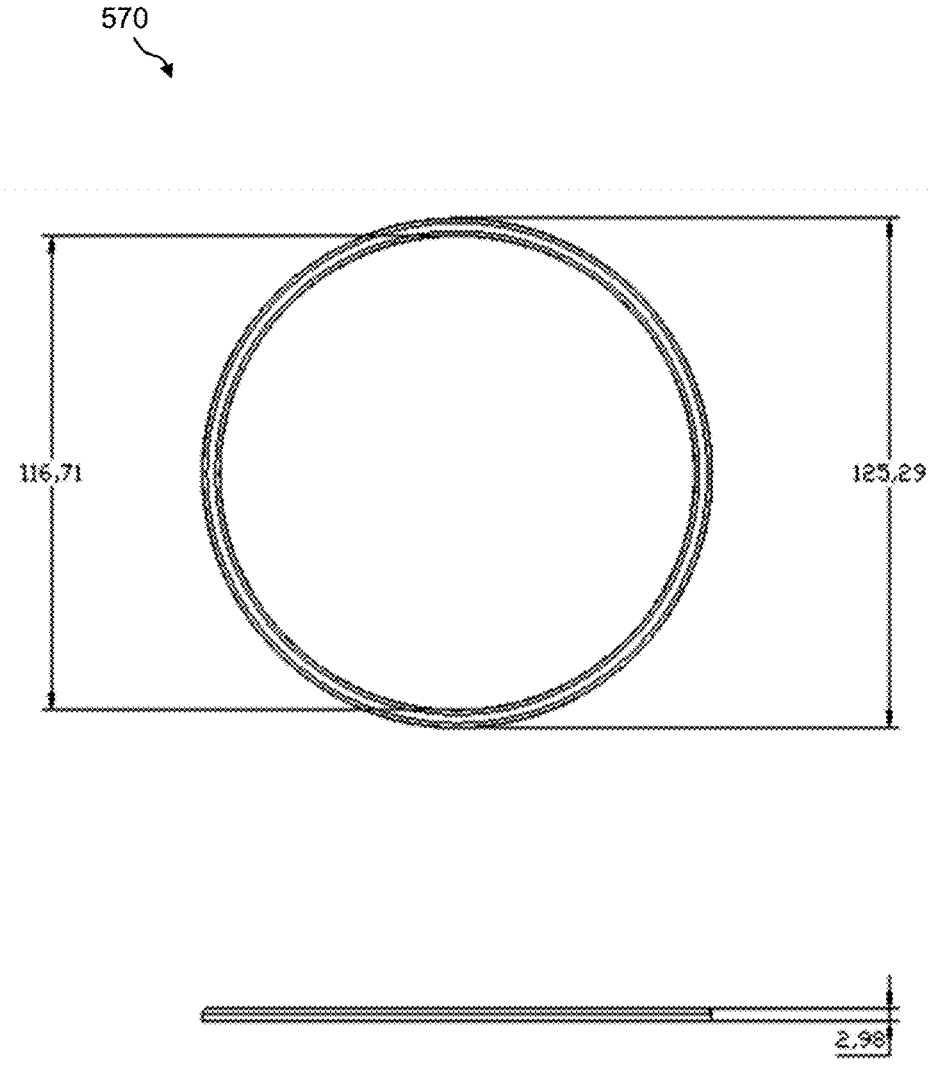
Figure 54:
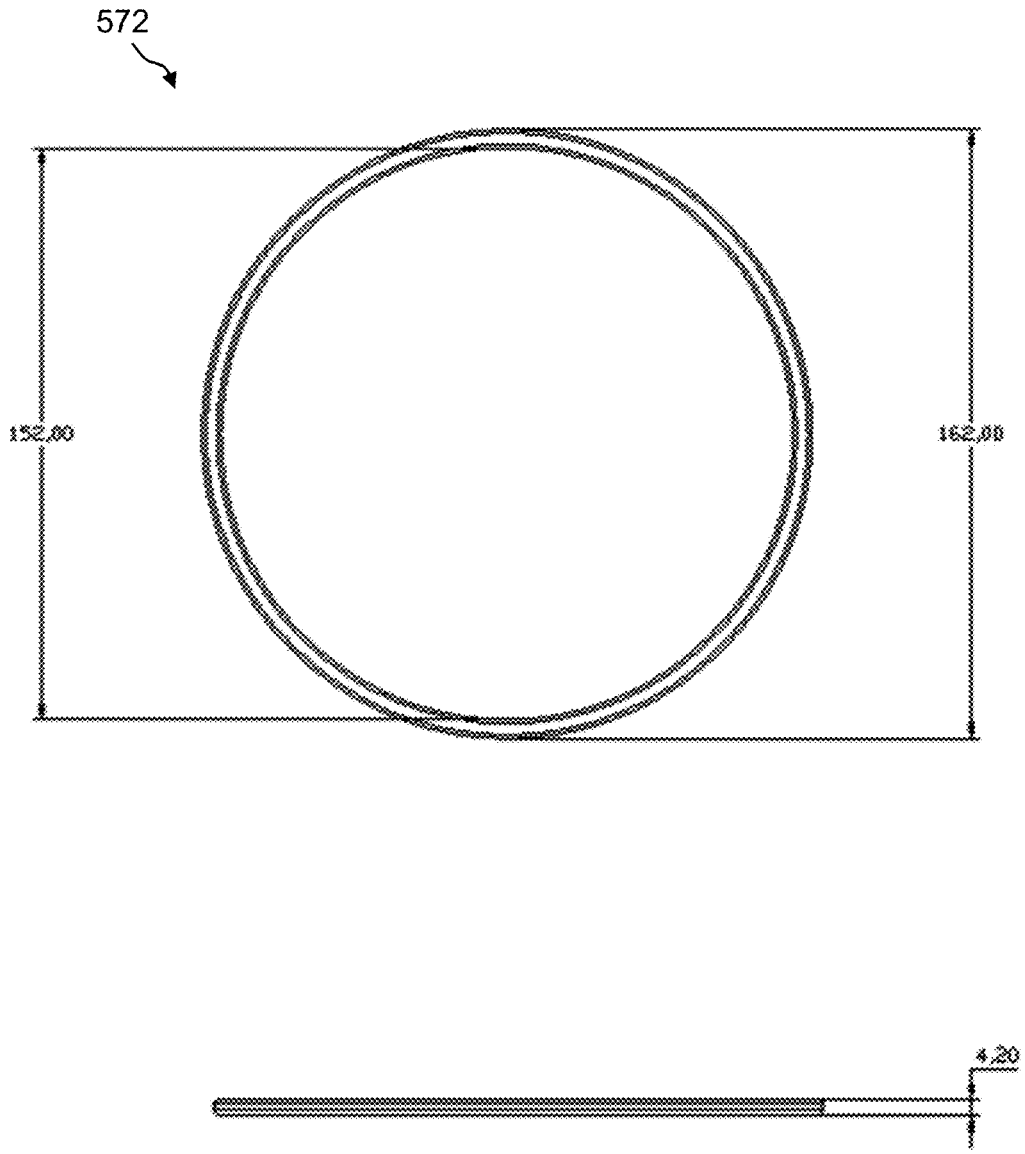
Figure 55:
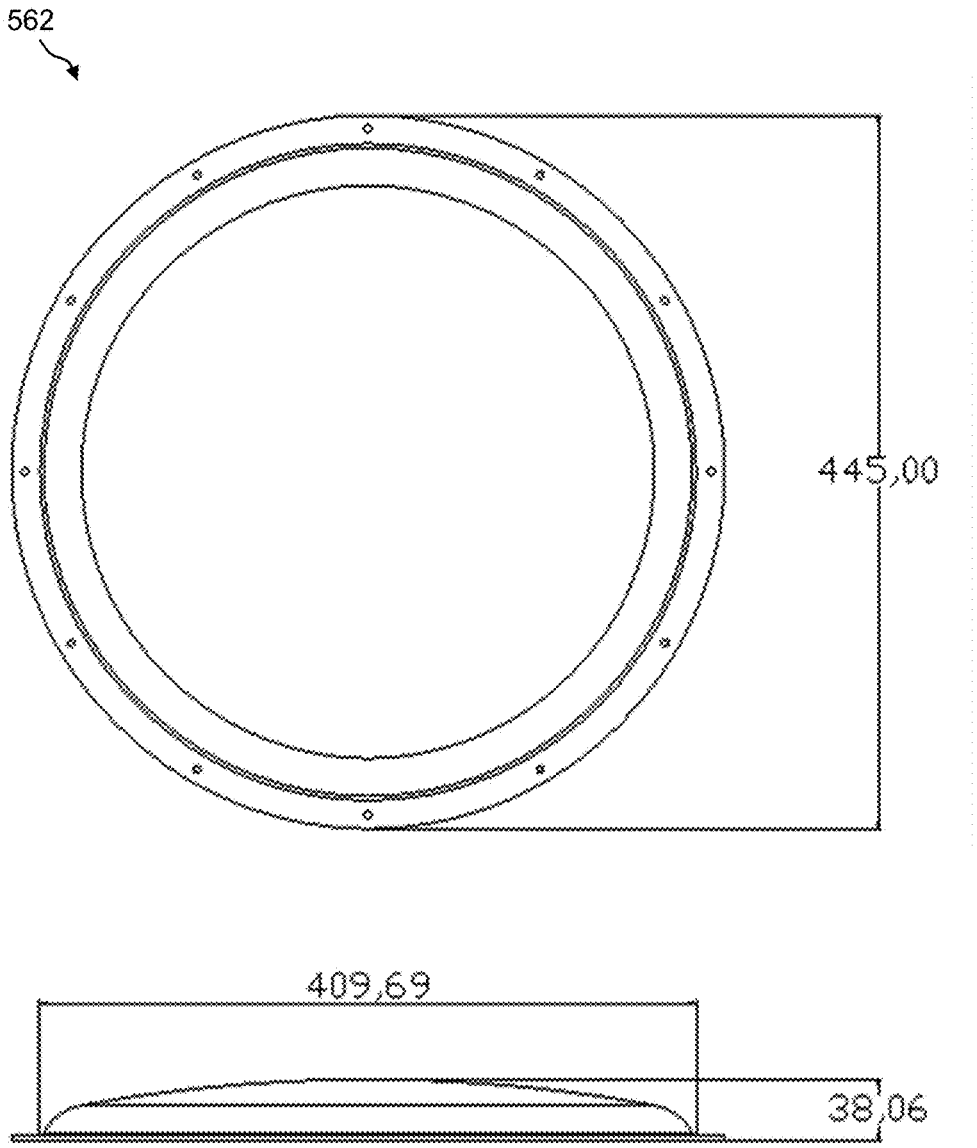
Figure 56:
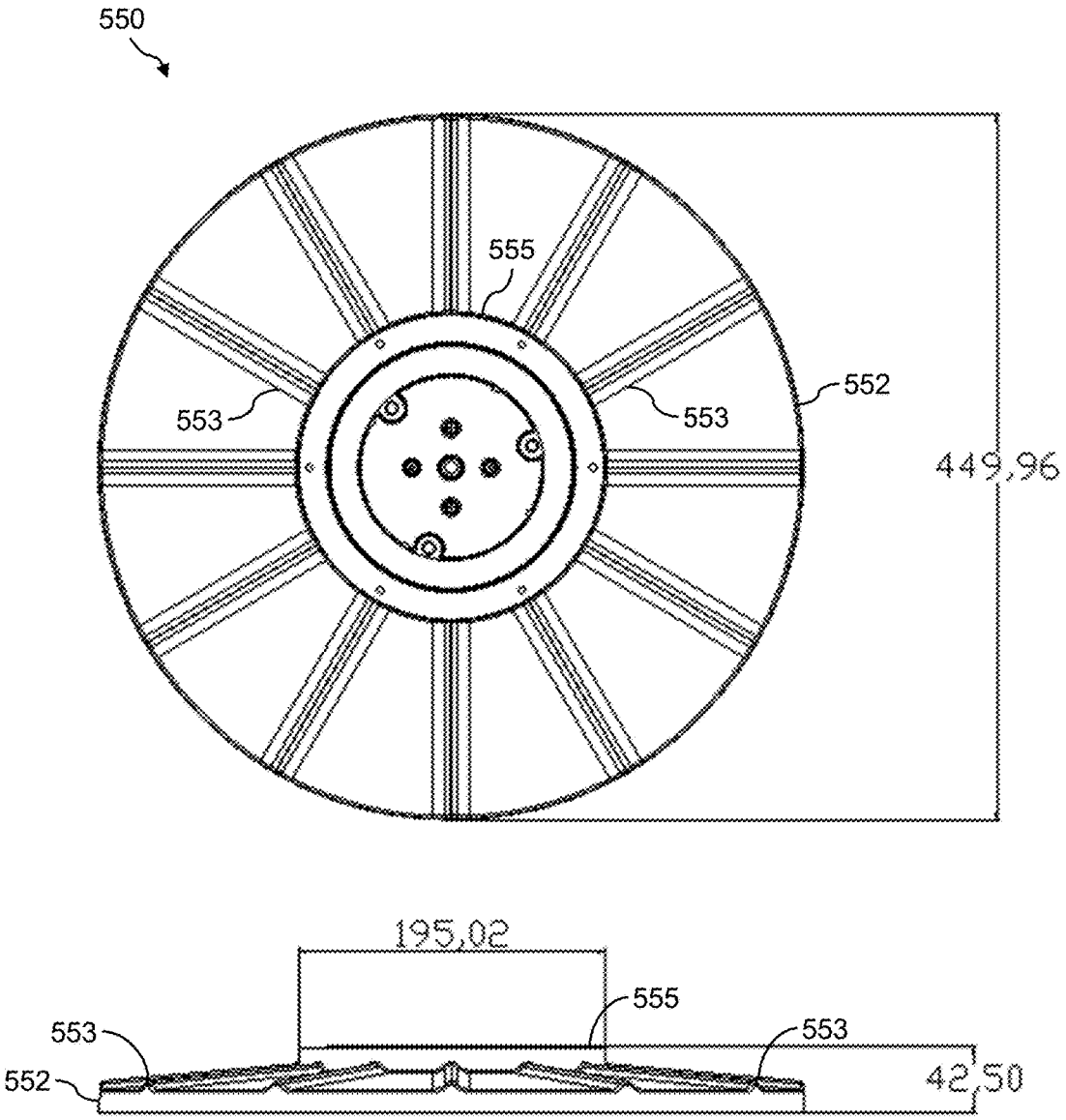
Figure 57:
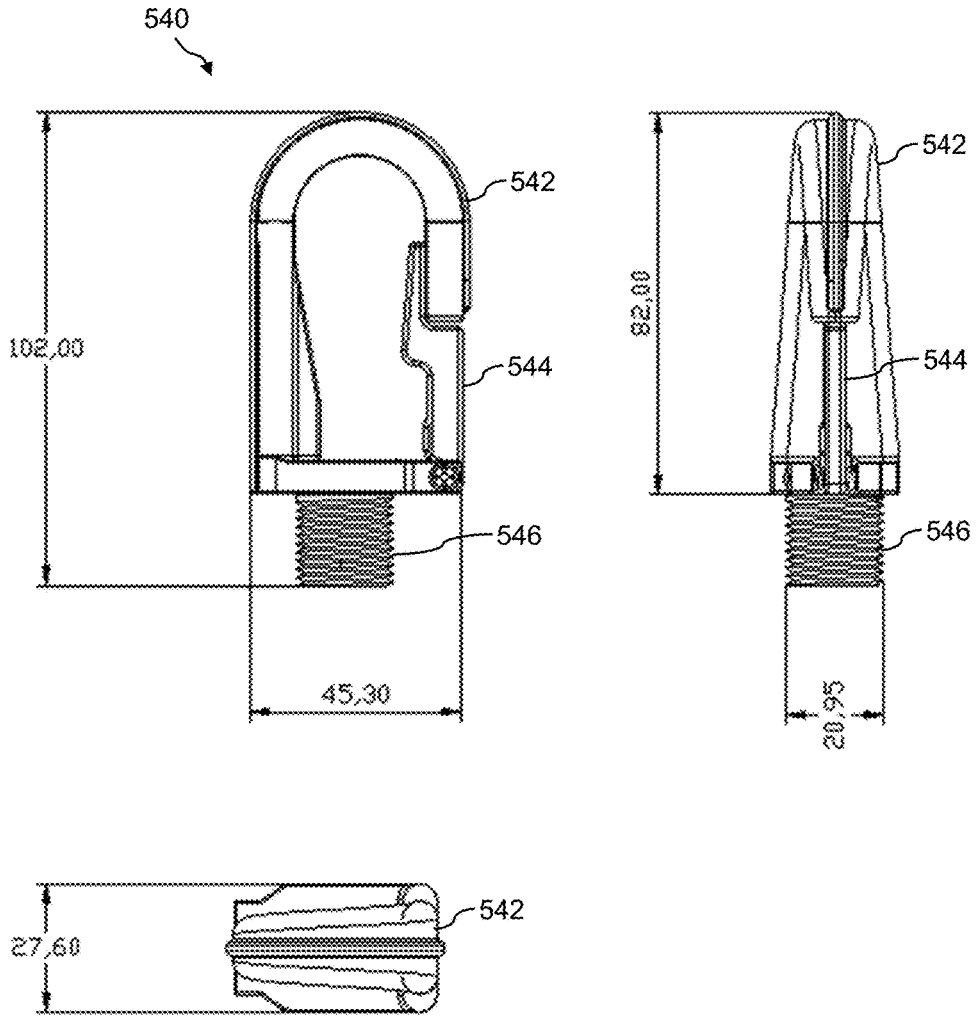

Having thus described the presently disclosed subject matter in general terms, reference will now be made to the accompanying Drawings, which are not necessarily drawn to scale, and wherein:

FIG. 1 illustrates a side view of an example of the presently disclosed LED light fixture according to a first embodiment;

FIG. 2 and FIG. 3 illustrate perspective views of the LED light fixture of FIG. 1;

FIG. 4 and FIG. 5 illustrate a top view and a bottom view, respectively, of the LED light fixture of FIG. 1;

FIG. 6 illustrates a perspective view of the LED light fixture absent the driver chamber body and driver heat sink and showing the driver module;

FIG. 7 illustrates a perspective view of the LED light fixture absent the driver chamber body and showing the driver module in relation to the driver heat sink;

FIG. 8 illustrates a cross-sectional view of the presently disclosed LED light fixture taken along the XY plane;

FIG. 9 illustrates a cross-sectional view of the presently disclosed LED light fixture taken along the YZ plane;

FIG. 10 illustrates a perspective view of the LED light fixture absent the hook assembly and the driver chamber cap;

FIG. 11 and FIG. 12 illustrate close up perspective views of the LED light fixture absent the hook assembly and the driver chamber cap with and without, respectively, the driver module present;

FIG. 13 illustrates a top view of the driver chamber only of the LED light fixture absent the hook assembly and the driver chamber cap;

FIG. 14 illustrates a perspective view of an example of the driver module of the presently disclosed LED light fixture;

FIG. 15 and FIG. 16 illustrate front and back perspective views, respectively, of an example of the driver heat sink of the presently disclosed LED light fixture;

FIG. 17A and FIG. 17B illustrate perspective views of the hook assembly with and without, respectively, the pressure ring present;

FIG. 18 illustrates a perspective view of the driver chamber body in relation to the center shaft of the presently disclosed LED light fixture;

FIG. 19 illustrates a perspective view of the driver chamber base in relation to the center shaft of the presently disclosed LED light fixture;

FIG. 20 illustrates a side view of the LED assembly in relation to the center shaft of the presently disclosed LED light fixture;

FIG. 21 illustrates a side view of the LED assembly, the driver chamber base, and the seal ring in relation to the center shaft of the presently disclosed LED light fixture;

FIG. 22 illustrates an exploded side view of the LED assembly, the driver chamber base, and the seal ring in relation to the center shaft of the presently disclosed LED light fixture;

FIG. 23 illustrates a top and bottom perspective view of the light board of the LED assembly of the presently disclosed LED light fixture;

FIG. 24 illustrates a bottom view of the light board of the LED assembly of the presently disclosed LED light fixture;

FIG. 25 illustrates a side view of the light board of the LED assembly in relation to the LED module of the LED assembly;

FIG. 26 and FIG. 27 illustrate a top view and a bottom view, respectively, of the LED module of the LED assembly of the presently disclosed LED light fixture;

FIG. 28 illustrates a perspective view and a close up view of the LED module of the LED assembly;

FIG. 29 illustrates an example of a schematic diagram of the presently disclosed LED light fixture;

FIG. 30 illustrates a side view of an example of a structure for forming the heat-dissipating components of the presently disclosed LED light fixture;

FIG. 31 illustrates a side view of an example of the presently disclosed LED light fixture according to another embodiment;

FIG. 32 and FIG. 33 illustrate perspective views of the LED light fixture of FIG. 31;

FIG. 34 and FIG. 35 illustrate a top view and a bottom view, respectively, of the LED light fixture of FIG. 31;

FIG. 36 and FIG. 37 illustrate exploded views of the LED light fixture of FIG. 31;

FIG. 38 illustrates a bottom view of the LED light fixture of FIG. 31 absent the lens thereof;

FIG. 39 illustrates a bottom view of the LED light fixture of FIG. 31 absent the top cap thereof;

FIG. 40A and FIG. 40B illustrate a perspective view and an end view, respectively, of one example of the driver chamber body of the LED light fixture of FIG. 31;

FIG. 41A and FIG. 41B illustrate a perspective view and an end view, respectively, of another example of the driver chamber body of the LED light fixture of FIG. 31;

FIG. 42A and FIG. 42B illustrate a perspective view and an end view, respectively, of yet another example of the driver chamber body of the LED light fixture of FIG. 31;

FIG. 43 and FIG. 44 illustrate perspective views of the LED light fixture of FIG. 31 absent the driver chamber body;

FIG. 45 illustrates perspective views of the driver chamber cap and the hook assembly of the LED light fixture of FIG. 31;

FIG. 46 illustrates a perspective view of the translucent seal ring of the LED light fixture of FIG. 31;

FIG. 47 and FIG. 48 show examples of schematic diagrams of the LED light fixture of FIG. 31;

FIG. 49 and FIG. 50 illustrate a side view and a top view, respectively, of an example of the presently disclosed LED light fixture according to yet another embodiment;

FIG. 51 shows a side view and a top view of an example of a driver chamber assembly of the LED light fixture of FIG. 49 and FIG. 50;

FIG. 52 shows a side view and a top view of an example of a base ring of the LED light fixture of FIG. 49 and FIG. 50;

FIG. 53 shows a top view and a side view of an example of an upper gasket of the base ring shown in FIG. 52;

FIG. 54 shows a top view and a side view of an example of a lower gasket of the base ring shown in FIG. 52;

FIG. 55 shows a bottom view and a side view of an example of a lens of the LED light fixture of FIG. 49 and FIG. 50;

FIG. 56 shows a top view and a side view of an example of an LED assembly of the LED light fixture of FIG. 49 and FIG. 50; and FIG. 57 shows a first side view, a second side view, and a top view of an example of a hook assembly of the LED light fixture of FIG. 49 and FIG. 50.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a high-bay LED light fixture. The presently disclosed high-bay LED light fixture is engineered for harsh commercial and industrial environments including, but not limited to, food and beverage processing facilities, livestock processing facilities, manufacturing and warehousing facilities, retail establishments, gymnasiums, health clubs, natatoriums, flight hangers, convention centers, sporting venues, parking facilities, and the like.

Generally, the presently disclosed high-bay LED light fixture includes a driver chamber assembly, a hook assembly, and an LED assembly. In one embodiment, the driver chamber assembly includes a two-piece housing. In another embodiment, the driver chamber assembly includes a one-piece housing. The LED assembly can be sealed with a lens, for example, an anti-glare, shatterproof, polycarbonate lens.

In some embodiments, the presently disclosed high-bay LED light fixture includes a motion sensor.

In yet other embodiments, the presently disclosed high-bay LED light fixture includes a visual status indicator, wherein the visual status indicator indicates, for example, the health of the LEDs and/or the operating mode of the LED light fixture.

An aspect of the presently disclosed high-bay LED light fixture that includes a visual status indicator is that it can provide, in a simple, and user-friendly way, a warning of degradation in performance and/or of an imminent failure, which allows corrective steps to be taken at the time of the degradation in performance and/or in advance of the failure. Accordingly, this feature of the presently disclosed high-bay LED light fixture enables planned preventative maintenance. This feature is useful, for example, when the age of the high-bay LED light fixture is not known and it is difficult to predict when service will be needed.

The presently disclosed high-bay LED light fixture is waterproof, dust tight, chemical resistant, and is capable of being chemically power washed daily with up to about 1600 psi. The features and/or characteristics of the aluminum alloy housing ensure that substantially no residue remains after wash down and allows the fixture to drip dry in minutes. The presently disclosed high-bay LED light fixture can operate efficiently in an ambient temperature range of, for example, from about −40° C. (−40° F.) to about 60° C. (140° F.).

The presently disclosed high-bay LED light fixture can operate using, for example, 140-watt LEDs. In some embodiments, the housing of the high-bay LED light fixture is coated with an anti-corrosive powder and/or a high emissivity coating to increase heat dissipation through radiation.

LED Light Fixture Featuring a Two-Piece Housing

Referring now to FIG. 1 through FIG. 3, which show various views of the presently disclosed LED light fixture 100 according to a first embodiment that features a two-piece housing. Namely, FIG. 1 shows a side view, FIG. 2 and FIG. 3 show perspective views, FIG. 4 shows a top view, and FIG. 3 shows a bottom view of the presently disclosed LED light fixture 100. The LED light fixture 100 includes a driver chamber assembly 110, a hook assembly 140, and an LED assembly 150; all arranged with respect to a center shaft 122 (e.g., a hollow shaft).

The driver chamber assembly 110 includes a driver chamber body (or housing) 112 that encloses an LED driver module 114 and a driver heat sink 116 (see FIG. 6 and FIG. 7). In this example, the driver chamber body 112 has a cylindrical shape. For strength and heat dissipation, an arrangement of ridges or ribs 111 is provided along the outer surface of the driver chamber body 112. The driver heat sink 116 further includes a plurality of fin members 118 for dissipating heat. A certain two of the fin members 118 along with a certain surface of the driver heat sink 116 form three sides of a compartment 120 for holding the LED driver module 114 (see FIG. 10, FIG. 11, FIG. 12, and FIG. 13). The center shaft 122 (e.g., a hollow shaft) runs axially through the driver chamber assembly 110 and connects at one end to the hook assembly 140 and at the other end to the LED assembly 150 (see FIG. 6, FIG. 7, FIG. 8, and FIG. 9). Also, the driver heat sink 116 is arranged with respect to the center shaft 122. Namely, the driver heat sink 116 includes a clamping feature 123 for fitting around the center shaft 122 (see FIG. 15 and FIG. 16). Then, the driver chamber body 112 is arranged with respect to the driver heat sink 116.

A heat pad 124 is provided between the LED driver module 114 and the driver chamber body 112 (see FIG. 6, FIG. 7, FIG. 13, and FIG. 14). The heat pad 124 contacts one side of the LED driver module 114 and a face 113 of the driver chamber body 112. The aforementioned two fin members 118 and surface of the driver heat sink 116 in combination with the face 113 of the driver chamber body 112 form the compartment 120 in its entirety.

The driver chamber body 112 is mechanically coupled to the driver heat sink 116 via a plurality of fasteners 126. In one example, the fasteners 126 are machine screws (see FIG. 1, FIG. 2, FIG. 6, and FIG. 7). By coupling together the driver heat sink 116 and the driver chamber body 112, one large heat sink is formed. A driver chamber base 128 is fitted against the lower portion of the driver chamber body 112. A seal (not shown) is provided around the upper side of the driver chamber base 128. A driver chamber cap 130 is fitted against the upper portion of the driver chamber body 112. A seal (not shown) is provided around the underside of the driver chamber cap 130. An eyelet 131 is provided on one side of the driver chamber cap 130.

The hook assembly 140 provides an easy and convenient means for hanging the LED light fixture 100. The hook assembly 140 includes a hook 142, a hook clip 144, and a pressure ring 146. A threaded portion 148 is provided at the lower portion of the hook 142 (see FIG. 17B). The hook 142 is mechanically coupled to the center shaft 122 of the driver chamber body 112 and in relation to the driver chamber cap 130 via the pressure ring 146. Further, electrical wires (not shown) for providing power to LED light fixture 100 may enter the center shaft 122 through a sealed opening (not shown) in the hook assembly 140.

The LED assembly 150 includes a light board 152 that houses an LED module 154. The LED module 154 includes a plurality of LEDs 156 arranged on a substrate 158. In one example, the LEDs 156 are white LEDs and the substrate 158 is a printed circuit board (PCB) (see FIG. 25, FIG. 26, FIG. 27, and FIG. 28). Further, the LED assembly 150 includes a lens 162 (see FIG. 1 and FIG. 3) that covers the LED module 154. In, for example, FIG. 2 and FIG. 3, the lens 162 is absent so that the LED module 154 is visible. In one example, the lens 162 is an anti-glare, shatterproof polycarbonate lens. The lens 162 is fastened to the light board 152 and the LED module 154 using, for example, screws and with a seal (not shown) there between, thereby protecting the LED module 154 against moisture, dust, chemicals, and/or corrosion.

The light board 152 includes a mating portion 160 that is designed to receive the driver chamber assembly 110 (see FIG. 23). For strength and heat dissipation, a plurality of ridges or ribs 161 is provided on the top of the light board 152. The ridges or ribs 161 extend radially from the mating portion 160 to the outer periphery of the light board 152. Further, a seal ring 170 is provided between the driver chamber base 128 of the driver chamber assembly 110 and the mating portion 160 of the light board 152 (see FIG. 22). The seal ring 170 provides a waterproof seal between the driver chamber assembly 110 and the LED assembly 150. Further, the seal ring 170 provides both thermal and electrical isolation between the driver chamber assembly 110 and the LED assembly 150. The seal ring 170 is formed of non-electrically conductive and non-thermally conductive material, such as, but not limited to, heat resistant silicone.

Certain components of the LED light fixture 100 are formed of materials capable of handling harsh environments and of dissipating heat. For example, the driver chamber body 112, the driver heat sink 116, the center shaft 122, the fasteners 126, the driver chamber base 128, and the driver chamber cap 130 of the driver chamber assembly 110 can be formed of an aluminum alloy material. Likewise, the hook 142, the hook clip 144, and the pressure ring 146 of the hook assembly 140 can be formed of an aluminum alloy material. Likewise, the light board 152 of the LED assembly 150 can be formed of an aluminum alloy material. Further, the smooth, seamless and downward angled aluminum alloy components of the LED light fixture 100 ensures zero residue remains after wash down and allows the LED light fixture 100 to drip dry in minutes.

Further, the power management characteristics of the LED light fixture 100 allow safe operation within an ambient temperature range of from about −40° C. (−40° F.) to about 60° C. (140° F.). Additionally, the LED light fixture 100 is designed to operate using 140 watt LEDs (see FIG. 28 and FIG. 29). Further, the components of the LED light fixture 100 can be coated with an anti-corrosive powder, and/or a high emissivity coating to increase heat dispensation through radiation (see FIG. 30). Optionally, the LED light fixture 100 can include a motion sensor for automatically turning the LED light fixture 100 on and off.

FIG. 6 shows the LED light fixture 100 absent the driver chamber body 112 and the driver heat sink 116 and showing the LED driver module 114, the center shaft 122, and the heat pad 124. FIG. 7 shows the LED light fixture 100 absent the driver chamber body 112 and showing the LED driver module 114 in relation to the driver heat sink 116.

FIG. 8 shows a cross-sectional view of the presently disclosed LED light fixture 100 taken along the XY plane, while FIG. 9 shows a cross-sectional view of the LED light fixture 100 taken along the YZ plane. Both showing the internal relationships of the components of the LED light fixture 100.

FIG. 10 shows the LED light fixture 100 absent the hook assembly 140 and the driver chamber cap 130. Similarly, FIG. 11 and FIG. 12 show close up views of the LED light fixture 100 absent the hook assembly 140 and the driver chamber cap 130. FIG. 11 shows the LED light fixture 100 with the LED driver module 114 installed. FIG. 12 shows the LED light fixture 100 without the LED driver module 114 installed. Further, FIG. 13 shows a top view of the driver chamber assembly 110 only of the LED light fixture 100 absent the hook assembly 140 and the driver chamber cap 130. These views show details of the two fin members 118 and surface of the driver heat sink 116 in combination with the face 113 of the driver chamber body 112, which together form the four sides of the compartment 120 that holds the LED driver module 114. These views also show details of the clamping feature 123.

FIG. 13 also shows the heat pad 124 fitted between one side of the LED driver module 114 and the face 113 of the driver chamber body 112. The heat pad 124 is a thermally conductive pad between the LED driver module 114 and the driver chamber body 112 for improving heat transfer from the LED driver module 114 to the driver chamber body 112. In one example, the heat pad 124 is about 3 mm thick. Referring now to FIG. 14 is a perspective view of an example of the LED driver module 114 and of the heat pad 124 in relation to the LED driver module 114.

FIG. 15 and FIG. 16 show front and back perspective views, respectively, of an example of the driver heat sink 116 and showing more details of the fin members 118, the compartment 120, and the clamping feature 123 for fitting around the center shaft 122.

FIG. 17A and FIG. 17B show perspective views of the hook assembly 140 with and without, respectively, the pressure ring 146. In particular, FIG. 17B shows the threaded portion 148 of the hook assembly 140.

FIG. 18 shows the driver chamber body 112 in relation to the center shaft 122 of LED light fixture 100. This view shows the face 113 of the driver chamber body 112. FIG. 19 shows the driver chamber base 128 in relation to the center shaft 122 of LED light fixture 100. FIG. 20 shows the LED assembly 150 in relation to the center shaft 122 of LED light fixture 100.

FIG. 21 shows a side view of the LED assembly 150, the driver chamber base 128, and the seal ring 170 in relation to the center shaft 122 of LED light fixture 100. FIG. 22 shows an exploded side view of the LED assembly 150, the driver chamber base 128, and the seal ring 170 in relation to the center shaft 122 of LED light fixture 100. FIG. 22 also shows a perspective view of the seal ring 170, showing more details thereof. Again, the seal ring 170 is a non-electrically conductive and non-thermally conductive seal ring that is formed, for example, of heat resistant silicone.

Referring again to FIG. 1 through FIG. 22, the presence of the hollow center shaft 122 creates a "chimney" feature within the LED light fixture 100. Namely, heat generated by the LED driver module 114 and the LED module 154 of the LED assembly 150 is drawn up the chimney (the hollow center shaft 122) and is dissipated via the driver heat sink 116 and the driver chamber body 112. Further, the center shaft 122 serves various other functions within the LED light fixture 100—(1) the center shaft 122 serves to bare the weight of the LED light fixture 100; (2) the center shaft 122 directly connects the hook assembly 140 on the top of the LED light fixture 100 to the LED assembly 150 on the bottom of the LED light fixture 100, wherein the LED assembly 150 is the heaviest part of the LED light fixture 100; (3) the center shaft 122 significantly reduces the load that the driver chamber assembly 110 bares, which allows the walls of the driver chamber assembly 110 to use light-weight materials and low cost manufacturing processes; and (4) the center shaft 122 provides a convenient and safe channel in which to run wires (not shown) within the LED light fixture 100.

Further, because the seal ring 170 provides thermal isolation between the driver chamber assembly 110 and the LED assembly 150, the driver heat sink 116 and the driver chamber body 112 are the components mainly responsible for dissipating heat from the LED driver module 114, while the light board 152 is the component mainly responsible for dissipating heat from the LED module 154.

FIG. 23 shows a top and bottom perspective view of the light board 152 of the LED assembly 150. In particular, FIG. 23 shows more details of the mating portion 160 of the light board 152. FIG. 24 shows a bottom view of the light board 152 of the LED assembly 150.

FIG. 25 shows a side view of the light board 152 in relation to the LED module 154 of the LED assembly 150. In particular, FIG. 25 shows the LED module 154, which includes the plurality of LEDs 156 (e.g., white LEDs) mounted on the substrate 158 (e.g., the PCB). FIG. 26 and FIG. 27 show a top view and a bottom view, respectively, of the LED module 154 of the LED assembly 150 of the LED light fixture 100.

Additionally, FIG. 28 shows a perspective view and a close up view of the LED module 154 of the LED assembly 150. In one example, there is a total of about 136 LEDs 156 mounted on the substrate 158. Each of the LEDs 156 can be, for example, a 1-watt white LED. The LEDs 156, however, are not limited to white LEDs only. The LEDs 156 can be any color or any combinations of two or more colors.

Referring now to FIG. 29 is an example of a schematic diagram of the presently disclosed LED light fixture 100. The schematic diagram shows the LED driver module 114 driving the LEDs 156. The LED driver module 114 can be any standard constant-current LED driver device that has a built in analog-to-digital converter (ADC) function and that has a power rating of from about 150 watts to about 200 watts. Namely, the LED driver module 114 can receive a standard AC input and then generate the required DC output to the LED module 154. For example, the AC input to the LED driver module 114 can be standard 110 VAC or 277 VAC and the output of the LED driver module 114 can be about 210 VDC at about 700 ma. The LED driver module 114 may have certain other features such as, but not limited to, short circuit protection, over voltage protection, and/or dimming capability. Examples of standard LED drivers suitable for LED driver module 114 may include, but are not limited to, the Xitanium 150 W 0.7A 210V Intellivolt LED driver available from Philips Lighting (Somerset, N.J.) and the PLED150 W-214-00700-xx LED driver available from Thomas Research Products (South Elgin, Ill.). The LED driver module 114 is used to drive the LEDs 156, wherein all the LEDs 156 are electrically connected in parallel.

Optionally, the LED light fixture 100 can include a controller (not shown) in combination with the LED driver module 114. Further, optionally, the LED light fixture 100 can include a motion sensor 180. In this example, a motion sensor 180 provides feedback to LED driver module 114, wherein the LED driver module 114 can turn on or off the LED module 154 of the LED light fixture 100 based on information from the motion sensor 180.

Referring now to FIG. 30 is a side view of an example of a structure 200 for forming the heat-dissipating components of the presently disclosed LED light fixture 100. The structure 200 includes, for example, an aluminum alloy layer 210, which is an example of the material used for forming certain components of the LED light fixture 100. The aluminum alloy layer 210 can be, for example, about 6 mm thick. An organic coating layer 212 is atop the aluminum alloy layer 210. The organic coating layer 212 can be, for example, about 2 mm thick. A high emissivity layer 214 is atop the organic coating layer 212. The high emissivity layer 214 can be, for example, about 1 mm thick.

LED Light Fixture Featuring a One-Piece Housing and Status Indicator

Referring now to FIG. 31 through FIG. 37, which show various views of the presently disclosed LED light fixture 300 according to another embodiment that features a one-piece housing and a visual status indicator. Namely, FIG. 31 shows a side view, FIG. 32 and FIG. 33 show perspective views, FIG. 34 shows a top view, FIG. 35 shows a bottom view, and FIG. 36 and FIG. 37 show exploded views of the presently disclosed LED light fixture 300. The LED light fixture 300 includes a driver chamber assembly 310, a hook assembly 340, and an LED assembly 350.

The driver chamber assembly 310 includes a driver chamber body (or housing) 312 and a driver chamber cap 330. As shown in FIG. 36 and FIG. 37, the driver chamber body 312 houses an LED driver module 316 and a controller module 318. In this example, the driver chamber body 312 has a cylindrical shape. For strength and heat dissipation, an arrangement of ridges or ribs 314 is provided along the outer surface of the driver chamber body 312. The hook assembly 340 is coupled to the driver chamber cap 330. The driver chamber cap 330 can be coupled to the driver chamber body 312 using, for example, screws 332. The controller module 318 may have wireless communications capability. In this case, the driver chamber assembly 310 further includes an antenna 336 (e.g., an 802.11b/g/n Wi-Fi Antenna) mounted, for example, atop the driver chamber cap 330.

A translucent seal ring 334 is sandwiched between the upper end of the driver chamber body 312 and the driver chamber cap 330. The translucent seal ring 334 provides two functions: (1) the translucent seal ring 334 provides a waterproof gasket between the driver chamber body 312 and the driver chamber cap 330, and (2) the translucent seal ring 334 provides an "optical window" through which light can be emitted, wherein the light can be used to indicate certain status conditions of the LED light fixture 300. Accordingly, the translucent seal ring 334 is formed of a sealing material that is substantially transparent or at least semitransparent or translucent to visible light. In one example, the translucent seal ring 334 is formed of a substantially transparent or at least semitransparent silicone rubber.

The translucent seal ring 334 can be any thickness that is capable of conveying light there through in a manner that is easily visible. The translucent seal ring 334 can be from about 0.125 inches to about 0.5 inches thick in one example, or is about 0.25 inches thick in another example. For the purpose of providing a status indicator in the LED light fixture 300, the presence of the translucent seal ring 334 eliminates the necessity of other types of visual indicators (e.g., LEDs) that might require that holes be put through the driver chamber body 312, requiring more seals and adding risk of leaks. More details of examples of status indicators are described herein below with reference to FIG. 47 and FIG. 48.

Optionally, in the LED light fixture 300, the translucent seal ring 334 can be replaced with a standard seal ring 334 that is not substantially transparent or at least opaque to visible light and therefore provides the sealing function only.

The hook assembly 340 provides an easy and convenient means for hanging the LED light fixture 300. The hook assembly 340 includes a hook 342 and a hook clip 344. A threaded portion 346 is provided at the lower portion of the hook 342 (see FIG. 43 and FIG. 45) for connecting to the driver chamber cap 330. Further, electrical wires (not shown) for providing power to LED light fixture 300 may enter the driver chamber body 312 through a sealed opening (not shown) and the threaded portion 346 of the hook assembly 340.

The LED assembly 350 includes a light board 352 that houses an LED module 354. FIG. 38 shows a bottom view of the LED light fixture 300 absent the lens (e.g., a lens 362) so that the LED module 354 is visible. FIG. 38 shows that the LED module 354 includes a plurality of LEDs 356 arranged on a substrate. In one example, the LEDs 356 are white LEDs and the substrate is a printed circuit board (PCB). The LED module 354 can be substantially the same as the LED module 154 described with reference to the LED light fixture 100 of FIG. 1 through FIG. 29.

Further, the LED assembly 350 includes the lens 362 that covers the LED module 354. In one example, the lens 362 is an anti-glare, shatterproof polycarbonate lens. The lens 362 is fastened to the light board 352 and the LED module 354 using, for example, screws 364 (see FIG. 35 and FIG. 43) and with a seal (not shown) there between, thereby protecting the LED module 354 against moisture, dust, chemicals, and/or corrosion.

The light board 352 includes a mating portion 355 (see FIG. 31 and FIG. 37) that is designed to receive the lower end of the driver chamber body 312. For strength and heat dissipation, a plurality of ridges or ribs 353 are provided on the top of the light board 352. The ridges or ribs 353 extend radially from the mating portion 355 to the outer periphery of the light board 352. Further, a seal ring 358 (see FIG. 37 and FIG. 44) is provided between the lower end of the driver chamber body 312 and the mating portion 355 of the light board 352. The seal ring 358 provides a waterproof gasket between the driver chamber body 312 and the light board 352. Further, the seal ring 358 provides both thermal and electrical isolation between the driver chamber assembly 310 and the LED assembly 350. Accordingly, the seal ring 358 is formed of non-electrically conductive and non-thermally conductive material, such as, but not limited to, heat resistant silicone. The light board 352 may be fastened to the lower end of the driver chamber body 312 via screws (not shown) that also pass through the seal ring 358.

Because the seal ring 358 provides thermal isolation between the driver chamber assembly 310 and the LED assembly 350, the driver chamber body 312 is the component mainly responsible for dissipating heat from the LED driver module 316 and the controller module 318, while the light board 352 is the component mainly responsible for dissipating heat from the LED module 354.

Certain components of the LED light fixture 300 are formed of materials capable of handling harsh environments and of dissipating heat. For example, the driver chamber body 312 and the driver chamber cap 330 of the driver chamber assembly 310, the hook 342 and the hook clip 344 of the hook assembly 340, and the light board 352 of the LED assembly 350 can be formed of an aluminum alloy material. Further, the smooth, seamless and downward angled components of the LED light fixture 300 ensures zero residue remains after wash down and allows the LED light fixture 300 to drip dry in minutes. The aluminum alloy components of the LED light fixture 300 can be based on the structure 200 shown in FIG. 30.

FIG. 39 illustrates a bottom view of the LED light fixture 300 of FIG. 31 absent the driver chamber cap 330 and showing the LED driver module 316 and the controller module 318 fitted within compartments of the driver chamber body 312. For example, the LED driver module 316 is fitted into a compartment 320 and the controller module 318 is fitted into a compartment 322.

The features of the driver chamber body 312 that houses the LED driver module 316 and the controller module 318 can vary. Namely, the features of the ridges or ribs 314 can vary and the size, shape, and geometry of the compartments 320, 322 can vary. FIG. 40A and FIG. 40B show a perspective view and an end view, respectively, of one example of the driver chamber body 312, wherein the driver chamber body 312 includes a driver module compartment 320 and a controller module compartment 322. FIG. 41A and FIG. 41B show a perspective view and an end view, respectively, of another example of the driver chamber body 312. FIG. 42A and FIG. 42B show a perspective view and an end view, respectively, of yet another example of the driver chamber body 312. In these three examples, the features of the ridges or ribs 314 vary and the features of the compartments 320, 322 vary.

Referring now to FIG. 43 and FIG. 44 are perspective views of the LED light fixture 300 absent the driver chamber body 312, thereby revealing the internal mating portions of the driver chamber cap 330, the hook assembly 340, and the LED assembly 350.

Referring now to FIG. 45 is perspective views of the driver chamber cap 330 and the hook assembly 340 of the LED light fixture 300, showing more details thereof.

Referring now to FIG. 46 is a perspective view of the translucent seal ring 334 of the LED light fixture 300, showing more details thereof. Again, the translucent seal ring 334 is substantially transparent or at least semitransparent to visible light. Not shown in FIG. 31 through FIG. 46 is a light source in relation to the translucent seal ring 334, wherein the light source is used to emit status information through the "optical window" formed by the translucent seal ring 334.

Referring now to FIG. 47 and FIG. 48 is examples of schematic diagrams of the presently disclosed LED light fixture 300 of FIG. 31 and describe more details about transmitting status information using a light source in combination with the translucent seal ring 334.

In FIG. 47, the schematic diagram shows the LED driver module 316 driving the LEDs 356 of the LED module 354. The LED driver module 316 can be any standard constant-current LED driver device that has a built in analog-to-digital converter (ADC) function and that has a power rating of from about 150 watts to about 200 watts. Namely, the LED driver module 316 can receive a standard AC input and then generate the required DC output to the LED module 354. For example, the AC input to the LED driver module 316 can be standard 110 VAC or 277 VAC and the output of the LED driver module 316 can be about 210 VDC at about 700 ma. The LED driver module 316 may have certain other features such as, but not limited to, short circuit protection, over voltage protection, and/or dimming capability. Examples of standard LED drivers suitable for LED driver module 316 may include, but are not limited to, the Xitanium 150 W 0.7 A 210V Intellivolt LED driver available from Philips Lighting (Somerset, N.J.) and the PLED150 W-214-00700-xx LED driver available from Thomas Research Products (South Elgin, Ill.). The LED driver module 316 is used to drive the LEDs 356, wherein all the LEDs 356 are electrically connected in parallel.

The schematic diagram of FIG. 47 also shows the controller module 318 electrically connected to the LED driver module 316. Namely, the LED driver module 316 provides power to the controller module 318, while the controller module 318 manages the overall operations of LED light fixture 300. In one example, the controller module 318 is monitoring the output of the LED driver module 316. For example, certain FEEDBACK from the output of LED driver module 316 allows the controller module 318 to monitor various characteristics that can indicate the health of the LED module 354. For example the controller module 318 monitors the output DC voltage and current. In one example, the controller module 318 monitors the LED module 354 in its entirety. In another example, the controller module 318 monitors multiple subsections of the LED module 354, depending on how the PCB is designed.

Further, the controller module 318 can have certain operating modes. For example, there may be a "normal" operating mode and a "power saver" operating mode. The "normal" operating mode is, for example, the full power operating mode of the LED light fixture 300. The "power saver" operating mode is, for example, the low power operating mode in which the LED light fixture 300 can be turned fully off or dimmed under system control to conserve energy.

The schematic diagram of FIG. 47 also shows a communications interface 410 and a status indicator 412 electrically connected to the controller module 318. The communications interface 410 may be any wired and/or wireless communication interface for connecting to a network (not shown) and by which information may be exchanged with other devices connected to the network. Examples of wired communication interfaces may include, but are not limited to, USB ports, RS232 connectors, RJ45 connectors, Ethernet, and any combinations thereof. Examples of wireless communication interfaces may include, but are not limited to, an Intranet connection, Internet, ISM, Bluetooth® technology, Bluetooth® Low Energy (BLE) technology, Wi-Fi, Wi-Max, IEEE 402.11 technology, ZigBee technology, Z-Wave technology, 6LoWPAN technology (i.e., IPv6 over Low Power Wireless Area Network (6LoWPAN)), ANT or ANT+(Advanced Network Tools) technology, radio frequency (RF), Infrared Data Association (IrDA) compatible protocols, Local Area Networks (LAN), Wide Area Networks (WAN), Shared Wireless Access Protocol (SWAP), any combinations thereof, and other types of wireless networking protocols. An example of communication facilitated by the communications interface 410 includes setting the operating mode ("normal" mode or "power saver" mode) of the LED light fixture 300.

In one example, the communications interface 410 is separate from the controller module 318. In another example, the communications interface 410 and the controller module 318 are integrated into a single device, an example of which is shown in the schematic diagram of FIG. 48. The status indicator 412 can be any means for indicating any type of status information about the LED light fixture 300. The status information can include, for example, health information about the LED module 354 and/or operating mode information about the LED light fixture 300. An example instantiation of the status indicator 412 that includes a light source in combination with the translucent seal ring 334 is shown in the schematic diagram of FIG. 48. Optionally, in FIG. 47 and FIG. 48, a motion sensor (e.g., the motion sensor 180 of FIG. 29) can be used on combination with the LED driver module 316 and the controller module 318.

Referring now to the schematic diagram of FIG. 48, the communications interface 410 and the controller module 318 shown in FIG. 47 are integrated into a single device; namely, a WIFI-enabled microcontroller unit (MCU) 318. In one example, the WIFI-enabled MCU 318 is the CC3200 MCU device with built-in Wi-Fi connectivity available from Texas Instruments (Dallas, Tex.). In this example, an analog-to-digital (A/D) converter 414 is used to monitor the current flow through a resister R1 suppling the LED module 354. The WIFI-enabled MCU 318 monitors the output reading of the A/D converter 414, which is an indication of the health of the LED module 354. Namely, a change in current reading over time indicates changing health condition of the LED module 354.

The schematic diagram of FIG. 48 also shows one or more LEDs 416 positioned in relation to the translucent seal ring 334, which is one example of implementing the status indicator 412 shown in FIG. 47 as a visual status indicator that is easily observable by eye. In one example, one or more LEDs 416 are mounted on the upper end of the LED driver module 316 or on the upper end of the controller module 318 so that any light emitted therefrom can be visible via the translucent seal ring 334.

Under the control of the WIFI-enabled MCU 318, the one or more LEDs 416 can emit various colors and/or blinking sequences to indicate, for example, certain health conditions and/or operating modes of the LED light fixture 300. Table 1 below shows an example of visual indicators of the status indicator 412.

TABLE 1

Example status indicator output

| Condition | Output color | Blinking Sequence |
|---|---|---|
| "normal" mode | Green | none |

TABLE 1-continued

| Example status indicator output | | |
|---|---|---|
| Condition | Output color | Blinking Sequence |
| "power saver" mode | Blue | none |
| "Connecting" mode | Orange | 1 time per second |
| "Lost Connection" mode | Red | 1 time per second |
| "Component Failure" mode | Red | none |

LED Light Fixture Featuring a One-Piece Tapered Housing

Referring now to FIG. 49 through FIG. 57, which show various views of the presently disclosed LED light fixture 500 according to yet another embodiment that features a one-piece tapered housing. The LED light fixture 500 shown in FIG. 49 through FIG. 57 features: (1) an easy assembly process; and (2) a design that enables components to be fully tested before assembly. Namely, an assembly process that does not break the integrity of components, which would require testing again after assembly.

FIG. 49 shows a side view and FIG. 50 shows a top view of the presently disclosed LED light fixture 500. The LED light fixture 500 includes a driver chamber assembly 510, a hook assembly 540, and an LED assembly 550.

The driver chamber assembly 510 includes a tapered driver chamber body (or housing) 512 and a driver chamber cap 530. The tapered driver chamber body 512 houses an LED driver module (not shown), such as LED driver module 316 of LED light fixture 300, and a controller module (not shown), such as controller module 318 of LED light fixture 300. In this example, the tapered driver chamber body 512 is substantially cone-shaped. In one example, the driver chamber cap 530 can be formed together with the tapered driver chamber body 512 as one piece. In another example, the driver chamber cap 530 and the tapered driver chamber body 512 can be formed separately and then fastened and sealed together. For example, the driver chamber cap 530 can be hinged atop the tapered driver chamber body 512. An eyelet 531 can be provided on one side of the driver chamber cap 530. More details of the driver chamber assembly 510 are shown in FIG. 51.

The hook assembly 540 is coupled to the driver chamber cap 530. The hook assembly 540 provides an easy and convenient means for hanging the LED light fixture 500. The hook assembly 540 includes a hook 542 and a hook clip 544. A threaded portion 546 is provided at the lower portion of the hook 542 for connecting to the driver chamber cap 530. Further, electrical wires (not shown) for providing power to LED light fixture 500 may enter the tapered driver chamber body 512 through a sealed opening (not shown) and the threaded portion 546 of the hook assembly 540. More details of the hook assembly 540 are shown in FIG. 57.

The LED assembly 550 includes a light board 552 that houses an LED module (not shown), such as LED module 354 of LED light fixture 300. Further, the LED assembly 550 includes a lens 562 that covers the LED module (not shown). In one example, the lens 562 is an anti-glare, shatterproof polycarbonate lens. The lens 562 is fastened to the light board 552 and the LED module using, for example, screws and with a seal (not shown) there between, thereby protecting the LED module against moisture, dust, chemicals, and/or corrosion. More details of the lens 562 are shown in FIG. 55. More details of the LED assembly 550 are shown in FIG. 56.

The light board 552 includes a mating portion 555 (see FIG. 56). A base ring 558 is provided between the lower end of the tapered driver chamber body 512 and the mating portion 555 of the light board 552. The base ring 558 provides a waterproof and dustproof coupler between the tapered driver chamber body 512 and the light board 552. Further, the base ring 558 can provide both thermal and electrical isolation between the driver chamber assembly 510 and the LED assembly 550. More details of the base ring 558 are shown in FIG. 52.

For strength and heat dissipation, a plurality of ridges or ribs 553 are provided on the top of the light board 552. The ridges or ribs 553 extend radially from the mating portion 555 to the outer periphery of the light board 552. The light board 552 may be fastened to base ring 558 via screws 559 (see FIG. 50).

Certain components of the LED light fixture 500 are formed of materials capable of handling harsh environments and of dissipating heat. For example, the tapered driver chamber body 512 and the driver chamber cap 530 of the driver chamber assembly 510, the hook 542 and the hook clip 544 of the hook assembly 540, and the light board 552 of the LED assembly 550 can be formed of an aluminum alloy material. Further, the smooth, seamless and downward angled components of the LED light fixture 500 ensures zero residue remains after wash down and allows the LED light fixture 500 to drip dry in minutes. The aluminum alloy components of the LED light fixture 500 can be based on the structure 200 shown in FIG. 30.

FIG. 51 shows a side view and a top view of an example of the tapered driver chamber body 512 and the driver chamber cap 530 of the driver chamber assembly 510. FIG. 51 shows example dimensions of the driver chamber cap 530 of the driver chamber assembly 510.

FIG. 52 shows a top view and a side view of an example of the base ring 558 of the presently disclosed LED light fixture 500. FIG. 52 shows example dimensions of the base ring 558. FIG. 53 shows a top view and a side view of an example of an upper gasket 570 for sealing the upper portion of the base ring 558 to the lower portion the tapered driver chamber body 512. FIG. 53 shows example dimensions of the gasket 570. Further, FIG. 54 shows a top view and a side view of an example of a lower gasket 572 for sealing the lower portion of the base ring 558 to the mating portion 555 of the light board 552. FIG. 54 shows example dimensions of the gasket 572.

In LED light fixture 500, the base ring 558 serves as a mounting bracket between the tapered driver chamber body 512 and the LED assembly 550. Using the base ring 558 to couple the tapered driver chamber body 512 and the LED assembly 550 allows fastening the two together without removing the lens 562 to access the mounting bolts or screws 556. Further, in other embodiments, the designs of the LED light fixture 100 shown in FIG. 1 through FIG. 29 and the LED light fixture 300 shown in FIG. 31 through FIG. 48 can be modified to include a base ring similar to the base ring 558 of LED light fixture 500.

FIG. 55 shows a bottom view and a side view of an example of the lens 562. FIG. 55 shows example dimensions of the lens 562.

FIG. 56 shows a top view and a side view of an example of the LED assembly 550. FIG. 56 shows example dimensions of the LED assembly 550.

FIG. 57 shows a first side view, a second side view, and a top view of an example of the hook assembly 540. FIG. 57 shows example dimensions of the hook assembly 540.

Referring now to FIG. 1 through FIG. 57, the LED light fixture 100, 300, 500 can be implemented in various physical sizes and power ratings. In one example, the specifications of the LED light fixture 100, 300, 500 are as indicated in Table 2 below.

TABLE 2

Specifications of the LED light fixture 100, 300, 500

| | Power Consumption | |
|---|---|---|
| | 150 W | 200 W |
| LED Chip | Philips | Philips |
| Lumen Output (IES) | >14700 lm | >24000 lm |
| Efficacy (IES) | >98 lm/watt | >120 lm/watt |
| Beam Angle | 60 Deg, 120 Deg | 60 Deg, 120 Deg |
| Color Temperature | 4000/5000 K Optional | 4000/5000 K Optional |
| CRI | >76 | >76 |
| Lumen Maintenance* | L70 >94,000 hrs | L70 >94,000 hrs |
| Input Voltage | 120-277 VAC | 120-277 VAC |
| LED Driver | Mean Well | Mean Well |
| Power Factor | >0.92 | >0.92 |
| IP Rating | IP66 | IP66 |
| Operating TEMP. | −40° C. to 55° C. | −40° C. to 55° C. |
| Dimensions (L × W × H) | 450 × 450 × 503 mm | 450 × 450 × 503 mm |
| Mounting Options | Hanging Ring | Hanging Ring |
| Fixture Material | Aluminum Alloy | Aluminum Alloy |
| Weight | 30 lbs (13.6 kg) | 30 lbs (13.6 kg) |

*Calculated Using TM-21 Calculator

In another example, the specifications of the LED light fixture 100, 300, 500 are as indicated in Table 3 below.

TABLE 3

Specifications of the LED light fixture 100, 300, 500

| | Power Consumption | | |
|---|---|---|---|
| | 150 W | 240 W | 300 W |
| LED Chip | LUMILEDS† | LUMILEDS | LUMILEDS |
| Lumen Output (IES) | >11,500 lm | >17,250 lm | >27,600 lm |
| Efficacy (IES) | >115 lm/watt | >115 lm/watt | >115 lm/W |
| Beam Angle | 60 Deg, 150 Deg | 60 Deg, 150 Deg | 60 Deg, 150 Deg |
| Color Temperature | 2750~5500 K Optional | 2750~5500 K Optional | 2750~5500 K Optional |
| CRI | ≥80 | ≥80 | ≥80 |
| Lumen Maintenance* | L70 >100,000 hrs | L70 >100,000 hrs | L70 >100,000 hrs |
| Input Voltage | 100-277 VAC | 100-277 VAC | 100-277 VAC |
| LED Driver | Mean Well | Mean Well | Mean Well |
| Power Factor | >0.95 | >0.95 | >0.95 |
| IP Rating | IP65 | IP65 | IP65 |
| Operating TEMP. | −40° C. to 65° C. | −40° C. to 65° C. | −40° C. to 65° C. |
| Humidity | 15% to 90% RH | 15% to 90% RH | 15% to 90% RH |
| Dimensions (L × W × H) | 590 × 590 × 537 mm | 590 × 590 × 537 mm | 590 × 590 × 537 mm |
| Mounting Options | Hanging Ring | Hanging Ring | Hanging Ring |
| Fixture Material | Aluminum Alloy | Aluminum Alloy | Aluminum Alloy |
| Weight | 30 lbs (13.6 kg) | 48 lbs (22 kg) | 52 lbs (24 kg) |

*Calculated Using TM-21 Calculator
†Lumileds Holding B.V., San Jose, California USA In summary, the presently disclosed LED light fixture 100, 300, 500 can be used, for example, as a high-bay LED light fixture. Namely, the LED light fixture 100, 300, 500 is engineered for harsh commercial and industrial environments including, but not limited to, food and beverage processing facilities, livestock processing facilities, manufacturing and warehousing facilities, retail establishments, gymnasiums, health clubs, natatoriums, flight hangers, convention centers, sporting venues, parking facilities, and the like.

Further, the presently disclosed LED light fixture 100, 300, 500 is waterproof, dust tight, chemical resistant, and is capable of being chemically power washed daily with up to about 1600 psi. The features and/or characteristics of the aluminum alloy housing ensure zero residue remains after wash down and allows the fixture to drip dry in minutes. For example, the shapes, contours, and angels of the features and/or characteristics of the driver chamber assembly 110, 310, 510 the hook assembly 140, 340, 540, and the LED assembly 150, 350, 550 ensure zero residue remains after wash down and allows the fixture to drip dry in minutes. Further, the presently disclosed LED light fixture 100, 300, 500 can operate in an ambient temperature range of from about −40° C. (−40° F.) to about 60° C. (140° F.).

Further, the presently disclosed high-bay LED light fixture 300 that includes the visual status indicator 412 can provide, in a simple way, a warning of degradation in performance and/or of an imminent failure, which allows corrective steps to be taken at the time of the degradation in performance and/or in advance of the failure, i.e., enables planned preventative maintenance. This feature is useful, for example, when the age of the high-bay LED light fixture 300 is not known and it is difficult to predict when service will be needed.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A high-bay light emitting diode (LED) fixture comprising a driver chamber assembly and an LED assembly:

wherein the driver chamber assembly comprises: (i) a driver chamber body comprising an LED driver module and a controller module operationally positioned therein; and (ii) a driver chamber cap, wherein a lower portion of the driver chamber cap is mechanically coupled to an upper end of the driver chamber assembly, wherein the driver chamber assembly further comprises a seal ring sandwiched between the upper end of the driver chamber body and the lower portion of the driver chamber cap, thereby forming a waterproof seal between the driver chamber body and the driver chamber cap;

wherein the driver chamber body comprises a plurality of ridges or ribs running along a length of an outer surface of the driver chamber body and arranged parallel to one another;

wherein the LED assembly comprises a light board comprising an LED module, wherein the LED module comprises a plurality of LEDs arranged on a substrate and a lens, wherein the lens is attached to the light board and adapted to cover the LED module;

wherein the light board comprises a mating portion adapted to receive a lower end of the driver chamber body and a seal ring sandwiched between the lower end of the driver chamber body and the mating portion of the light board, thereby providing a waterproof seal between the light board and the driver chamber body;

wherein the light board further comprises a plurality of ridges or ribs extending radially from the mating portion to an outer periphery of the light board; and wherein an outer surface of the driver chamber assembly and an outer surface of the LED assembly are coated with an anti-corrosive powder and a high emissivity coating.

2. The high-bay light emitting diode (LED) fixture of claim 1, wherein the seal ring sandwiched between the upper end of the driver chamber body and the lower portion of the driver chamber cap comprises a translucent material.

3. The high-bay light emitting diode (LED) fixture of claim 2, wherein the translucent material comprises a substantially transparent or semitransparent silicone rubber.

4. The high-bay light emitting diode (LED) fixture of claim 2, further comprising one or more indicator lights adapted to indicate one or more status conditions of one or more components of the high-bay LED fixture.

5. The high-bay light emitting diode (LED) fixture of claim 1, wherein the driver chamber assembly and LED assembly comprise an aluminum alloy.

6. The high-bay light emitting diode (LED) fixture of claim 1, further comprising a hook assembly mechanically coupled to an upper portion of the driver chamber cap.

7. The high-bay light emitting diode (LED) fixture of claim 6, wherein the hook assembly comprises a hook and a hook clip.

8. The high-bay light emitting diode (LED) fixture of claim 1, wherein the controller module comprises an antenna adapted for wireless communication.

9. The high-bay light emitting diode (LED) fixture of claim 1, wherein the substrate comprising the LED module comprises a printed circuit board.

10. A high-bay light emitting diode (LED) fixture comprising a driver chamber assembly and an LED assembly, wherein:

the driver chamber assembly comprises a driver chamber body and a driver heat sink, wherein the driver chamber body and driver heat sink are mechanically coupled and operationally arranged with respect to a hollow shaft running axially through a center of the driver chamber assembly;

wherein the driver chamber body comprises a plurality of ridges or ribs running parallel to the hollow shaft and arranged parallel to one another along an outer surface of the driver chamber body;

wherein the driver heat sink comprises a plurality of fin members, wherein two fin members and one surface of the drive heat sink in combination with an inner surface of the driver chamber body form four sides of a compartment adapted to enclose a LED driver module;

wherein the driver chamber body further comprises a heat pad positioned between the LED driver module and the inner surface of the driver chamber body, wherein the heat pad is in contact with one side of the LED driver module and the inner surface of the driver chamber body forming the compartment adapted to enclose the LED driver module;

wherein the driver chamber assembly further comprises a driver chamber cap fitted against an upper portion of the driver chamber body, wherein the driver chamber cap further comprises a seal forming a waterproof seal with the driver chamber assembly;

wherein the driver chamber assembly comprises a driver chamber base fitted against a lower portion of the driver chamber body and wherein the LED assembly is mechanically coupled to a lower portion of the driver chamber base through a mating portion, wherein the mating portion comprises a seal ring forming a waterproof seal with the driver chamber base;

wherein the LED assembly comprises a light board comprising an LED module, wherein the LED module comprises a plurality of LEDs arranged on a substrate and a lens, wherein the lens is attached to the light board and adapted to cover the LED module, wherein an outer surface of the light board comprises a plurality of ridges or ribs extending radially from the mating portion to an outer periphery of the light board; and wherein an outer surface of the driver chamber assembly and an outer surface of the LED assembly are coated with an anti-corrosive powder and a high emissivity coating.

11. The high-bay LED fixture of claim 10, wherein one or more of the driver chamber body, the driver heat sink, the hollow shaft, the driver chamber base, and the driver chamber cap comprise an aluminum alloy.

12. The high-bay LED fixture of claim 10, wherein the ring seal comprising the mating portion of the light board comprises a non-electrically conductive and non-thermally conductive material.

13. The high-bay LED fixture of claim 12, wherein the non-electrically conductive and non-thermally conductive material comprises a heat-resistant silicone.

14. The high-bay LED fixture of claim 10, wherein the heat pad comprises a thermally conductive pad.

15. The high-bay LED fixture of claim 10, further comprising a motion sensor adapted to automatically turn the LED fixture on and off.

16. The high-bay LED fixture of claim 10, further comprising a controller.

17. The high-bay LED fixture of claim 10, wherein the driver chamber assembly comprises a one-piece housing.

18. The high-bay LED fixture of claim 10, further comprising a hook assembly.

19. The high-bay LED fixture of claim 10, wherein the driver chamber body has a cylindrical shape.

20. A high-bay light emitting diode (LED) fixture comprising a driver chamber assembly and an LED assembly:

wherein the driver chamber assembly comprises: (i) a driver chamber body comprising an LED driver module and a controller module operationally positioned therein; and (ii) a driver chamber cap, wherein a lower portion of the driver chamber cap is mechanically coupled to an upper end of the driver chamber assembly, wherein the driver chamber assembly further comprises a seal ring sandwiched between the upper end of the driver chamber body and the lower portion of the driver chamber cap, thereby forming a waterproof seal between the driver chamber body and the driver chamber cap;

wherein the LED assembly comprises a light board comprising an LED module, wherein the LED module comprises a plurality of LEDs arranged on a substrate and a lens, wherein the lens is attached to the light board and adapted to cover the LED module;

wherein the light board comprises a mating portion adapted to receive a lower end of the driver chamber body and a base ring sandwiched between the lower end of the driver chamber body and the mating portion of the light board, wherein the base ring further comprises a top gasket for sealing an upper portion of the base ring to the lower end of the driver chamber body and a bottom gasket for sealing a lower portion of the base ring to the mating portion of the light board, thereby providing a waterproof seal between the light board and the driver chamber body;

wherein the light board further comprises a plurality of ridges or ribs extending radially from the mating portion to an outer periphery of the light board; and wherein an outer surface of the driver chamber assembly and an outer surface of the LED assembly are coated with an anti-corrosive powder and a high emissivity coating.

21. The high-bay light emitting diode (LED) fixture of claim 20, wherein the seal ring sandwiched between the upper end of the driver chamber body and the lower portion of the driver chamber cap comprises a translucent material.

22. The high-bay light emitting diode (LED) fixture of claim 21, wherein the translucent material comprises a substantially transparent or semitransparent silicone rubber.

23. The high-bay light emitting diode (LED) fixture of claim 21, further comprising one or more indicator lights adapted to indicate one or more status conditions of one or more components of the high-bay LED fixture.

24. The high-bay light emitting diode (LED) fixture of claim 20, wherein the driver chamber assembly and LED assembly comprise an aluminum alloy.

25. The high-bay light emitting diode (LED) fixture of claim 20, further comprising a hook assembly mechanically coupled to an upper portion of the driver chamber cap.

26. The high-bay light emitting diode (LED) fixture of claim 25, wherein the hook assembly comprises a hook and a hook clip.

27. The high-bay light emitting diode (LED) fixture of claim 20, wherein the controller module comprises an antenna adapted for wireless communication.

28. The high-bay light emitting diode (LED) fixture of claim 20, wherein the substrate comprising the LED module comprises a printed circuit board.

29. The high-bay light emitting diode (LED) fixture of claim 20, wherein the driver chamber body comprises a plurality of ridges or ribs running along a length of an outer surface of the driver chamber body and arranged parallel to one another.

30. The high-bay light emitting diode (LED) fixture of claim 20, wherein the driver chamber body is tapered.

31. The high-bay light emitting diode (LED) fixture of claim 20, wherein the driver chamber body and the light board are fastened to the base ring via screws.

* * * * *